US011047637B2

(12) United States Patent
Regan

(10) Patent No.: US 11,047,637 B2
(45) Date of Patent: Jun. 29, 2021

(54) INTRINSICALLY SAFE FIREARM

(71) Applicant: Brent Ford Regan, Coeur d'Alene, ID (US)

(72) Inventor: Brent Ford Regan, Coeur d'Alene, ID (US)

( * ) Notice: Subject to any disclaimer, the term of this patent is extended or adjusted under 35 U.S.C. 154(b) by 0 days.

(21) Appl. No.: 16/930,276

(22) Filed: Jul. 15, 2020

(65) Prior Publication Data

US 2021/0033363 A1 Feb. 4, 2021

Related U.S. Application Data

(63) Continuation of application No. 16/529,246, filed on Aug. 1, 2019, now Pat. No. 10,746,488.

(51) Int. Cl.

| | |
|---|---|
| ***F41A 11/04*** | (2006.01) |
| ***F41A 9/17*** | (2006.01) |
| ***F41A 9/38*** | (2006.01) |
| *F41C 9/02* | (2006.01) |

(52) U.S. Cl.

CPC ..... *F41A 11/04* (2013.01); *F41A 9/17* (2013.01); *F41A 9/38* (2013.01); *F41C 9/02* (2013.01)

(58) Field of Classification Search

CPC .... F41A 11/04; F41A 9/17; F41A 9/38; F41C 9/02

USPC ..... 42/70.02, 70.01, 71.01, 71.02, 72, 73, 42/75.03, 14

See application file for complete search history.

(56) References Cited

U.S. PATENT DOCUMENTS 1,454,454 A * 5/1923 Rosier ..... F41C 23/04 42/59
4,625,621 A * 12/1986 Warin ..... F41C 9/02 42/1.09
5,235,769 A 8/1993 Stead et al.
5,305,539 A * 4/1994 Von Kuster ..... F41A 11/04 42/69.01

(Continued)

FOREIGN PATENT DOCUMENTS

CA 2970349 A1 * 6/2015 ..... F41C 3/00
DE 324634 C * 9/1920 ..... F41C 9/02

(Continued)

OTHER PUBLICATIONS

NPL: https://overwatchprecision.com/blog/glock-safeties-the-basics/ Oct. 3, 2018.*

(Continued)

*Primary Examiner* — John Cooper
(74) *Attorney, Agent, or Firm* — FIG. 1 Patents

(57) ABSTRACT

An intrinsically safe firearm may include a handle and a frame connected by a pivot pin. One or more latches of the firearm can temporarily fix the firearm in a stowed orientation or a deployed orientation. In the deployed orientation, a magazine of the firearm can be removed from the handle; a slide of the firearm can be removed from the frame; a magazine safety allows a firing pin to strike a primer of a round in the firearm; and a trigger of the firearm is accessible to discharge the round in the firearm. In the stowed orientation, the magazine is not removable from the handle; the slide is not removable from the frame; the magazine safety prevents the firing pin from striking the primer; and the trigger of the firearm is not accessible.

20 Claims, 42 Drawing Sheets

(56) References Cited

U.S. PATENT DOCUMENTS

| | | | | |
|---|---|---|---|---|
| 7,739,821 | B1 * | 6/2010 | Hamme | F41C 9/02 42/8 |
| D622,802 | S | 8/2010 | Fitzpatrick et al. | |
| 7,941,956 | B2 | 5/2011 | Carr et al. | |
| 8,006,425 | B2 | 8/2011 | Burt et al. | |
| 8,051,594 | B2 | 11/2011 | Carr et al. | |
| D819,157 | S | 5/2018 | Kjellberg | |
| 10,175,012 | B2 | 1/2019 | Anderson et al. | |
| 10,746,488 | B1 | 8/2020 | Regan | |
| 2009/0277066 | A1 * | 11/2009 | Burt | F41A 3/66 42/6 |
| 2010/0242329 | A1 * | 9/2010 | Carr | F41A 11/04 42/14 |
| 2015/0219419 | A1 * | 8/2015 | Bondhus | F41A 11/04 42/2 |
| 2017/0131052 | A1 * | 5/2017 | Voigt | F41C 23/22 |
| 2017/0321981 | A1 * | 11/2017 | Voigt | F41A 17/46 |
| 2019/0025012 | A1 * | 1/2019 | Hall | F41A 5/26 |
| 2019/0033026 | A1 * | 1/2019 | Full | F41C 23/10 |
| 2019/0331445 | A1 * | 10/2019 | Full | F41A 19/11 |

FOREIGN PATENT DOCUMENTS

| | | | | |
|---|---|---|---|---|
| FR | 2811418 | | 1/2002 | |
| RU | 2000538 | | 9/1993 | |
| WO | WO-2017044589 | A1 * | 3/2017 | F41C 9/02 |
| WO | WO-2017136838 | A1 * | 8/2017 | F41A 11/04 |

OTHER PUBLICATIONS

"Notice of Allowance", U.S. Appl. No. 16/529,246, dated Apr. 15, 2020, 10 pages.

* cited by examiner

204

206

1000

1002

1100

1102

1106

INTRINSICALLY SAFE FIREARM

This application is a continuation of and claims priority to U.S. patent application Ser. No. 16/529,246, filed Aug. 1, 2019, entitled "Intrinsically Safe Firearm," the entire disclosure of which is hereby incorporated by reference herein in its entirety.

BACKGROUND

Firearms are ubiquitous in the United States and tragic events related to accidental or unintentional discharge of these firearms are a subject of much concern to the populous as a whole. In one such tragedy, a young mother was killed while shopping when her two year old toddler accidently discharged a firearm. In this example, the mother was licensed to carry the firearm and it was stored in a zipped pocket of the mother's purse. This pocket was specifically designed for carrying concealed firearms, but the toddler unzipped the pocket and retrieved the concealed firearm before causing the discharge of one fatal round.

The problem of accidental firearm discharge is particularly acute in the context of personal defense firearms because these firearms are generally designed for concealment and to fire quickly and easily. In particular, firearms for personal defense are usually designed with limited safety features so that a user can quickly and easily fire rounds in response to an unexpected threat which makes personal defense firearms inherently less safe than firearms for hunting or recreational activities. In other words, reducing a risk of accidental discharge can increase a risk that a personal defense firearm will not be effective when used for self-defense. For example, storing a personal defense firearm separate from its ammunition would greatly reduce the risk that the firearm will discharge accidently; however, this would also increase an amount of time and effort involved in preparing the firearm to discharge the ammunition in response to an identified threat.

Conventional personal defense systems typically support rudimentary safety measures to prevent unintentional discharge. These conventional personal defense firearms may include a "safety" which can refer to any single means of prevention of an accidental discharge but which commonly refers to a minimum magnitude of an applied force to actuate a trigger or a button which can be actuated to release a lock. However, because of concerns that the firearm will not be effective when it is used for personal protection, many users carry firearms with the available safety features disengaged. This tends to further increase accident rates related to personal defense firearms. While the number of known accidents is significant, an actual number of unintentional discharges of these types of firearms is not known since "near-miss" scenarios are frequently not reported.

This problem is compounded by the nature of personal defense in that incidents involving use of a firearm for protection are largely unpredictable. Because of this unpredictability, personal defense firearms are typically worn by a user or stored in close proximity to the user. As a result, an amount user interaction, both intended and unintended, with personal defense firearms is substantially greater than an amount of user interaction with firearms intended for recreational use. The significant amount of time that users interact with their personal defense firearms creates a demand for lighter, smaller, and concealable firearm designs. However, these features can also create situations which may increase a risk of unintentional discharge.

For example, U.S. Patent Application Publication No. 2010/0242329 to Carr et al. (hereinafter "Carr") describes a compact foldable handgun. Carr describes that a handgrip is movable between a firing position and a storage position and that the handgrip can pivot relative to a frame. Can's handgrip is also movable along the frame in a direction aligned with a barrel. The design described by Carr utilizes both rotational and axial movement of the handgrip to move between the firing position and the storage position. Carr's ammunition is exposed in the storage position and Carr's design is capable of discharging in both the firing position and the storage position.

U.S. Patent Application Publication No. 2016/0377361 to Osborne (hereinafter "Osborne") describes a collapsible pistol. Osborne describes a pistol which may be opened into a ready-to-fire position with a single hand. Osborne further describes that manipulation of the pistol into and out of the open, ready-to-fire position can be accomplished by a user having relatively small hands and/or relatively low grip strength. Thus, Osborne presents an example of design features for quick and easy operation of a personal defense firearm but which also increase a risk that the firearm may be unintentionally discharged by a child.

U.S. Patent Application Publication No. 2017/0321981 to Voigt (hereinafter "Voigt") describes a folding pocket pistol. Voigt describes that the design of the pocket pistol is for the purpose of being easily carried and stored without resembling a firearm. The design described by Voigt is capable of discharging in both the folded and the unfolded configuration.

U.S. Patent Application Publication No. 2017/0356710 to Full (hereinafter "Full I") describes a folding compact pistol. Full I describes that a handle actuates relative to a frame and also rotates relative to the frame to fold the pistol. Full I's ammunition is exposed in the folded position and Full I's design is capable of discharging in both the folded position and the unfolded position.

U.S. Patent Application Publication No. 2019/0033026 to Full (hereinafter "Full II") describes a folding pistol. Full II describes modifications to an existing pistol which detaches a handgrip of the existing pistol from a frame of the existing pistol. Full II further describes a grip is movable between an extended position in which the pistol is operable and a stowed position in which the free end of the grip is adjacent to the frame. Full II's ammunition is exposed in the stowed position and Full II's design is capable of discharging in both the extended position and the storage position.

Thus, these conventional personal defense firearms suffer from a variety of challenges that may render the firearms unsafe in practice. Conventional systems designed specifically for concealment have increased risks of unintentional or accidental discharge. Further, many of the conventional firearms have sacrificed safety features in favor designs that are quick to operate and easy to discharge. Moreover, conventional firearms are typically capable of being operated by a small child such as the toddler in the tragic example above. Specifically, a small child that has the coordination, strength, and reach to operate the conventional systems may be able to unintentionally discharge a round intended for use in personal defense.

SUMMARY

An intrinsically safe firearm is described. The firearm includes a frame and a handle connected to the frame by a pivot pin which allows the handle to rotate relative to the frame. The firearm also includes a slide which can be disposed over a portion of the frame and a magazine which may be disposed in the handle. A pair of latches can temporarily fix the intrinsically safe firearm in a stowed orientation or a deployed orientation.

The firearm resembles a conventional firearm in the deployed orientation. For example, a trigger is accessible and can be actuated to discharge a round in a chamber of the firearm, and a trigger guard surrounds the trigger to prevent unintended discharges. A magazine safety of the magazine engages a firing pin safety which allows a firing pin to strike a primer of the round in the chamber. The magazine can be removed from the handle and the slide may be removed from the portion of the frame. While in the deployed orientation, a power supply energizes an integral laser sight which may be used to aim the intrinsically safe firearm using a laser spot projected by the laser sight as an indication of a path of a discharged round.

To convert the firearm from the deployed orientation to the stowed orientation, the pair of latches are released by a deliberate action of a user with hand strength and dexterity greater than a child is capable of providing. For example, the pair of latches may be simultaneously released to convert the firearm from the deployed orientation to the stowed orientation or to convert the firearm from the stowed orientation to the deployed orientation. After releasing the pair of latches, the handle is rotated relative to the frame until the latches temporarily fix the firearm in the stowed orientation.

In one example, the intrinsically safe firearm does not resemble a conventional firearm in the stowed orientation. For example, the trigger and the trigger guard are not directly accessible or visible. The trigger is also disconnected from a trigger bar in this orientation. Further, the magazine safety does not engage the firing pin safety and the firing pin is mechanically prevented from striking the primer of the round. While in the stowed orientation, the slide is not removable from the frame and the magazine is not removable from the handle. An electrical circuit which energizes the laser sight in the deployed orientation is opened and the laser sight is inoperable in the stowed orientation. Additionally, a lateral projection of the handle is disposed over a barrel of the firearm and the laser sight which prevents debris from entering an inner portion of the firearm. Further, the firearm can be safely stored, concealed, dropped, thrown, or otherwise mishandled in the stowed orientation because the firearm is not capable of discharge in this orientation. The intrinsically safe firearm can be converted to the deployed orientation by releasing the pair of latches, and rotating the handle relative to the frame until the latches temporarily fix the firearm in the deployed orientation.

The described systems and techniques overcome the limitations of conventional personal defense systems by providing a concealable firearm with more safety features than firearms not designed for concealment. While in the stowed orientation, the intrinsically safe firearm is not capable of discharging a round which is not possible in conventional firearms. Releasing the firearm from the stowed orientation can be performed by a deliberate action of an adult user which is not always the case using conventional techniques. Moreover, the described firearm can be converted from the stowed orientation to the deployed and ready to fire orientation in less time than conventional concealed firearms with no risk of unintentional or accidental discharge.

This Summary introduces a selection of concepts in a simplified form that are further described below in the Detailed Description. As such, this Summary is not intended to identify essential features of the claimed subject matter, nor is it intended to be used as an aid in determining the scope of the claimed subject matter.

BRIEF DESCRIPTION OF THE DRAWINGS

The detailed description is described with reference to the accompanying figures. Entities represented in the figures may be indicative of one or more entities and thus reference may be made interchangeably to single or plural forms of the entities in the discussion.

FIGS. 1A and 1B are illustrations of an intrinsically safe firearm.

FIGS. 2A-2D are illustrations depicting an intrinsically safe firearm in stowed and deployed orientations.

FIGS. 3A-3C are illustrations depicting operation of a slide lock.

FIGS. 4A-4D are illustrations of partially transparent representations of components of an intrinsically safe firearm as the firearm is converted from a deployed orientation to a stowed orientation.

FIGS. 6A-6D are illustrations of partially transparent representations of components of an intrinsically safe firearm as the firearm is converted from a stowed orientation to a deployed orientation.

FIGS. 8A-8C are illustrations depicting representations of a firing pin and a firing pin safety.

FIGS. 9A-9C are illustrations depicting operation of a magazine safety.

FIGS. 11A-11D are illustrations depicting example representations of a laser sight circuit.

FIGS. 12A-12F are illustrations depicting example representations of operations of components of an intrinsically safe firearm.

FIGS. 13A-13D are illustrations depicting component kinematics as an intrinsically safe firearm is converted from a deployed orientation to a stowed orientation.

DETAILED DESCRIPTION

Overview

Figure 14:
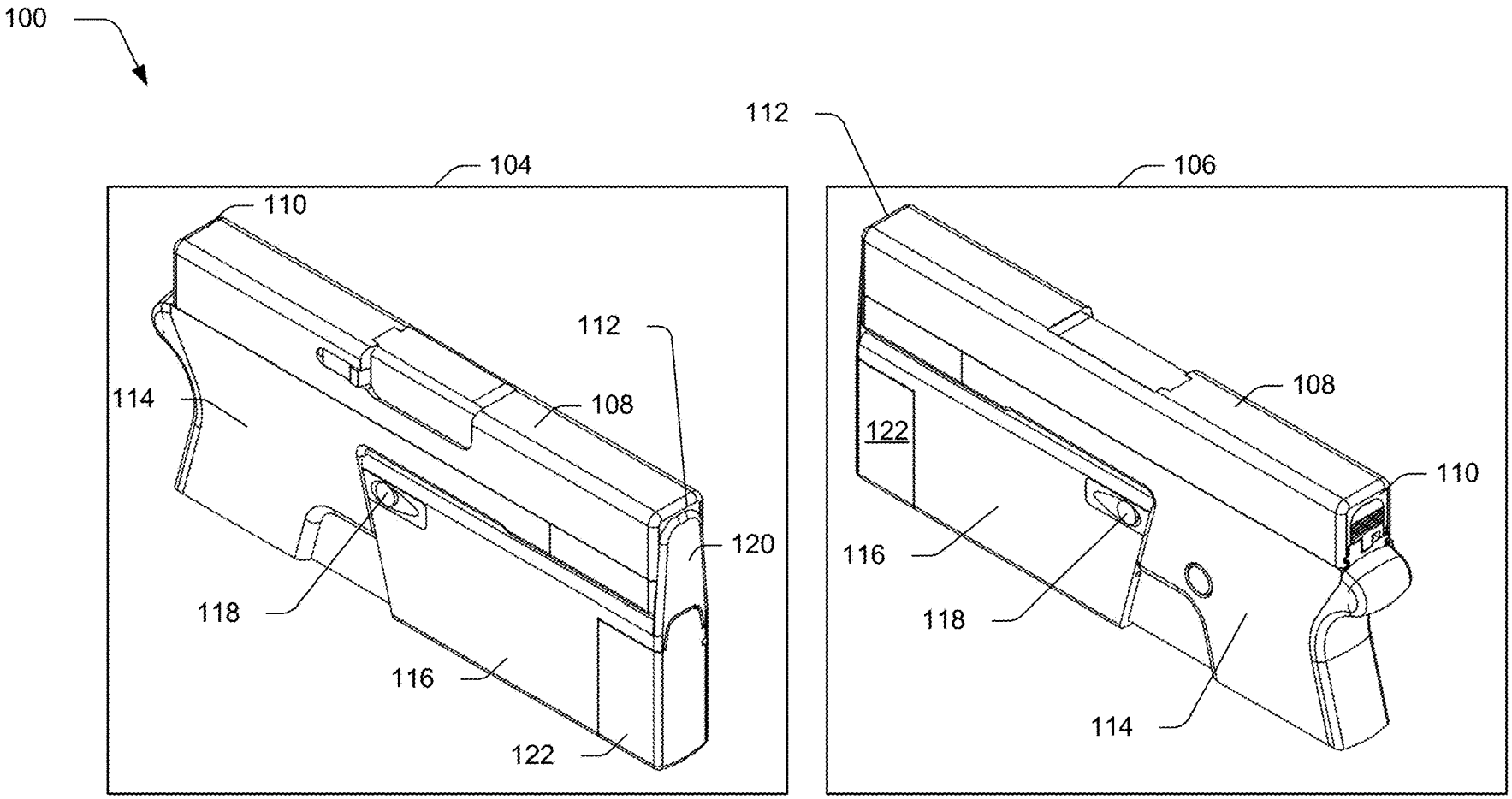
Figure 18:
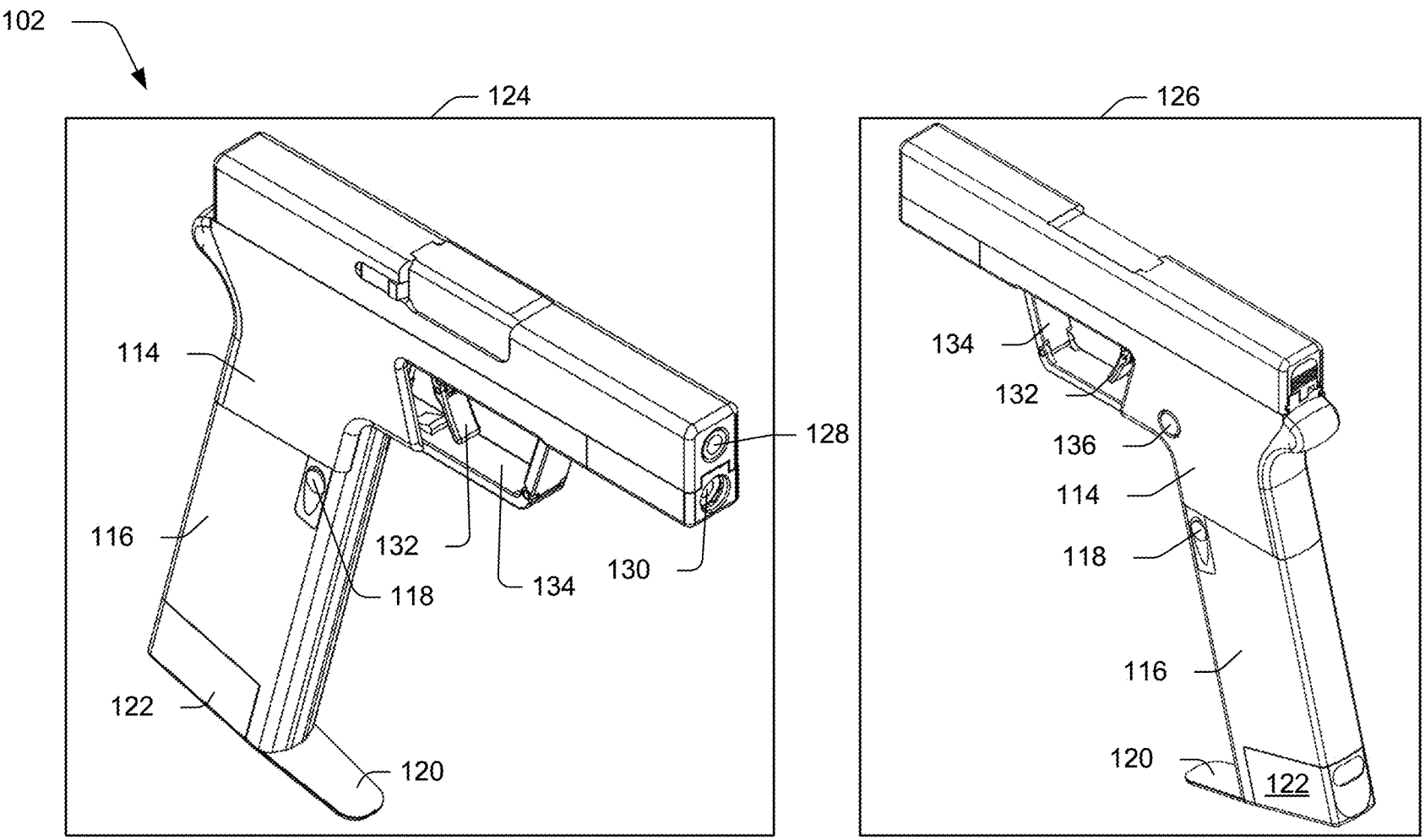
Figure 24:
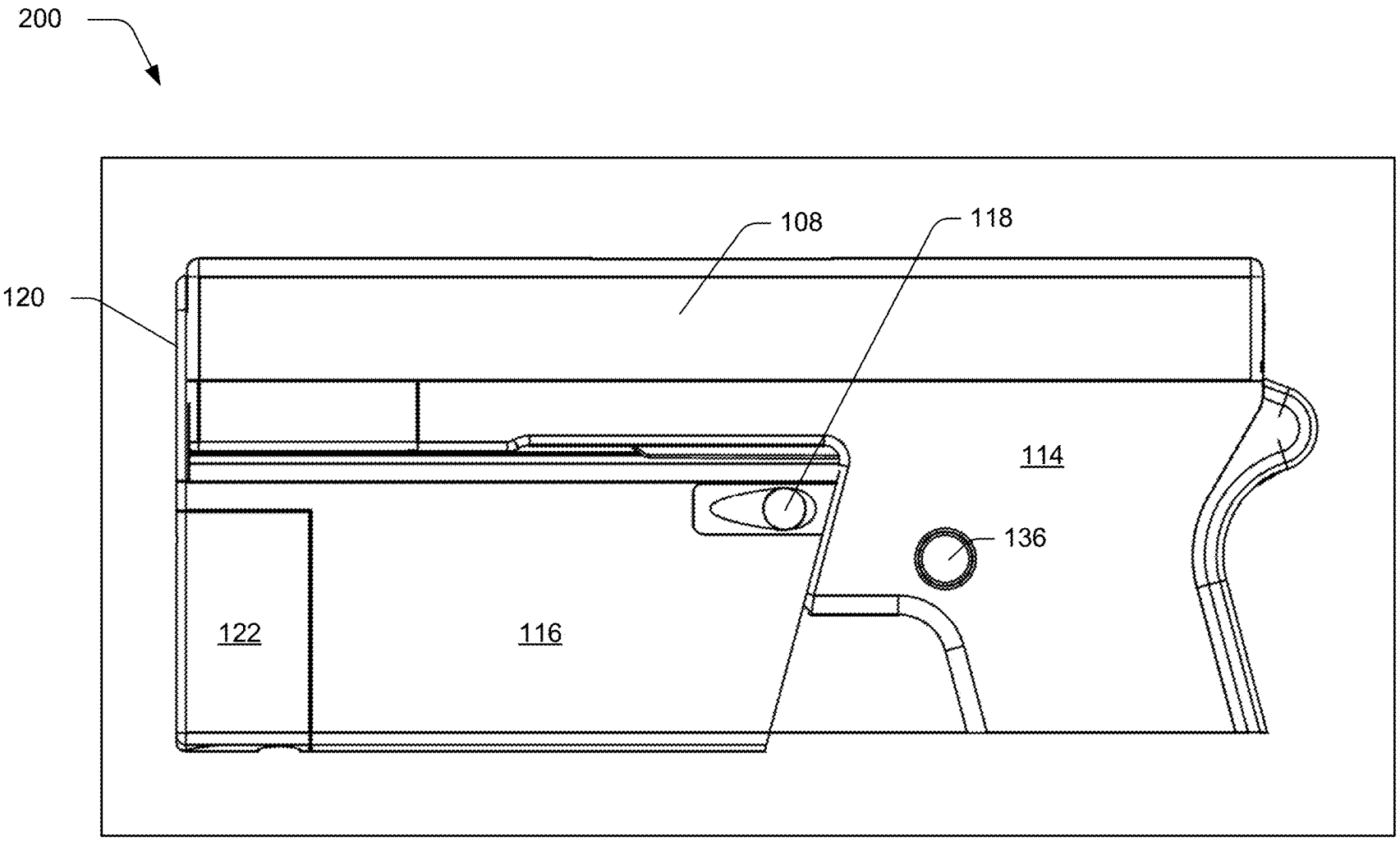

Personal defense firearms are pervasive in the United States and tragic events related to accidental or unintentional discharge of these firearms are a subject of general concern world-wide. The problem of accidental firearm discharge is particularly acute in the context of personal defense firearms because these firearms are generally designed for concealment and to fire quickly and easily. Specifically, firearms for personal defense are usually designed with basic safety features so that a user can quickly and easily fire rounds in response to an unexpected threat which makes personal defense firearms potentially less safe than firearms for hunting or recreational activities. In other words, reducing a risk of accidental discharge can increase a risk that a personal defense firearm will not be effective when used for self-defense.

Conventional personal defense systems typically only include rudimentary safety measures to prevent unintentional discharge. These conventional personal defense firearms may include a "safety" which can refer to any single means of prevention of an accidental discharge but which commonly refers to a minimum magnitude of an applied force to actuate a trigger or a button which can be actuated to release a lock. However, because of concerns that the firearm will not be effective when it is used for personal protection, many users carry firearms with the available safety features disengaged. This tends to further increase accident rates related to personal defense firearms. While the number of known accidental shootings is substantial, an actual number of unintentional discharges of these types of firearms is not known since "near-miss" scenarios are frequently not reported.

This problem is compounded by the nature of personal defense in that incidents which may involve use of a firearm for protection are largely unpredictable. Because of this unpredictability, personal defense firearms are typically worn by a user or stored in close proximity to the user. As a result, an amount user interaction, both intended and unintended, with personal defense firearms is substantially greater than an amount of user interaction with firearms intended for recreational use. The significant amount of time that users interact with their personal defense firearms creates a demand for lighter, smaller, and concealable firearm designs. However, these features can also create situations which may increase a risk of unintentional discharge such as when accessing or operating a concealed firearm.

Systems and techniques for an intrinsically safe firearm are described. The firearm includes a frame and a handle connected to the frame by a pivot pin which allows the handle to rotate relative to the frame. The firearm also includes a slide which can be disposed over a portion of the frame and a magazine that may be disposed in the handle. A pair of latches can temporarily fix the intrinsically safe firearm in a stowed orientation or a deployed orientation.

In an example, the firearm resembles a conventional firearm in the deployed orientation. For example, a trigger is accessible and can be actuated to discharge a round in a chamber of the firearm, and a trigger guard surrounds the trigger to prevent unintended discharges. The trigger includes a trigger safety which can be released by applying a force to a lower portion of the trigger to actuate the trigger and discharge the round. In this way, the trigger safety can prevent an unintentional force from actuating the trigger.

While the firearm is in the deployed orientation, the trigger safety can also prevent the trigger from actuating in the event that the deployed firearm is dropped or mishandled. The trigger safety may additionally prevent the trigger from actuating as the intrinsically safe firearm is being converted from the stowed orientation to the deployed orientation. For example, if the firearm is "snapped" into the deployed orientation, the trigger safety can prevent the trigger from deflecting a trigger bar by stopping the trigger's rotation.

A magazine safety of the magazine engages a firing pin safety which allows a firing pin to strike a primer of the round in the chamber. The magazine safety engages the firing pin safety in this manner, solely in this example, when the firearm is in the deployed orientation. In this manner, the magazine safety can act as an additional safety feature by preventing the firing pin from striking the primer of the round when magazine safety does not engage the firing pin safety.

The magazine can be removed from the handle by actuating a magazine release, and the slide may be removed from the portion of the frame by disengaging a slide lock. While in the deployed orientation, a power supply energizes an integral laser sight which may be used to aim the intrinsically safe firearm using a laser spot projected by the laser sight as an indication of a path of a discharged round. The laser sight also provides an indication to a user that the firearm is in the deployed orientation because the laser sight is only energized in this orientation. In one example, the intrinsically safe firearm may include a scanner such as a fingerprint or a thumbprint scanner such as to confirm a user as an authorized user, and the power supply can provide power for the scanner in this example.

To convert the firearm from the deployed orientation to the stowed orientation, the pair of latches are released as part of a deliberate action by a user with hand strength and dexterity, which may be set to be greater than that of a child. For example, the pair of latches may involve simultaneous release to convert the firearm from the deployed orientation to the stowed orientation or to convert the firearm from the stowed orientation to the deployed orientation. For example, the latch or latches can include a tapered portion, and the tapered portion of the latch or latches can allow the latch or latches to automatically engage once having been released.

After releasing the pair of latches, the user rotates the handle relative to the frame until the latches temporarily fix the firearm in the stowed orientation. For example, the intrinsically safe firearm can include an internal channel of the frame as well as an internal guide of the handle. In this manner, the internal guide is disposed in the internal channel and an actuation of the guide within the channel can facilitate the rotation of the handle relative to the frame. Illustratively, a carriage of the firearm may linearly actuate relative to the frame as the handle rotates relative to the frame. In one example, the carriage facilitates a folding of the trigger guard as the firearm is converted from the deployed orientation to the stowed orientation. For example, as the user rotates the handle relative to the frame to stow the firearm, the carriage may retract relative to the frame to guide the kinematics of the conversion of the firearm to the stowed orientation. Illustratively, this retraction of the carriage relative to the frame can fold the trigger guard into the stowed orientation. In another example, the carriage can extend relative to the frame as the firearm is converted to the deployed orientation. In this example, the extension of the carriage relative to the frame can unfold the trigger guard as the handle rotates relative the frame.

In one example, the intrinsically safe firearm does not resemble a conventional firearm in the stowed orientation. In this orientation, the firearm has a length of approximately 7.2 inches; a width of approximately 3.2 inches; and a depth of approximately 0.75 inches such that the stowed firearm has a volume of less than 17.5 cubic inches. In some examples, the firearm has no sharp edges, raised portions, or visible apertures and easily fits into a purse or a suit breast pocket for concealment. If a footprint or an outline of the firearm in the stowed orientation is observable such as if the firearm is stored in a pocket, then the footprint or outline also does not resemble a firearm. Rather, this footprint or outline more closely resembles a smartphone or a wallet.

For example, while the firearm is in the stowed orientation, the trigger and the trigger guard are not accessible or visible. In one example, the trigger is also disconnected from a trigger bar in this orientation. In some embodiments, and while in the stowed orientation, the slide is not removable from the frame and the magazine is not removable from the handle.

In some examples, when the firearm is in the stowed orientation or in any orientation other than the deployed orientation, the magazine safety and the firing pin safety can prevent the discharge of the round in the chamber of the firearm. Specifically, the intrinsically safe firearm may include a firing pin safety spring which is configured to apply a force to the firing pin safety. This applied force can actuate the firing pin safety such that the firing pin safety is mechanically disposed between firing pin and the primer of the round in the chamber. In other words, the firing pin is not capable of striking the primer because such a strike is prevented by the firing pin safety in this example.

For example, an electrical circuit which energizes the laser sight in the deployed orientation is opened and the laser sight is inoperable in the stowed orientation. In this manner, the intrinsically safe firearm extends a useful life of the power supply. Additionally, a lateral projection of the handle may be disposed over a barrel of the firearm and the laser sight which prevents debris from entering an inner portion of the firearm. In some examples, the lateral projection may also be functional to reduce a lethality of a round that is discharged while the lateral projection covers the barrel of the firearm. In these examples, the lateral projection may be configured to mechanically reduce a momentum of the discharged round such that the round is no longer lethal.

Further, the firearm can be safely stored, concealed, dropped, thrown, or otherwise mishandled in the stowed orientation because the firearm is not capable of discharge in this orientation. The intrinsically safe firearm can be converted to the deployed orientation by releasing the pair of latches, and rotating the handle relative to the frame until the latches temporarily fix the firearm in the deployed orientation. As described above, this conversion may be performed by a deliberate action of the user with hand strength and dexterity greater than a child is capable of providing.

The described systems and techniques overcome the limitations of conventional personal defense systems by providing a concealable firearm with more safety features than firearms not designed for concealment. While in the stowed orientation, the intrinsically safe firearm is not capable of discharging a round which is not possible in conventional firearms. Releasing the firearm from the stowed orientation may be performed by a deliberate action of an adult user which is not the case using conventional techniques. Moreover, the described firearm can be converted from the stowed orientation to the deployed and ready to fire orientation in less time than conventional concealed firearms with no risk of unintentional or accidental discharge.

In the following discussion, an example environment is first described that may employ the techniques described herein. Example procedures are also described which may be performed in the example environment as well as other environments. Consequently, performance of the example procedures is not limited to the example environment and the example environment is not limited to performance of the example procedures.

EXAMPLE EMBODIMENTS

FIGS. 1A and 1B are illustrations of an intrinsically safe firearm. FIG. 1A illustrates an intrinsically safe firearm in a stowed or safe orientation 100. FIG. 1B illustrates an intrinsically safe firearm in a deployed or ready to fire orientation 102. FIG. 1A includes illustrations of the stowed orientation 100 in an isometric view from the front 104 and in an isometric view from the rear 106. As shown, the intrinsically safe firearm includes a slide 108 which has a first end 110 and a second end 112. As further shown, the slide 108 includes no mechanical sights in this example; however, in other examples mechanical sights may be included. The slide 108 may be disposed over a portion of a frame 114 which is illustrated as being fixed to a handle 116. For example, a portion of the handle 116 may be temporarily fixed to a portion of the frame 114 by a latch 118, and the latch 118 may temporarily fix the intrinsically safe firearm in the stowed orientation 100.

In some examples, the latch 118 can include multiple independent latches 118 and a user can actuate two latches 118 simultaneously to release the portion of the handle 116 from the portion of the frame 114. In other examples, the latch 118 can also include more than two independent latches 118 and a user can actuate at least three latches 118 simultaneously, e.g., by using two hands, to release the handle 116 from the frame 114. For example, the latch 118 may be configured to ensure that a user intends to temporarily release the portion of the handle 116 which is temporarily fixed to the portion of the frame 114. In some examples, the latch 118 may be actuated by a deliberate action of an adult user to release the latch 118. In other examples, the latch 118 may be configured to ensure that an unintended user does not release a portion of the handle 116 which is temporarily fixed to a portion of the frame 114 by the latch 118. For example, the latch 118 may include features such as symbols which can indicate to the unintended user that the latch 118 is not to be released.

As illustrated in FIG. 1A, the handle 116 may include a lateral projection 120 which extends laterally from a portion of the handle 116. For example, the lateral projection 120 may be configured to cover an inner portion of the intrinsically safe firearm when the firearm is in the stowed or safe orientation 100. In one example, the lateral projection 120 may be configured to prevent debris from entering the inner portion of the firearm, e.g., by covering slide second end 112. In another example, the lateral projection 120 may form a seal to protect the inner portion of the firearm such as a hermetic seal or a watertight seal. In this manner, the lateral projection 120 may be configured to prevent air from an ingress into the inner portion of the firearm or the lateral projection 120 can be configured to prevent water from an ingress into the inner portion of the firearm.

As further shown in FIG. 1A, the handle may also include a power supply housing 122 which may form a portion of the lateral projection 120. In some examples, the power supply housing 122 may house a power supply such as a battery to provide electrical current to portions of the firearm under certain conditions. For example, the power supply housing 122 may be integrated into a magazine or integrated into the handle 116.

FIG. 1B includes illustrations of the deployed orientation 102 in an isometric view from the front 124 and in an isometric view from the rear 126. As shown, the latch 118 has been released while the firearm was in the stowed configuration 100, and the handle 116 has been actuated relative to the frame 114 until the latch 118 temporarily fixes the handle 116 to the frame 114 in the deployed orientation 102. In some embodiments, as the handle 116 actuates from the stowed orientation 100 to the deployed orientation 102, the lateral projection 120 exposes a barrel 128 and a laser sight 130 of the intrinsically safe firearm. The laser sight 130 is illustrated as being disposed in a laser sight housing of the frame 114 and the laser sight is energized when the firearm is in the deployed orientation 102. In this manner, a user may aim the intrinsically safe firearm using a laser spot projected by the laser sight 130 as an indication of a path of a discharged round. In one or more embodiments, the firearm may provide multiple indicators to a user that the firearm is in the deployed orientation 102. For example, a user may have tactile feedback that the firearm is in the deployed orientation 102 as the latch 118 temporarily fixes the handle 116 to the frame 114 in the deployed orientation 102. In another example, a user may have visual feedback that the firearm is in the deployed orientation 102 as the laser sight 130 is energized.

As shown in FIG. 1B, the firearm includes a trigger 132 and a trigger guard 134. The trigger guard 134 is illustrated as surrounding the trigger 132 to prevent unintended actuation of the trigger 132 when the firearm is in the deployed orientation 102. In one or more embodiments, the trigger 132 and the trigger guard 134 are not visible or accessible in the stowed configuration 100. As illustrated, the intrinsically safe firearm also includes a magazine release 136. While the firearm is in the deployed orientation 102, actuating the magazine release 136 may be configured to release a magazine which can include the power supply housing 122. In some examples, actuating the magazine release 136 while the firearm is in the stowed orientation may not release the magazine.

Figure 2B:
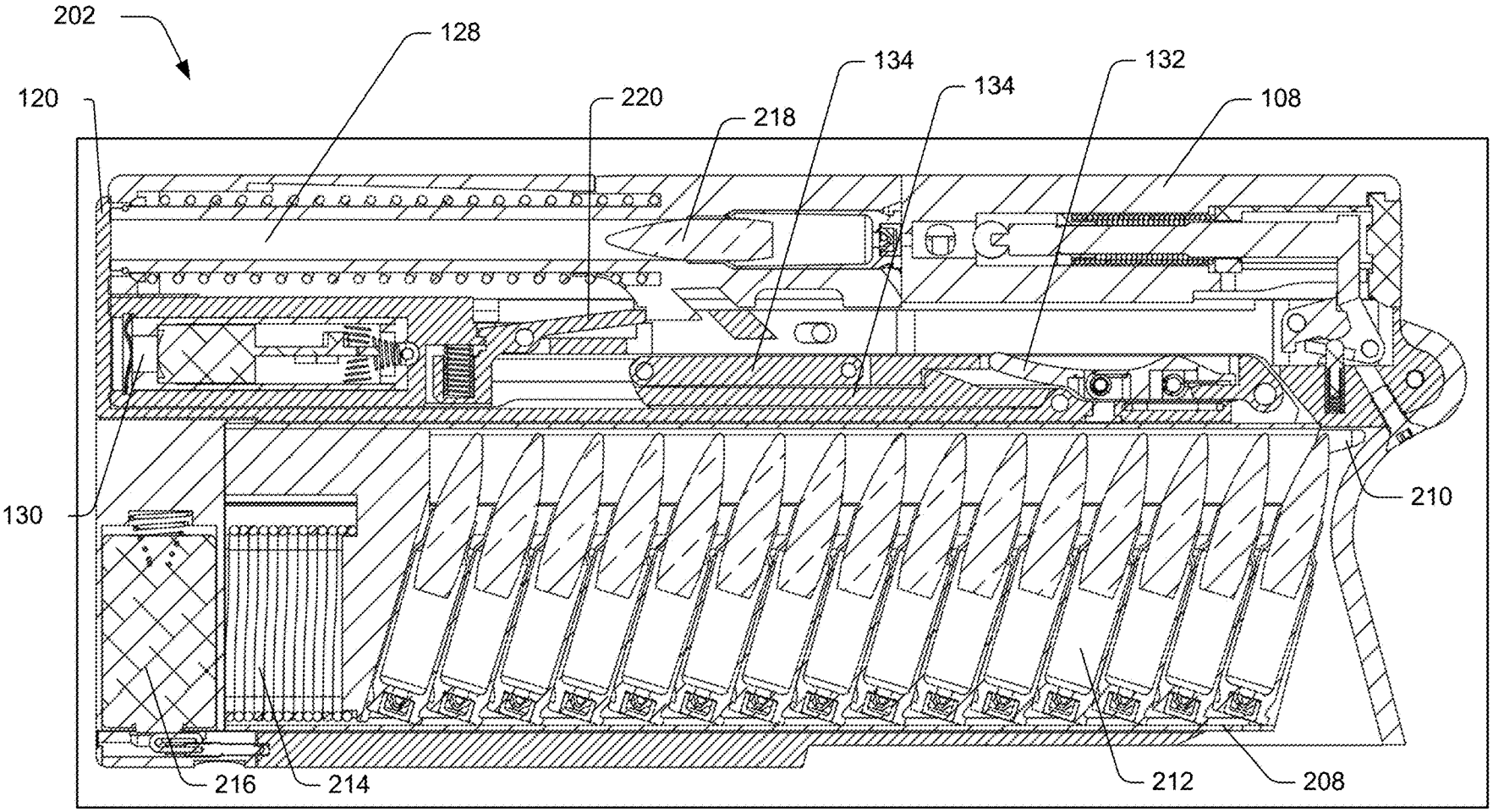
Figure 2C:
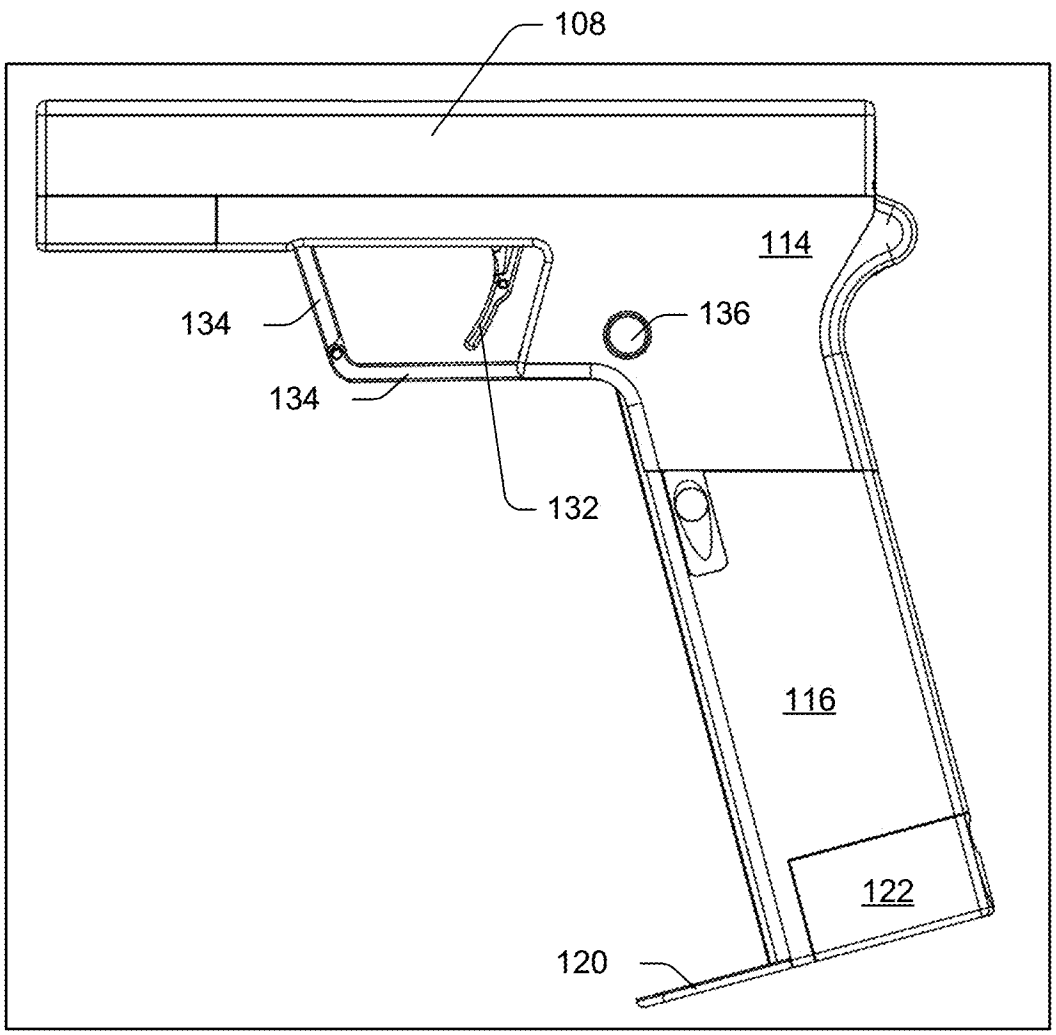
Figure 2D:
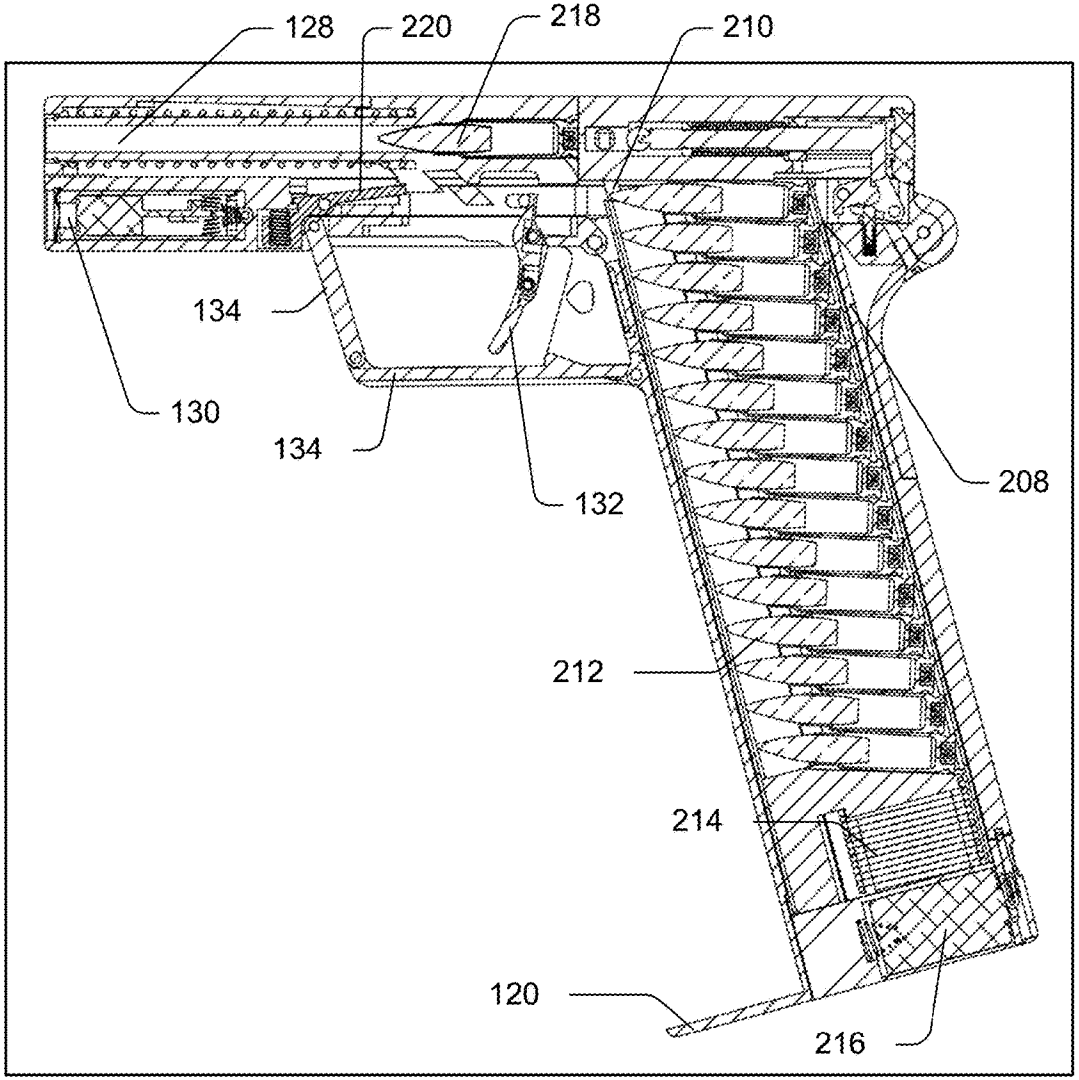
Figure 34:
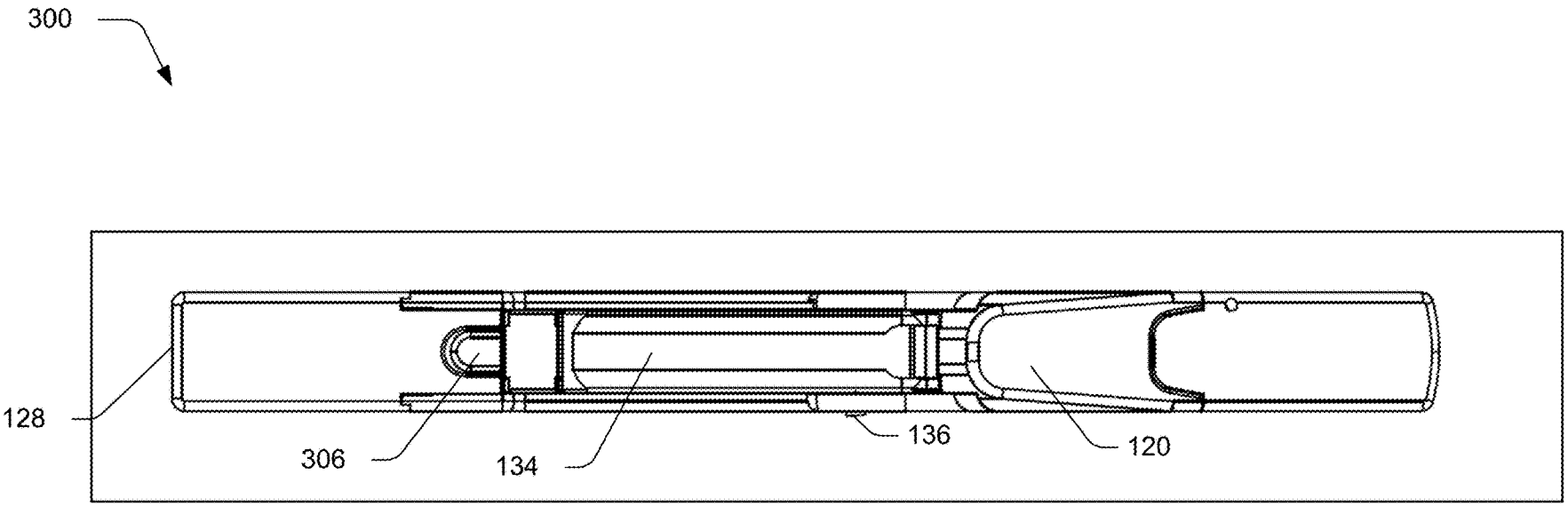

FIGS. 2A-2D are illustrations depicting the intrinsically safe firearm in stowed and deployed orientations. FIG. 2A illustrates a side view of the firearm in the stowed orientation 200. FIG. 2B illustrates a cross-sectional view in a sagittal plane of the firearm in the stowed orientation 202. FIG. 2C illustrates a side view of the firearm in the deployed orientation 204. FIG. 2D illustrates a cross-sectional view in a sagittal plane of the firearm in the deployed orientation 206. As shown in FIG. 2A, the latch 118 temporarily fixes the handle 116 to a portion of the frame 114 when the firearm is in the stowed orientation 100. In one example, actuating the magazine release 136 does not release the magazine in this orientation. In another example, the slide 108 is not removable from the frame 114 in the stowed orientation 100. As additionally illustrated, the trigger 132 is not accessible and the lateral projection 120 covers the barrel 128 and the laser sight 130. As shown, the intrinsically safe firearm does not resemble a firearm in the stowed orientation 100. In this orientation, the firearm has a length of approximately 7.2 inches; a width of approximately 3.2 inches; and a depth of approximately 0.75 inches such that the stowed firearm has a volume of less than 17.5 cubic inches. In some examples, the firearm can have a length of less than or greater than 7.2 inches; a width of less than or greater than 3.2 inches; and a depth of less than or greater than 0.75 inches. In the illustrated example, the firearm has no sharp edges, raised portions, or apertures and easily fits into a purse or a suit breast pocket for concealment.

As shown in FIG. 2B, the intrinsically safe firearm can include multiple safety features preventing accidental or unintentional discharge when the firearm is in the stowed orientation 100. For example, the trigger 132 is completely inaccessible and is stowed within the firearm in between the slide 108 and the handle 116. The inaccessibility of the trigger 132 in the stowed orientation 100 may be a first safety feature of the intrinsically safe firearm which prevents accidental or unintentional discharge of the firearm. In the stowed orientation 100, the trigger 132 is inert and positioned generally parallel to the slide 108 and the handle 116. This disconnection of the trigger 132 in the stowed orientation 100 may be a second safety feature of the firearm which prevents discharge of the firearm. As shown, a portion of the trigger 132 is adjacent to a portion of the trigger guard 134 which is folded on itself in the stowed orientation 100.

As illustrated, the intrinsically safe firearm includes a magazine 208. The magazine 208 is illustrated to include a magazine safety 210, rounds 212, a feed spring 214, and a power supply 216. For example, the magazine 208 and the rounds 212 are inaccessible in the stowed orientation 100 which may be a third safety feature that prevents accidental discharge of the firearm. In the illustrated example, the magazine 208 contains 15 rounds 212 although in other examples, the magazine may contain less than 15 rounds or more than 15 rounds 212. In one example, the rounds 212 may be 5.7×28 millimeter rounds. In other examples, the rounds 212 may be any suitable size or caliber.

In some embodiments, the magazine safety 210 is in a safe position while the firearm is in the stowed orientation 100 and this prevents the firearm from discharging a round independently of the other safety features. For example, the magazine safety 210 may prevent the firearm from discharging when the firearm is in any orientation other than the deployed orientation 102. Thus, the magazine safety 210 may be a fourth safety feature of the intrinsically safe firearm which prevents unintentional and accidental discharge of the firearm.

In some examples, the power supply 216 supplies power to the laser sight 130 in the deployed orientation 102 but not in the stowed orientation 100. In one example, the power supply 216 may only supply power to the laser sight 130 when the firearm is in the deployed orientation 102. For example, the power supply 216 can be a battery which is integrated into the magazine 208. In this example, changing the magazine 208 would also change the power supply 216.

As shown, the firearm also includes a chambered round 218 and a slide lock 220. The slide lock 220 can prevent the slide 108 from being removed from the firearm and the slide lock 220 is not accessible when the firearm is in the stowed orientation 100. As illustrated in this example, the chambered round 218 in addition to the rounds 212 allow the intrinsically safe firearm a total round capacity of 16 rounds. However, the firearm may also have total round capacities of less than 16 rounds or more than 16 rounds. The chambered round 218 is prevented from discharge by the disconnected trigger 132 as well as the magazine safety 210 which ensures that a firing pin of the firearm is physically separated from a primer of the chambered round 218 in the stowed orientation 100. For example, the magazine safety 210 may ensure that the firing pin is physically separated from the primer of the chambered round 218 when the firearm is in any orientation other than the deployed orientation 102.

As further shown, the lateral projection 120 covers the barrel 128, and in some examples, the lateral projection 120 is configured to prevent the chambered round 218 from exiting the barrel 128 in the event that the chambered round 218 is discharged. In other examples, the lateral projection 120 is configured to absorb an impact from the chambered round 218 such that the round exits the barrel 128 in a non-lethal capacity. In these examples, the vast majority of the kinetic energy associated with a discharge of the chambered round is dissipated by the lateral projection 120 and the remaining kinetic energy after impact with the lateral projection 120 is not sufficient to be lethal. In some examples, the lateral projection 120 may be manufactured from a synthetic fiber such as an aramid fiber.

As shown in FIG. 2C, the latch 118 temporarily fixes the handle 116 to a portion of the frame 114 when the firearm is in the deployed orientation 102. The trigger 132 is accessible and the lateral projection 120 does not cover the barrel 128 or the laser sight 130. As illustrated, the intrinsically safe firearm does resemble a firearm in the deployed orientation 102. In this orientation, the safety features of the stowed configuration 100 have been disabled and actuating the trigger 132 is effective to discharge the chambered round 218. For example, actuating the magazine release 136 is effective to release the magazine 208 in this orientation. In one example, the slide 108 is also removable in the deployed orientation 102, e.g., by disengaging the slide lock 220.

As shown in FIG. 2D, the intrinsically safe firearm may include no safety features to prevent discharge of the firearm when the firearm is in the deployed orientation 102. For example, the trigger 132 is accessible and an actuation of the trigger 132 is effective to discharge the chambered round 218. In this example, the trigger guard 134 has unfolded and surrounds the trigger 132. As illustrated, the magazine safety 210 is engaged in position such that the firing pin may strike a primer of the chambered round 218. In one or more embodiments, the power supply 216 supplies electrical current to the laser sight 130 and the laser sight is energized in the deployed orientation 102. For example, this provides a first means of confirmation that the firearm is in the deployed orientation 102 and a tactile response from the latch 118 temporarily locking the firearm in the deployed orientation 102 provides a second means of confirmation that the intrinsically safe firearm is in the deployed orientation 102.

In some examples, one or more portions of the intrinsically safe firearm can manufactured by additive manufacturing, e.g., one or more portions of the firearm may be manufactured by selective laser sintering, selective heat sintering, selective laser melting, electron-beam melting, direct metal laser sintering, electron beam freeform fabrication, stereolithography, digital light processing, fused deposition modeling, laminated object manufacturing, ultrasonic additive manufacturing, vat photopolymerization, material jetting, binder jetting, laser engineered net shaping, etc. For example, the firearm and/or its components may be manufactured by a machining process, a forging process, a casting process, a molding process such as injection molding, a forming process, a coating process, a joining process, etc.

In some examples, the firearm and/or its components may be manufactured from any suitable material, e.g., polymers, metals, metal alloys, etc., or from any combination of suitable materials. For example, the intrinsically safe firearm and/or its components may be manufactured from spring steel, e.g., the firearm and/or its components may be manufactured from a shape memory material. In some examples, the firearm and/or its components may be manufactured from stainless steel, e.g., the firearm and/or its components may be manufactured from Type 301 stainless steel, Type 302 stainless steel, Type 303 stainless steel, Type 304 stainless steel, Type 304L stainless steel, Type 304LN stainless steel, Type 310 stainless steel, Type 316 stainless steel, Type 316L stainless steel, Type 316Ti stainless steel, Type 321 stainless steel, Type 430 stainless steel, Type 440 stainless steel, Type 17-7 stainless steel, etc.

In one example, the firearm and/or its components may be manufactured from nitinol. In another example, the firearm and/or its components may be manufactured from aluminum, e.g., the firearm and/or its components may be manufactured from an aluminum alloy. In other examples, the firearm and/or its components may be manufactured from a 6061 aluminum alloy, a 6061-T4 aluminum alloy, a 6061-T6 aluminum alloy, a 6063 aluminum alloy, a 6063 aluminum alloy, etc. In further examples, the firearm and/or its components may be manufactured from titanium, e.g., the firearm and/or its components may be manufactured from a titanium alloy. For example, the firearm and/or its components may be manufactured from a Grade 5 titanium alloy, a Grade 6 titanium alloy, a Grade 7 titanium alloy, a Grade 7H titanium alloy, a Grade 9 titanium alloy, a Grade 11 titanium alloy, a Grade 12 titanium alloy, a Grade 16 titanium alloy, a Grade 17 titanium alloy, a Grade 18 titanium alloy, etc. In some examples, the firearm and/or its components may be manufactured from glass fiber, Aramid fiber, Kevlar fiber, carbon fiber which can include a carbon fiber reinforced polymer, etc. For example, the firearm and/or its components may be manufactured using an Inconel. In some examples, the firearm and/or its components may be manufactured from composite materials such as an epoxy composite material. In further examples, the firearm and/or its components can be manufactured from a polymer such as Nylon, Turcite, Torlon, polyether ether ketone (PEEK), etc.

In general, functionality, features, and concepts described in relation to the examples above and below may be employed in the context of the examples described in this section. Further, functionality, features, and concepts described in relation to different figures and examples in this document may be interchanged among one another and are not limited to implementation in the context of a particular figure or procedure. Moreover, blocks associated with different representative procedures and corresponding figures herein may be applied together and/or combined in different ways. Thus, individual functionality, features, and concepts described in relation to different example environments, devices, components, figures, and procedures herein may be used in any suitable combinations and are not limited to the particular combinations represented by the enumerated examples in this description.

Example Slide Lock Features

Figure 3B:
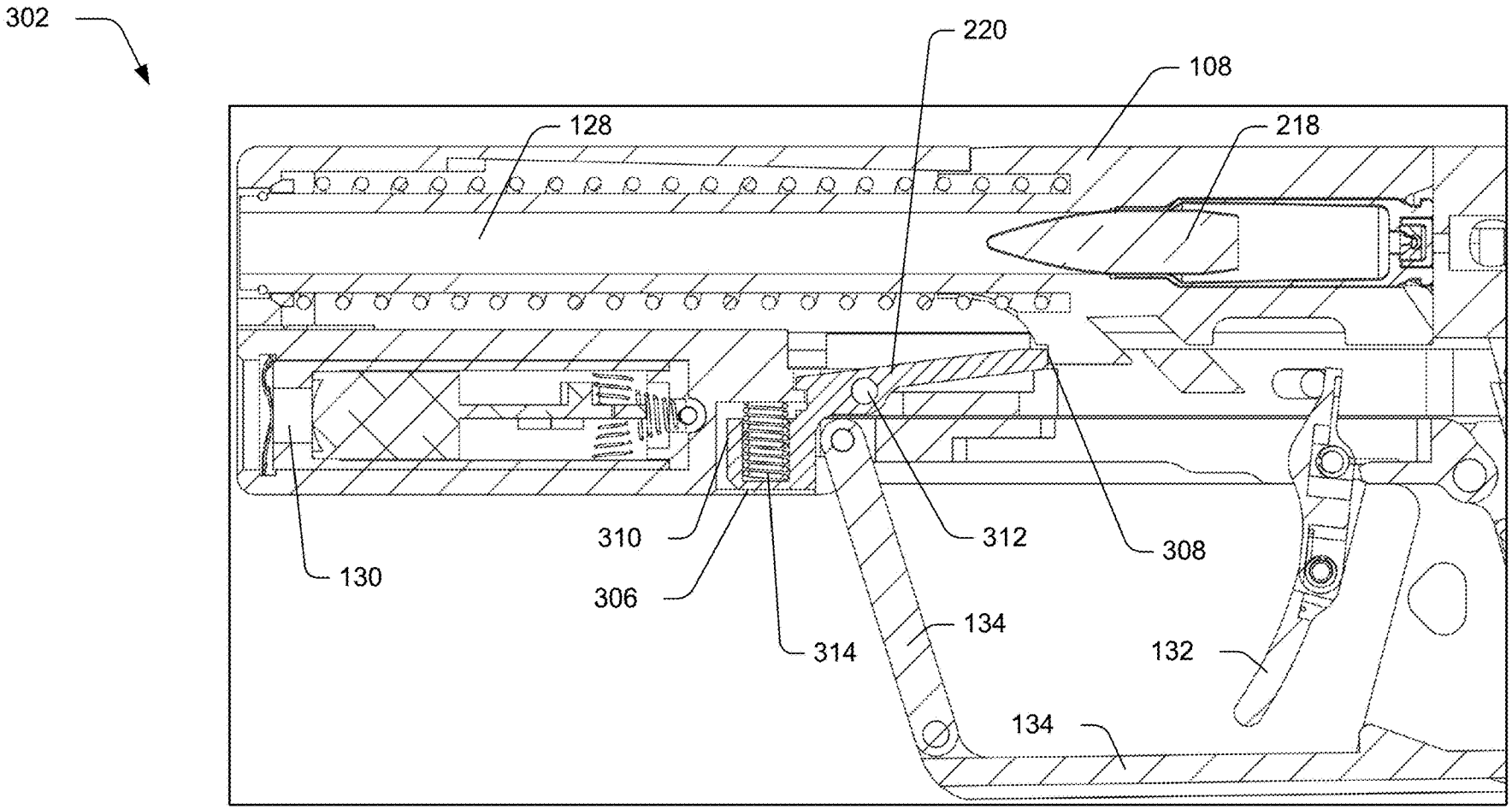
Figure 3C:
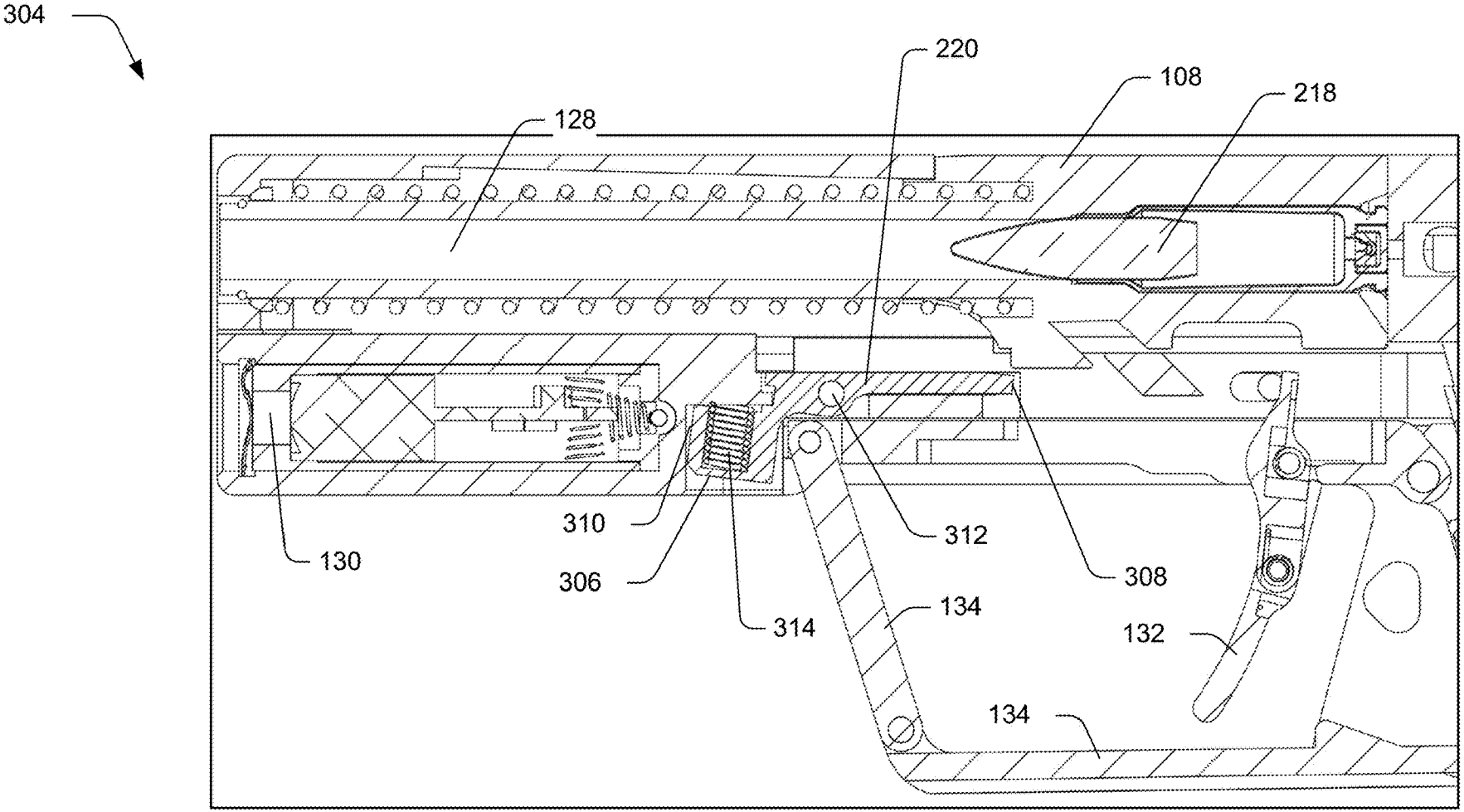
Figure 44:
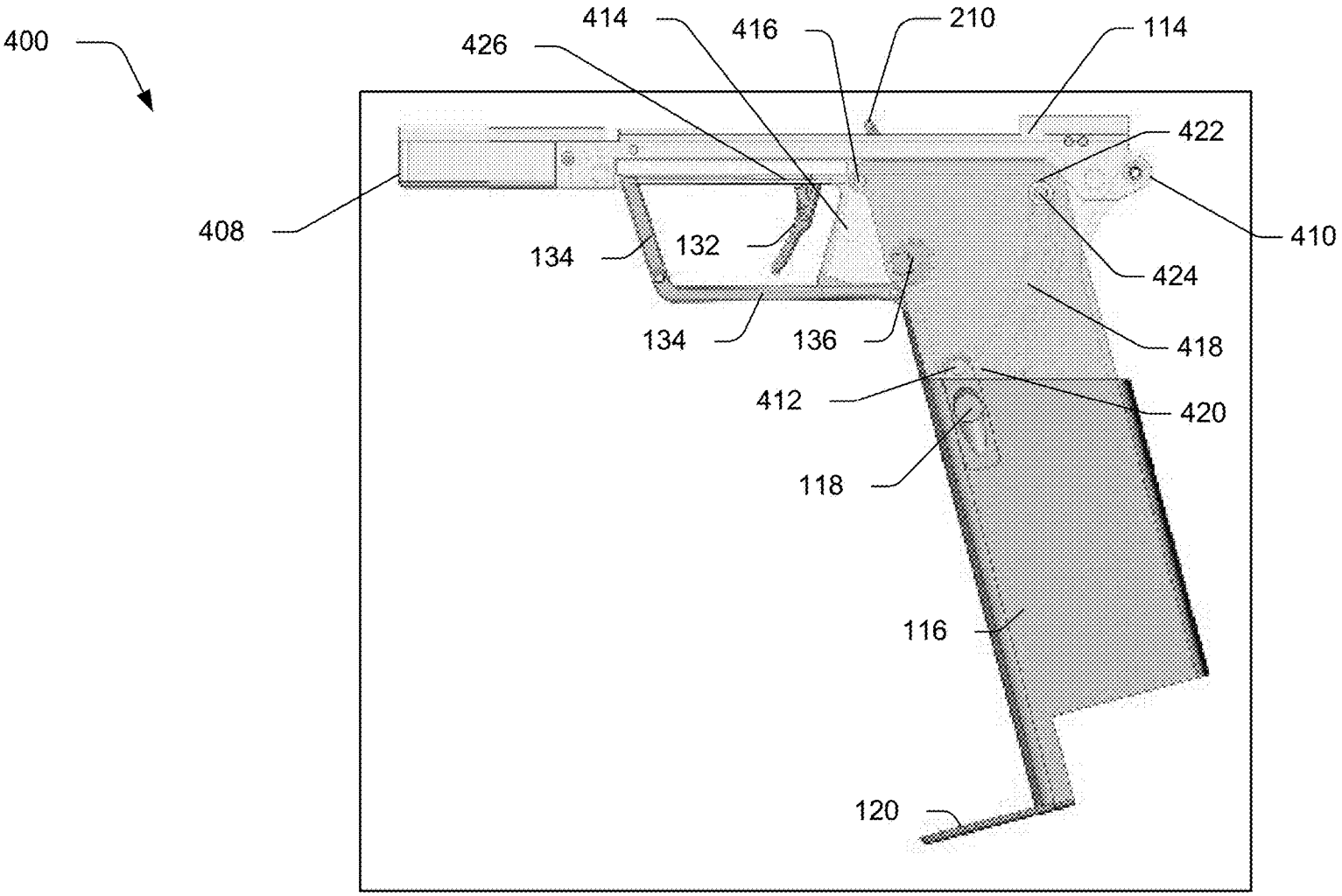

FIGS. 3A-3C are illustrations depicting operation of a slide lock 220. FIG. 3A illustrates the intrinsically safe firearm from a view looking upward at the firearm in a deployed orientation 300. FIG. 3B illustrates a cutaway view of a cross-section in a sagittal plane of the intrinsically safe firearm 302 with the slide lock 220 engaged. FIG. 3C illustrates a cutaway view of a cross-section in a sagittal plane of the intrinsically safe firearm 304 with the slide lock 220 disengaged. As shown in FIG. 3A, the firearm includes a slide lock release 306 which is accessible when the firearm is in the deployed orientation 102. In an example, the slide lock release 306 may be disposed between the trigger guard 134 and the laser sight 130. In some examples, an actuation of the slide lock release 306 is configured to disengage the slide lock 220.

FIG. 3B illustrates the slide lock 220 which includes a first end 308 and a second end 310. As shown, the slide lock 220 can also include a slide lock pivot pin 312 and the slide lock 220 may be configured to rotate about the slide lock pivot pin 312. In some examples, when the slide lock 220 is engaged, a slide lock spring 314 applies a force to a portion of the slide lock 220 which rotates the slide lock about the slide lock pivot pin 312 such that the slide lock first end 308 abuts a portion of the slide 108 which prevents forward motion of the slide 108 relative to the frame 114. For example, the slide lock first end 308 may contact the portion of the slide 108 in a manner such that the slide lock first end 308 acts as a stop to prevent forward movement of the slide 108 which prevents the slide 108 from being removed from the frame 114.

As shown in FIG. 3C, actuating the slide lock release 306 is configured to rotate the slide lock 220. For example, an application of a force to the slide lock release 306 having a magnitude greater than a magnitude of a force applied to the slide lock 220 by the slide lock spring 314 may be configured to rotate the slide lock 220 about the slide lock pivot pin 312. As illustrated, this rotation actuates slide lock first end 308 to a position and the slide lock first end 308 does not abut the portion of the slide 108 in the position. While the force is applied to the slide lock release 306, the slide lock 220 is disengaged and forward movement of the slide 108 relative to the frame 114 is not prevented by the slide lock 220. For example, a user may remove the slide 108 from the frame 114 by clearing chambered round 218, disengaging the slide lock 220, and pulling the trigger 132. Removing the force applied to the slide lock release 306 can enable the slide lock spring 314 to rotate the slide lock 220 about the slide lock pivot pin 312 which causes the slide lock first end 308 to abut the portion of the slide 108. In other words, removing the force applied to the slide lock release 306 is configured to cause the slide lock 220 to be engaged and prevent forward movement of the slide 108 relative to the frame 114.

Examples of Firearm Orientations

Figure 4B:
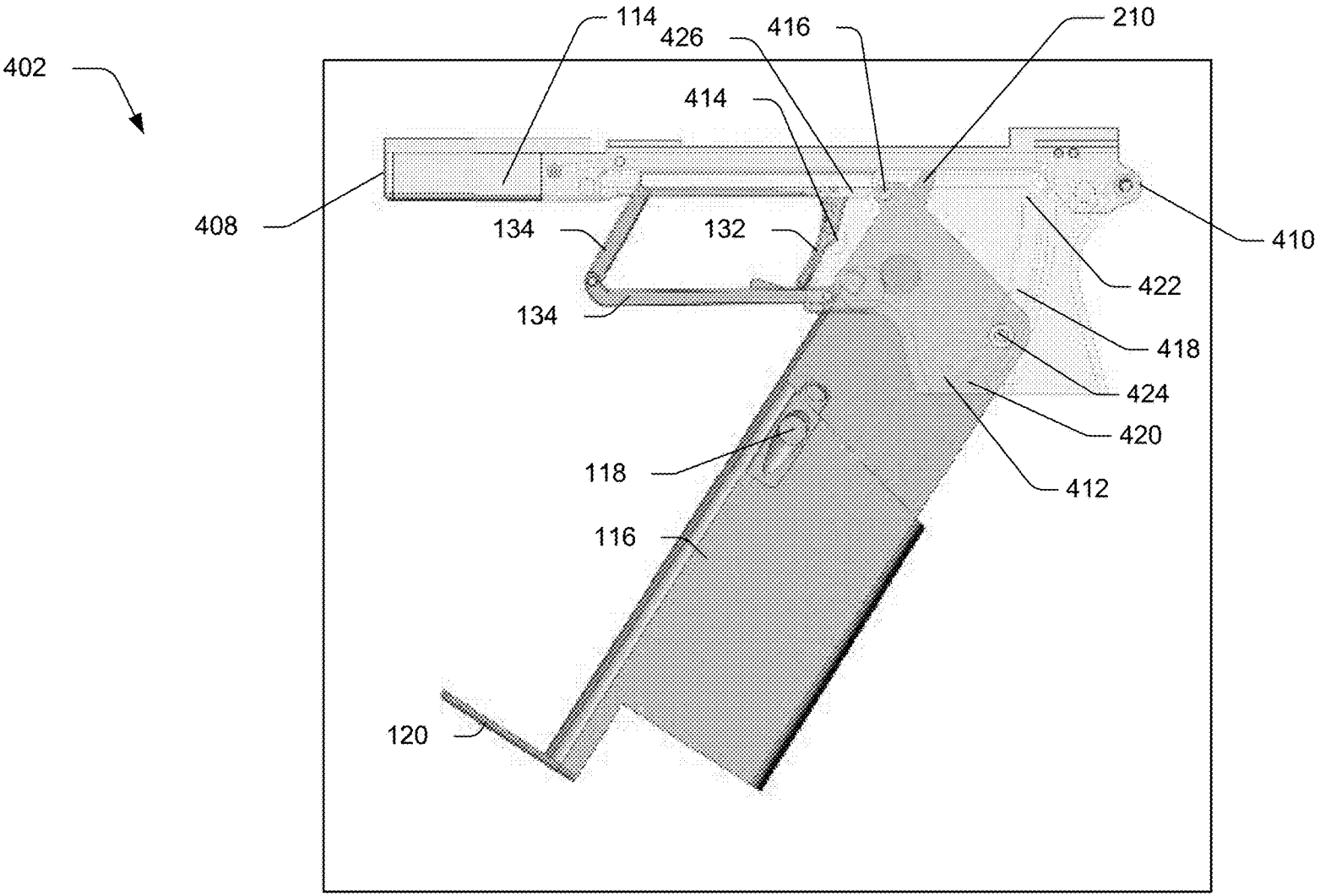
Figure 4C:
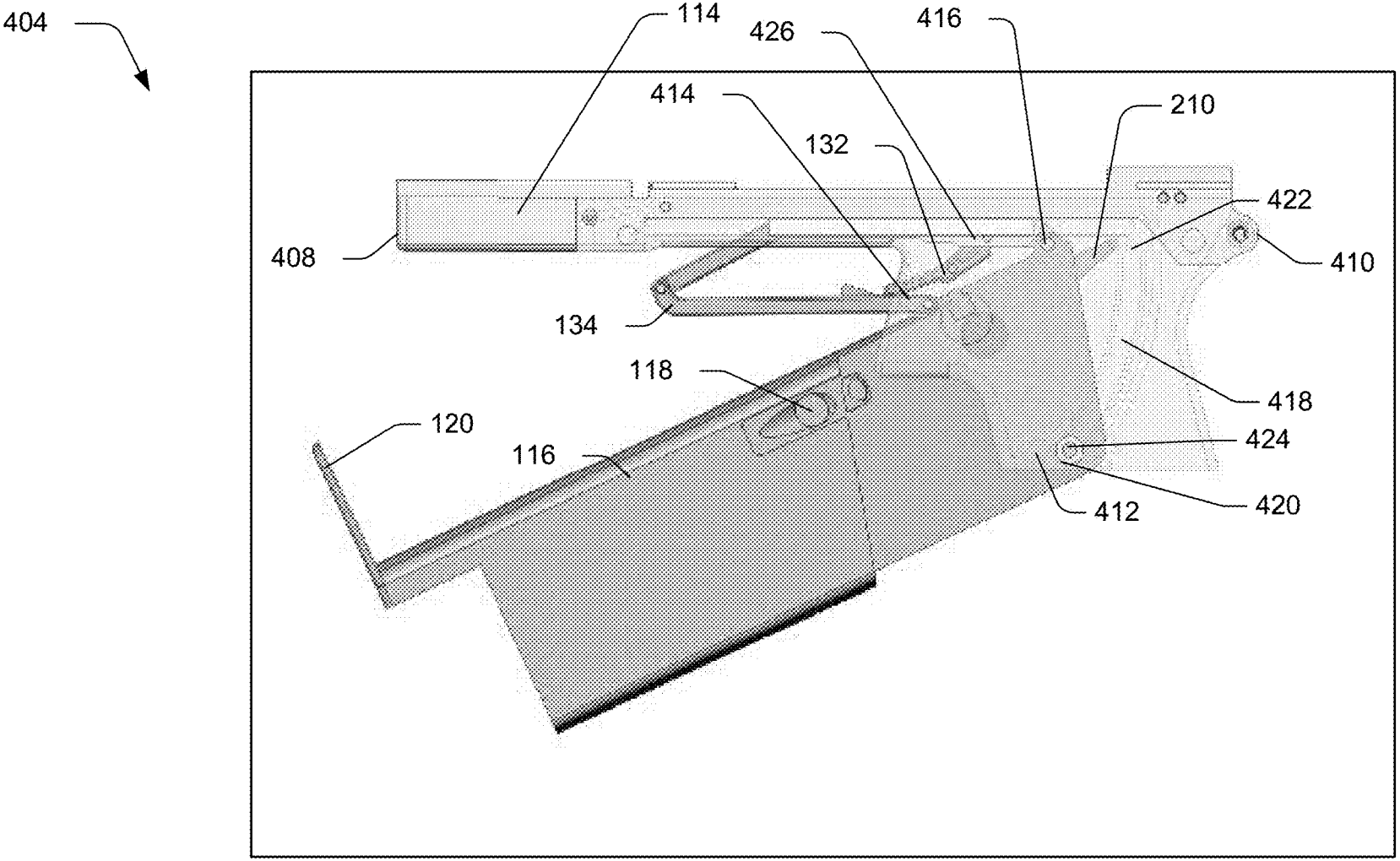
Figure 4D:
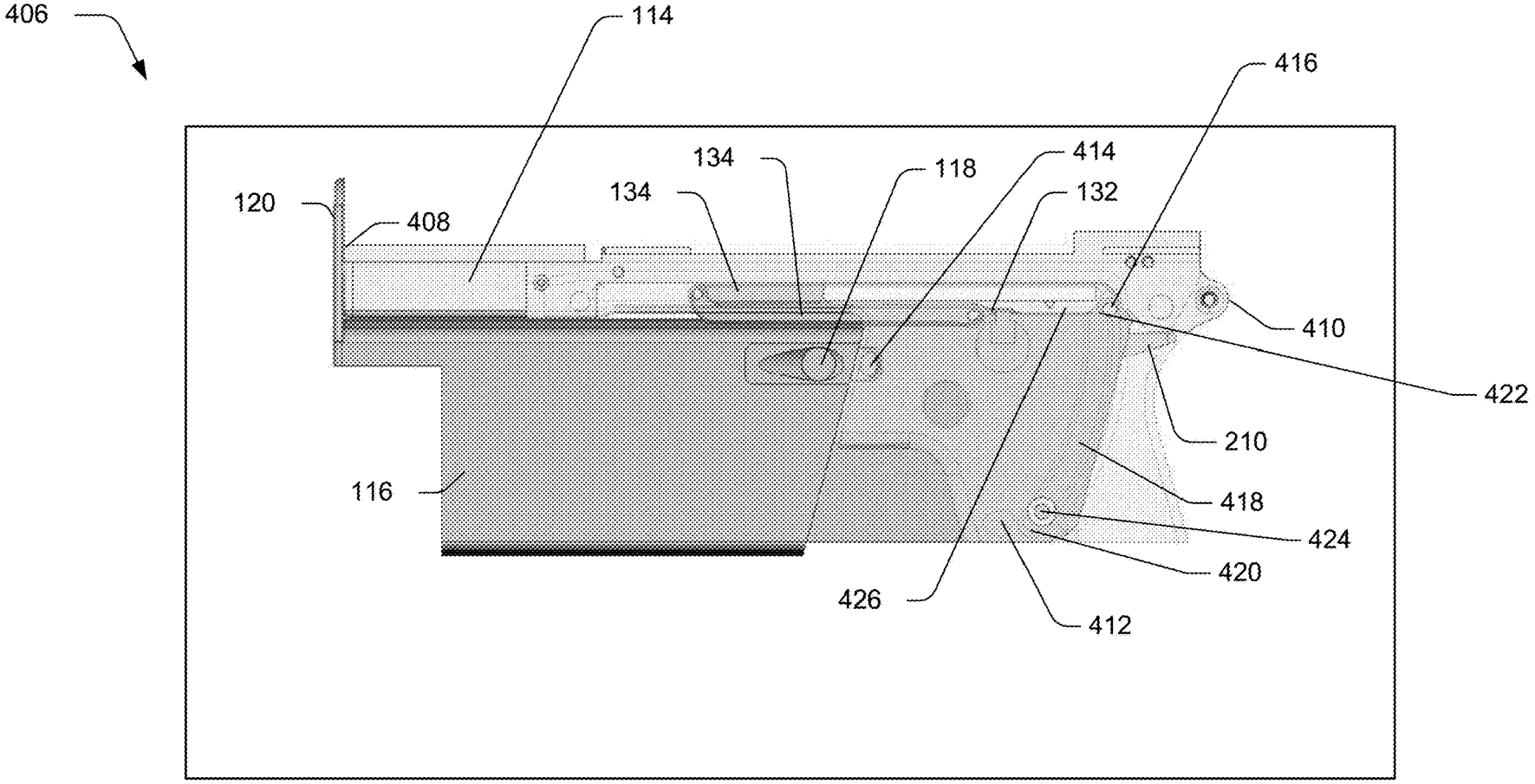

FIGS. 4A-4D are illustrations of partially transparent representations of components of the intrinsically safe firearm as the firearm is converted from a deployed orientation to a stowed orientation. FIG. 4A is a partially transparent view of the components of the intrinsically safe firearm in a deployed orientation 400. FIG. 4B is a partially transparent view of the components of the intrinsically safe firearm actuating out of the deployed orientation 402. FIG. 4C is a partially transparent view of the components of the intrinsically safe firearm actuating into a stowed orientation 404. FIG. 4D is a partially transparent view of the components of the intrinsically safe firearm in the stowed orientation 406.

As shown in FIG. 4A, the frame 114 includes a first end 408 and a second end 410. As illustrated, a portion of latch 118 is disposed in a deployed detent 412 of the frame 114 and the latch 118 temporarily fixes the firearm in the deployed orientation 102. For example, the frame 114 may also include a stowed detent 414 for temporarily fixing the firearm in the stowed orientation 100. In some examples, the handle 116 and the frame 114 are connected by a pivot pin 416 and the handle 116 can rotate relative to the frame 114 about the pivot pin 416 when the latch 118 is released from the deployed detent 412 and the stowed detent 414. In this manner, the frame 114 can also rotate relative to the handle 116 about the pivot pin 416 when the latch 118 is released from the deployed detent 412 and the stowed detent 414.

For example, an actuation of the handle 116 relative to the frame 114 may be configured to convert the intrinsically safe firearm from the deployed orientation 102 to the stowed orientation 100 or convert the firearm from the stowed orientation 100 to the deployed orientation 102. In one or more embodiments, an actuation of the handle 116 relative to the frame 114 in a first direction may be configured to convert the firearm from the deployed orientation 102 to the stowed orientation 100 and an actuation of the handle 116 relative to the frame 114 in a second direction may be configured to convert the firearm from the stowed orientation 100 to the deployed orientation 102.

As shown in FIG. 4A, the frame 114 may include a channel 418 having a first end 420 and a second end 422. In one example, the channel 418 is internal to the frame 114 and the channel is not visible when the firearm is in the stowed orientation 100 or the deployed orientation 102. The channel 418 is illustrated to have a slight curvature although the channel 418 may have no curvature in some examples. In other examples, the channel 418 can have other features such as angles or steps. As further shown, the handle 116 includes a guide 424 and the guide 424 is disposed in the channel 418. In an example, the guide 424 is internal to the handle 116 and the guide 424 is not visible when the firearm is in the stowed orientation 100 or the deployed orientation 102. In this manner, the guide 424 can be configured to actuate within the channel 418 such as to guide an actuation of the handle 116 relative to the frame 114 or to guide an actuation of the frame 114 relative to the handle 116. The guide 424 is illustrated as being adjacent to the channel first end 422 in FIG. 4A.

As illustrated, the firearm may also include a carriage 426 which can be configured to facilitate a conversion of the intrinsically safe firearm from the deployed orientation 102 to the stowed orientation 100 and/or facilitate a conversion of the firearm from the stowed orientation 100 to the deployed orientation 102. For example, the carriage 426 may actuate relative to the frame 114 to guide these conversions by actuating towards the frame second end 410 as the firearm is converted from the deployed orientation 102 to the stowed orientation 100. The carriage 426 may further guide such conversions by actuating towards the frame first end 408 as the firearm is converted from the stowed orientation 100 to the deployed orientation 102.

FIG. 4B illustrates the firearm actuating out of the deployed orientation 402. The latch 118 has been released from the deployed detent 412, e.g., a user can release the latch 118 by actuating the latch 118. In one or more embodiments, the latch 118 can be two independent latches 118 and when the firearm is in the deployed orientation, the two independent latches 118 are partially disposed in two independent deployed detents 412. In this example, the two independent latches 118 can be released from the two independent deployed detents 412 simultaneously to actuate the firearm out of the deployed orientation 402. In other examples, the two independent latches 118 each can be released from the independent deployed detents 412 but simultaneous release is not necessary to actuate the firearm into the deployed orientation 402. In some embodiments, a first latch 118 can be released from a first deployed detent 412 and then a second latch 118 can be released from a second deployed detent 412 to actuate the firearm out of the deployed orientation 402. For example, the firearm may be actuated out of the deployed orientation 402 by a deliberate action of an adult user such as the user simultaneously releasing two latches 118.

As shown in FIG. 4B, the guide 424 has actuated within the channel 418, e.g., away from the channel second end 422 and towards the channel first end 420. In one example, this actuation also can actuate the carriage 426 relative to the frame 114 which can facilitate the kinematics of one or more components of the firearm actuating simultaneously. In this example, the carriage 426 has actuated relative to the frame 114 towards the frame second end 410 and away from the frame first end 408.

The latch 118 has actuated away from the deployed detent 412 and towards the stowed detent 414 in this example. As illustrated, the lateral projection 120 has actuated towards the frame first end 408 and the handle 116 has actuated relative to the frame 114. For example, after releasing the latch 118 from the deployed detent 412, an application of a force vector to having a direction that is towards the frame first end 408 and away from the frame second end 410 to the handle 116 may be configured to actuate the handle 116 relative to the frame 114. In some embodiments, the application of the force to the handle 116 may be configured to actuate the firearm out of the deployed orientation 402.

As further shown, the magazine safety 210 has actuated into the frame 114 and the magazine safety 210 no longer partially extends out from the frame 114. The trigger 132 is beginning to actuate into a portion of the frame 114 and the trigger guard 134 is beginning to fold over itself. In one example, the channel 418 and the guide 424 are configured to guide a rotation of the handle 116 about the pivot pin 416 to actuate the firearm out of the deployed orientation 402. In some embodiments, the guide 424 can only actuate within the channel 418 and the guide 424 and the channel 418 direct an actuation of the handle 116 relative to the pivot pin 416.

FIG. 4C illustrates the firearm actuating into a stowed orientation 404. As shown, the guide 424 has fully actuated within the channel 418, e.g., the guide 424 has actuated from being adjacent to the channel second end 422 to being adjacent to the channel first end 420. As shown in FIG. 4C, the lateral projection 120 has actuated closer to the frame first end 408. The carriage 426 has actuated further relative to the frame 114 towards the frame second end 410 and away from the frame first end 408 and this actuation also actuates a portion of the trigger 132. As also shown, the trigger 132 has actuated into the frame 114 almost completely as the trigger guard 234 continues to fold over itself which may be facilitated by the actuation of the carriage 426 in some embodiments. For example, a continued application of the force vector having the direction towards the frame first end 408 and away from the frame second end 410 to the handle 116 after actuating the firearm out of the deployed orientation 402 may be configured to actuate the firearm closer to the stowed orientation 100. As illustrated, the latch 118 has actuated closer to the stowed detent 414 and farther from the deployed detent 412.

FIG. 4D illustrates the firearm in the stowed orientation 406. As illustrated, the latch 118 is fixed in the stowed detent 414. In some examples, two independent latches 118 are partially disposed in two independent stowed detents 414. As shown in FIG. 4D, the lateral projection 120 is disposed over the frame first end 408. The carriage 426 has fully actuated relative to the frame 114 towards the frame second end 410 and away from the frame first end 408. As further shown, the trigger 132 is fully disposed between the frame 114 and the handle 116 and the trigger guard 134 is completely folder over itself. Note that the guide 424 is disposed a distance away from the channel first end 420. Note also that the pivot pin 416 is disposed near the channel second end 422. In one example, the latch 118 temporarily fixes the firearm in the stowed orientation 100, e.g., until the latch 118 is released by a deliberate action of a user.

Figure 5:
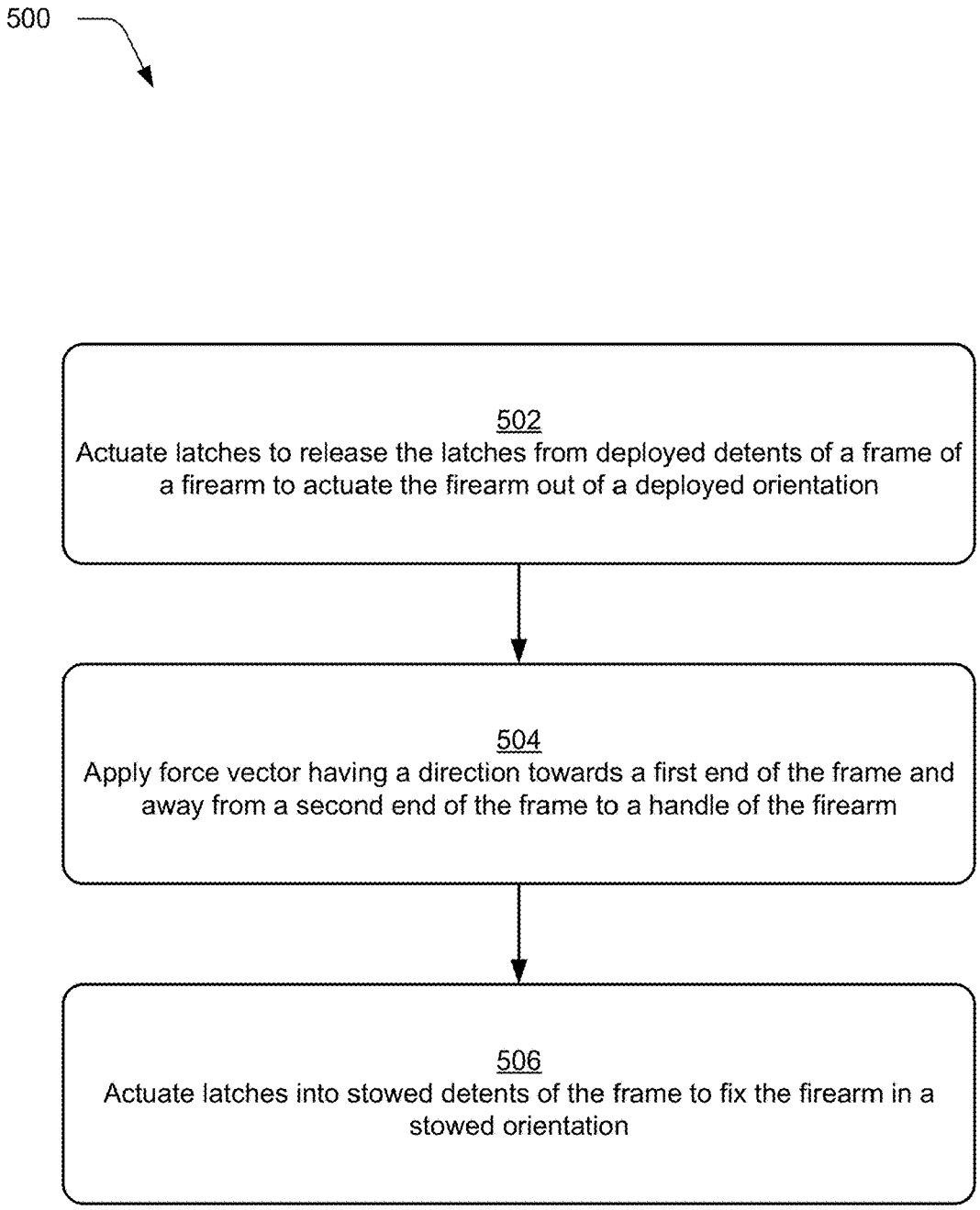
FIG. 5 is a flow diagram depicting a procedure in an example implementation in which an intrinsically safe firearm is converted from a deployed orientation to a stowed orientation.
Figure 64:
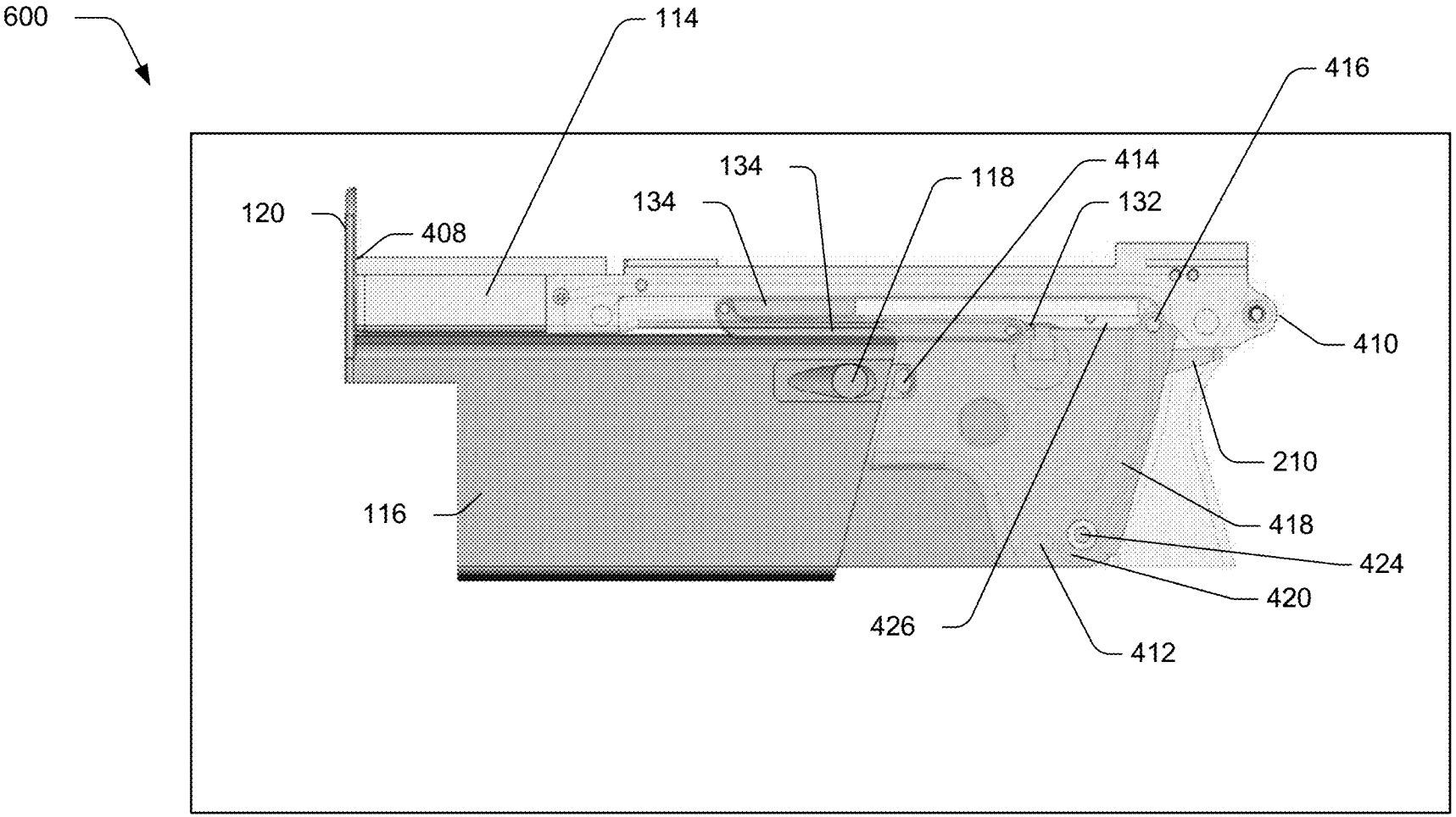

FIG. 5 is a flow diagram depicting a procedure 500 in an example implementation in which an intrinsically safe firearm is converted from a deployed orientation to a stowed orientation. First, latches are actuated to release the latches from deployed detents of a frame of a firearm to actuate the firearm out of a deployed orientation (block 502). For example, a user can actuate latches 118 to release the latches 118 from the deployed detents 412 of the frame 114 of the firearm to actuate the firearm out of the deployed orientation 102. A force vector having a direction towards a first end of the frame and away from a second end of the frame is applied to a handle of a firearm (block 504). In one example, a user can apply the force vector having the direction towards the frame first end 408 and away from the frame second end 410 to the handle 116 of the firearm. Finally, latches are actuated into stowed detents of the frame to fix the firearm in a stowed orientation (block 506). For example, a user can actuate the latches 118 into the stowed detents 414 of the frame 114 to fix the firearm in the stowed orientation 100.

Figure 6B:
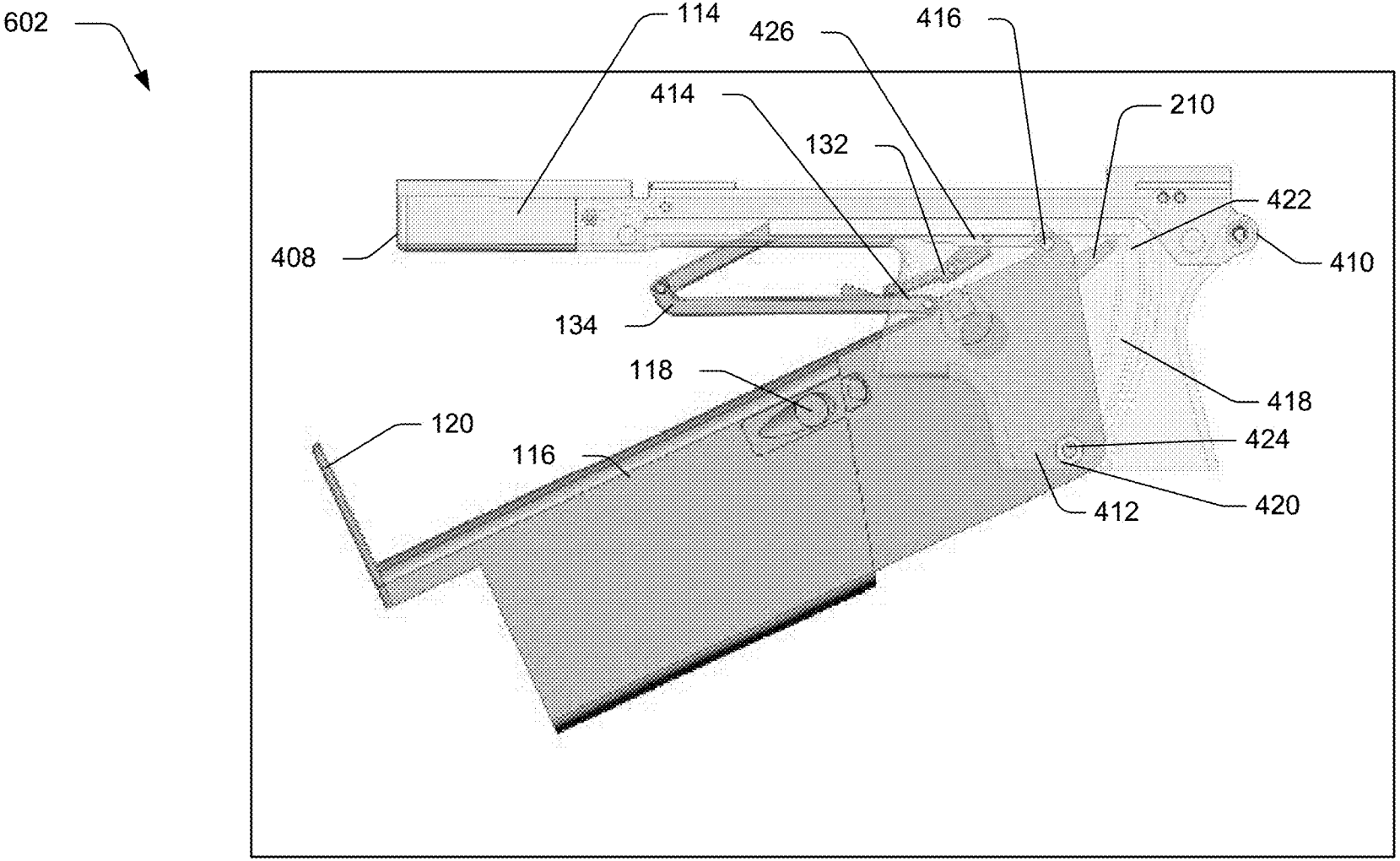
Figure 6C:
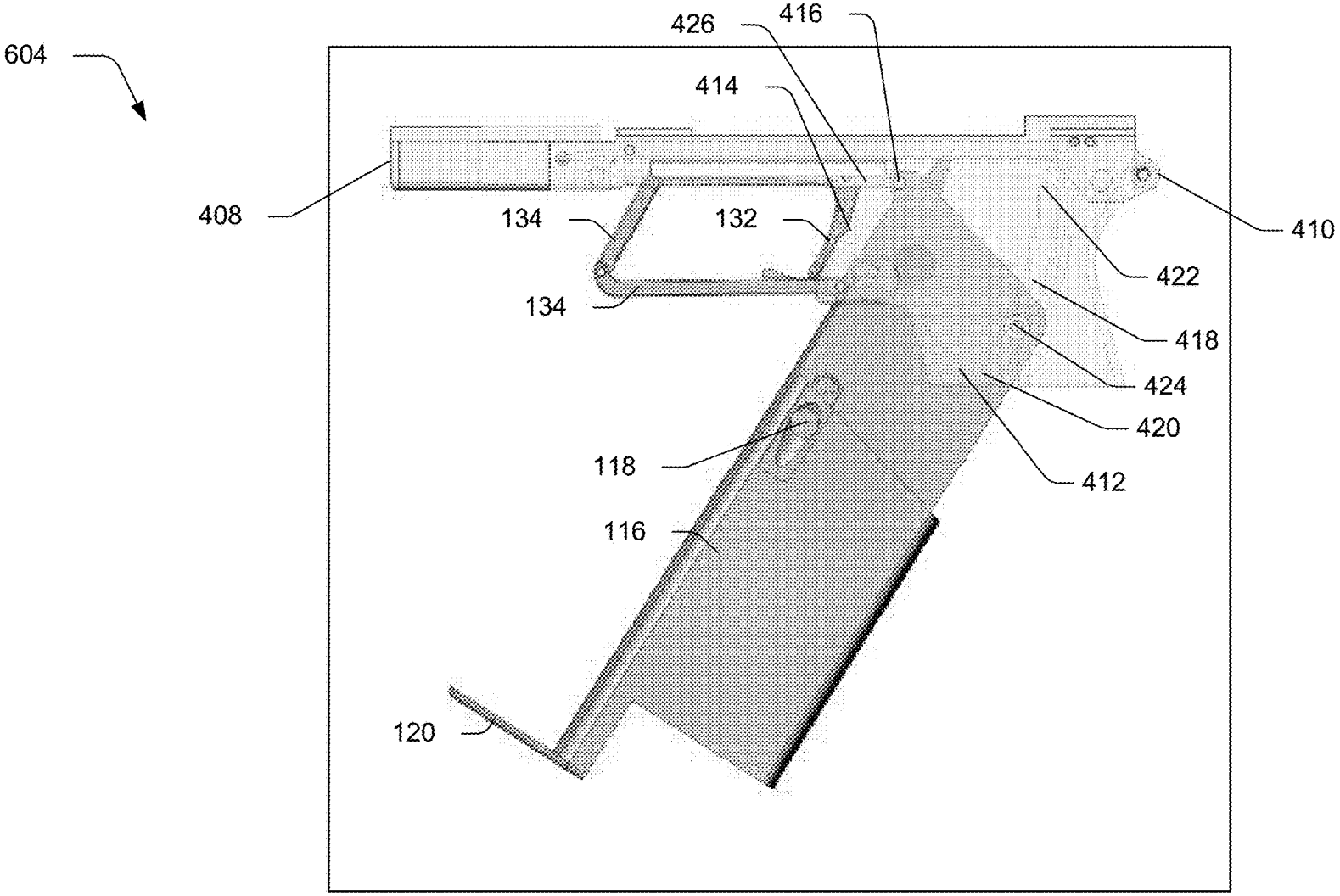
Figure 6D:
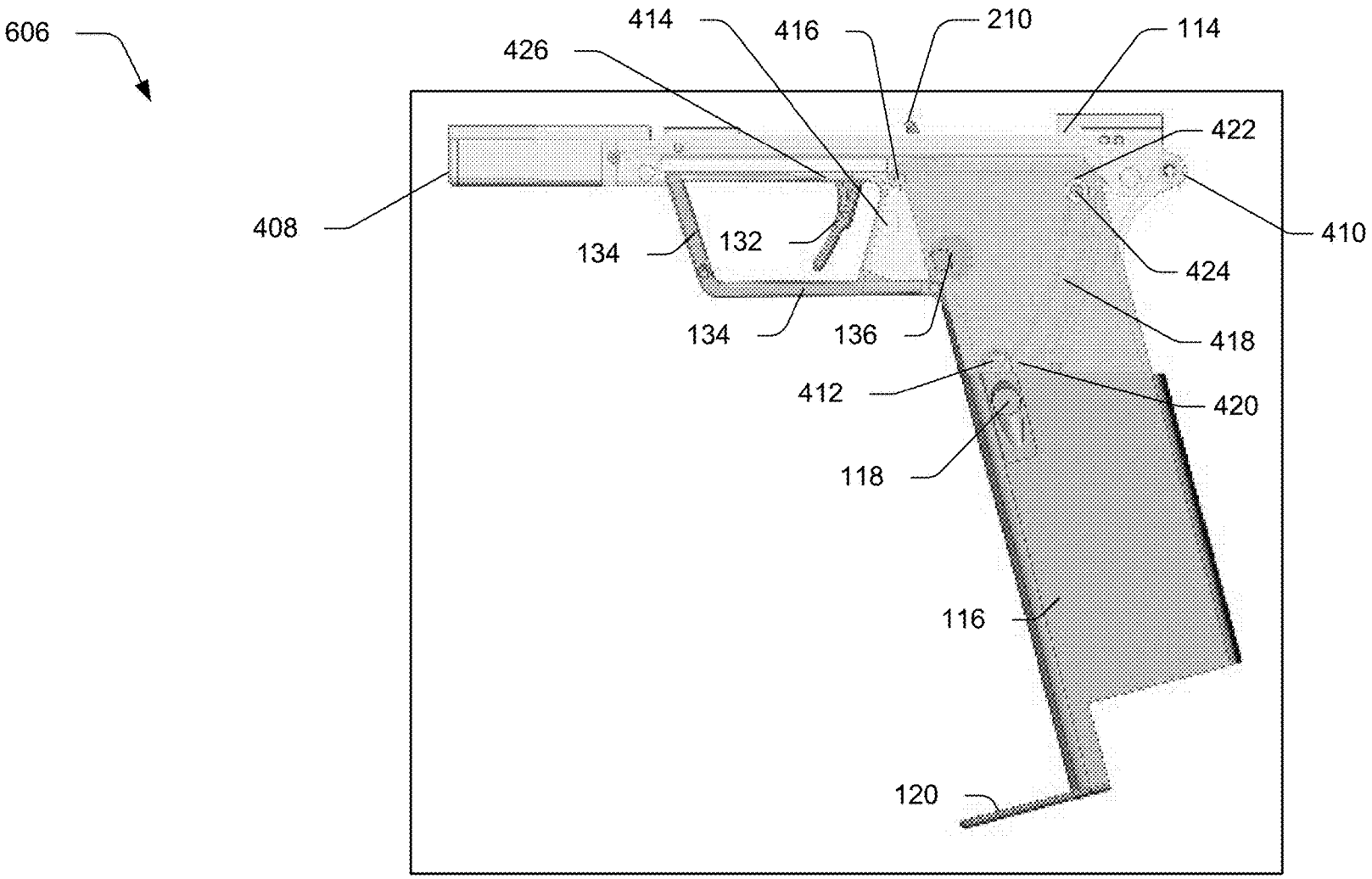

FIGS. 6A-6D are illustrations of partially transparent representations of components of an intrinsically safe firearm as the firearm is converted from a stowed orientation to a deployed orientation. FIG. 6A is a partially transparent view of the components of the intrinsically safe firearm in a stowed orientation 600. FIG. 6B is a partially transparent view of the components of the intrinsically safe firearm actuating out of the stowed orientation 602. FIG. 6C is a partially transparent view of the components of the intrinsically safe firearm actuating into a deployed orientation 604. FIG. 6D is a partially transparent view of the components of the intrinsically safe firearm in the deployed orientation 606.

As shown in FIG. 6A, latch 118 is fixed in stowed detent 414 and trigger 132 is not accessible. In some examples, a user may release the latch 118 which can include multiple latches 118 and which may be simultaneously actuated, and then rotate handle 116 about pivot pin 416 as shown in FIG. 6B Further rotation of the handle 116 about the pivot pin 414 is illustrated in FIG. 6C. FIG. 6D illustrates complete rotation of the handle 116 about the pivot pin 416 which causes the latch 118 to be fixed in deployed detent 412. As shown in FIG. 6D, the intrinsically safe firearm is temporarily fixed in the deployed orientation 102.

Figure 7:
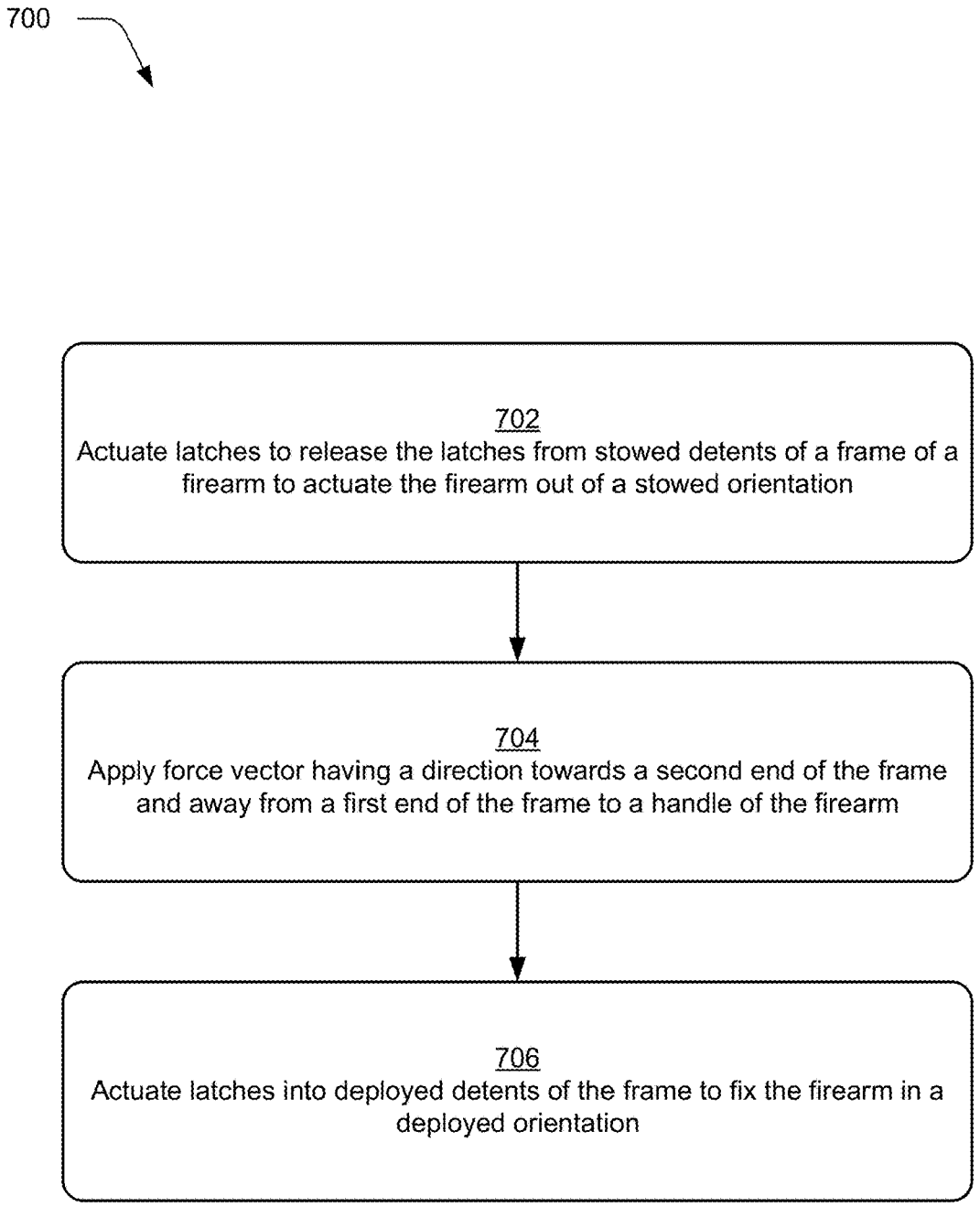
FIG. 7 is a flow diagram depicting a procedure in an example implementation in which an intrinsically safe firearm is converted from a stowed orientation to a deployed orientation.
Figure 84:
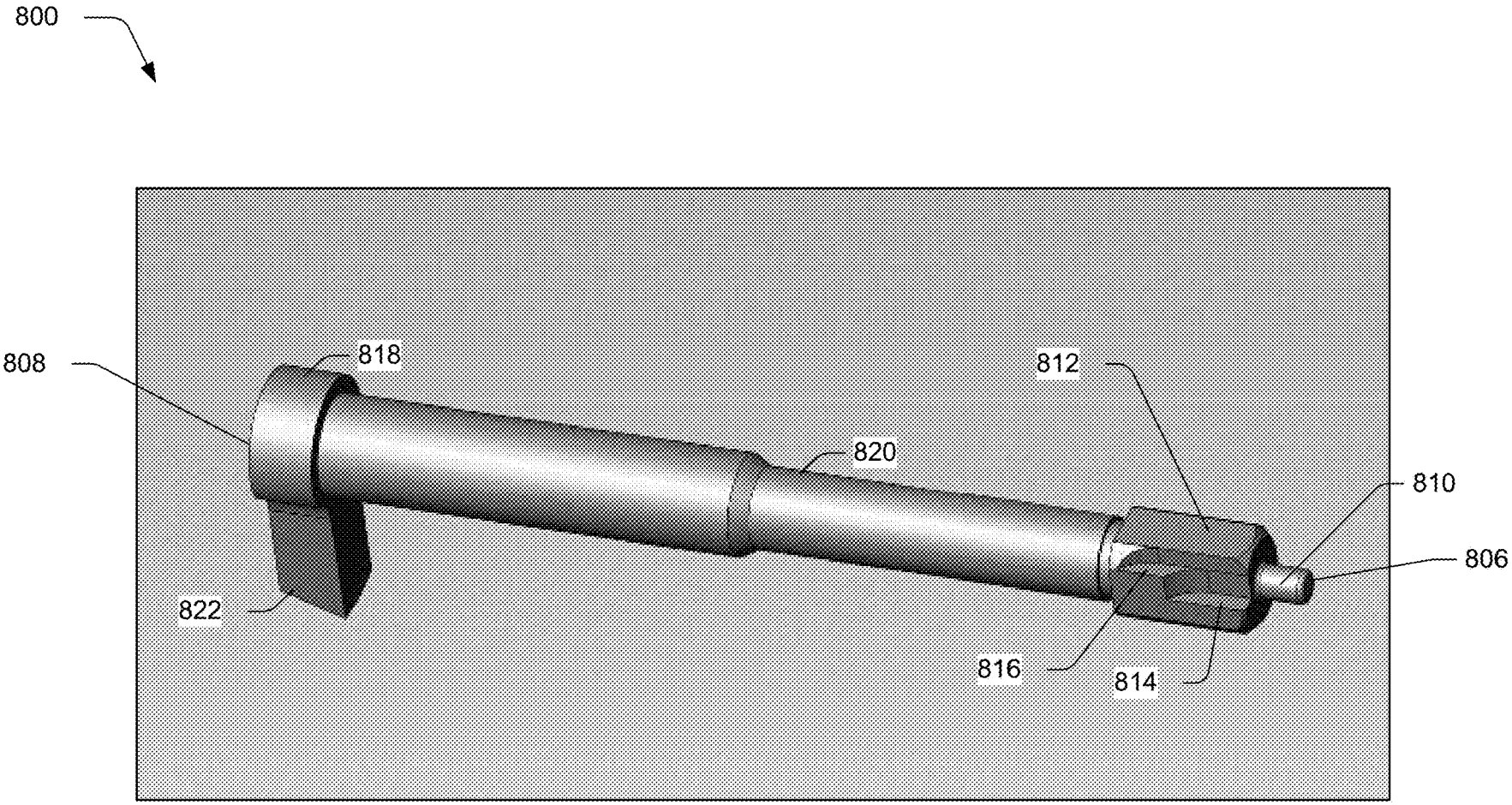

FIG. 7 is a flow diagram depicting a procedure 700 in an example implementation in which an intrinsically safe firearm is converted from a stowed orientation to a deployed orientation. First, latches are actuated to release the latches from stowed detents of a frame of a firearm to actuate the firearm out of a stowed orientation (block 702 For example, a user can actuate the latches 118 to release the latches from stowed the detents 414 of the frame 114 of the firearm to actuate the firearm out of the stowed orientation. A force vector having a direction towards a second end of the frame and away from a first end of the frame is applied to a handle of the firearm (block 704). In one example, a user may apply the force vector having the direction towards the frame second end 410 and away from the frame first end 208 to the handle 116 of the firearm. Finally, latches are actuated into deployed detents of the frame to fix the firearm in a deployed orientation (block 708). For example, a user may actuate the latches 118 into the deployed detents 412 of the frame 114 to fix the firearm in the deployed orientation.

Example Safety Features

Figure 8B:
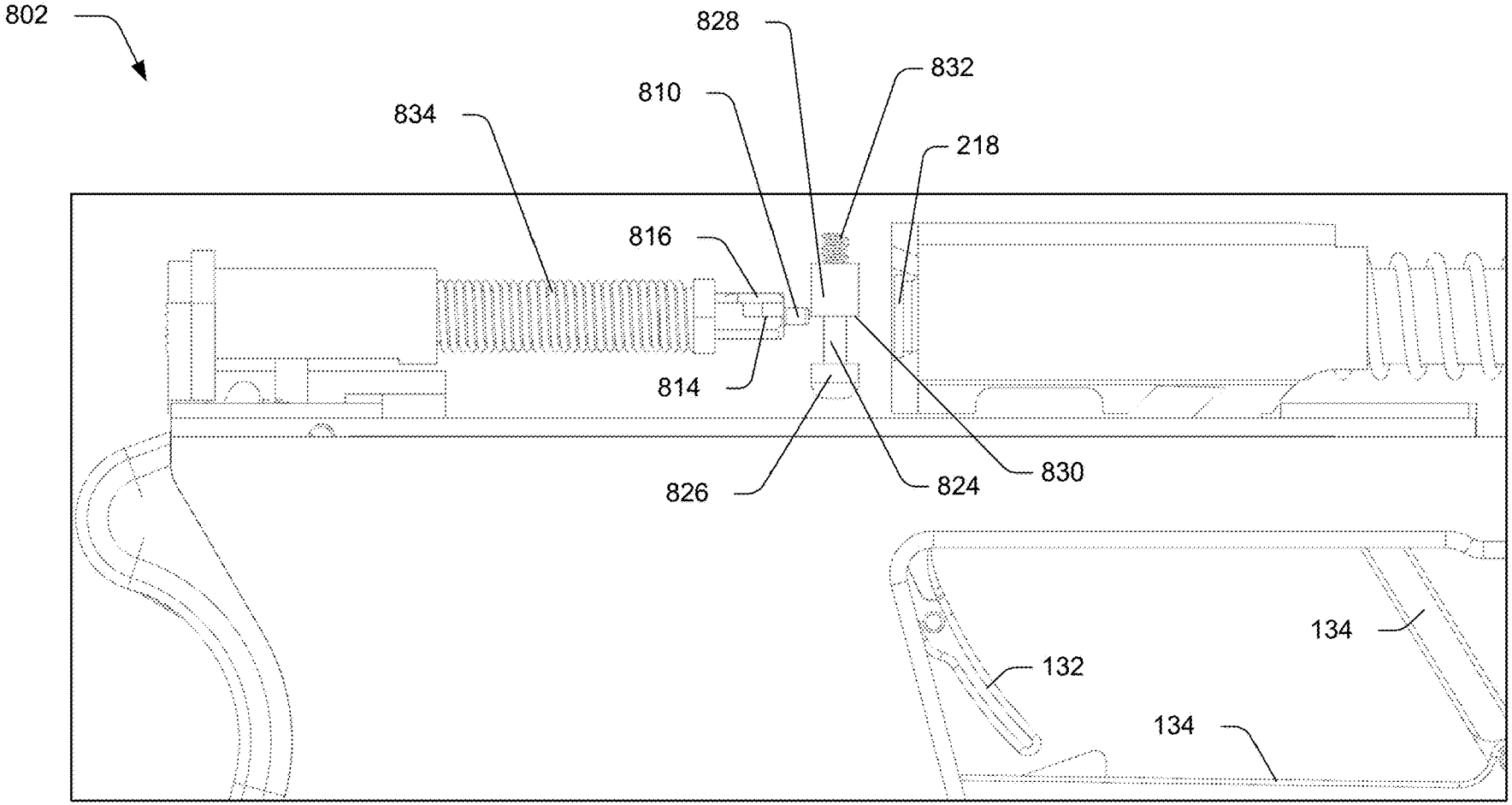
Figure 8C:
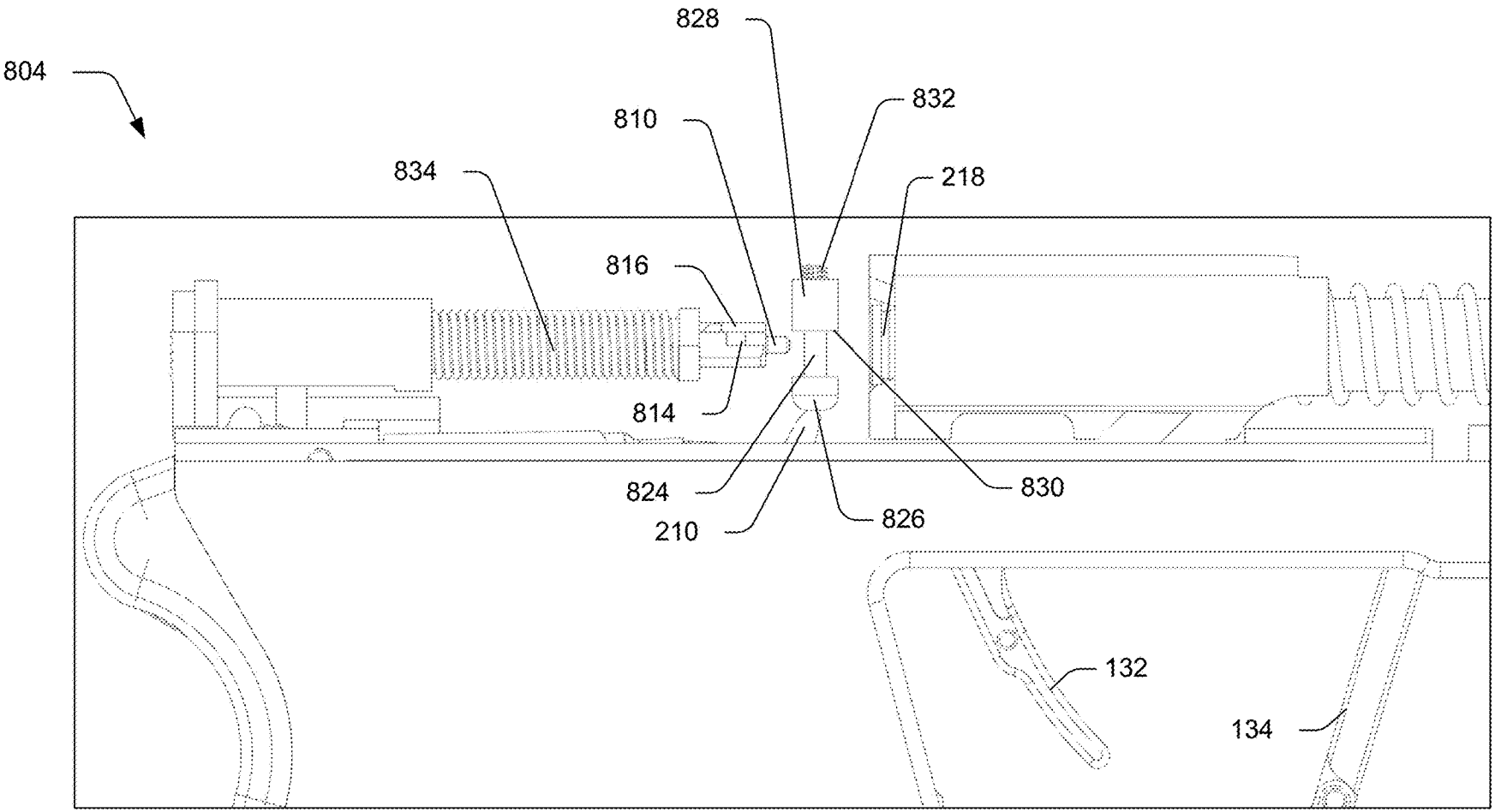
Figure 94:
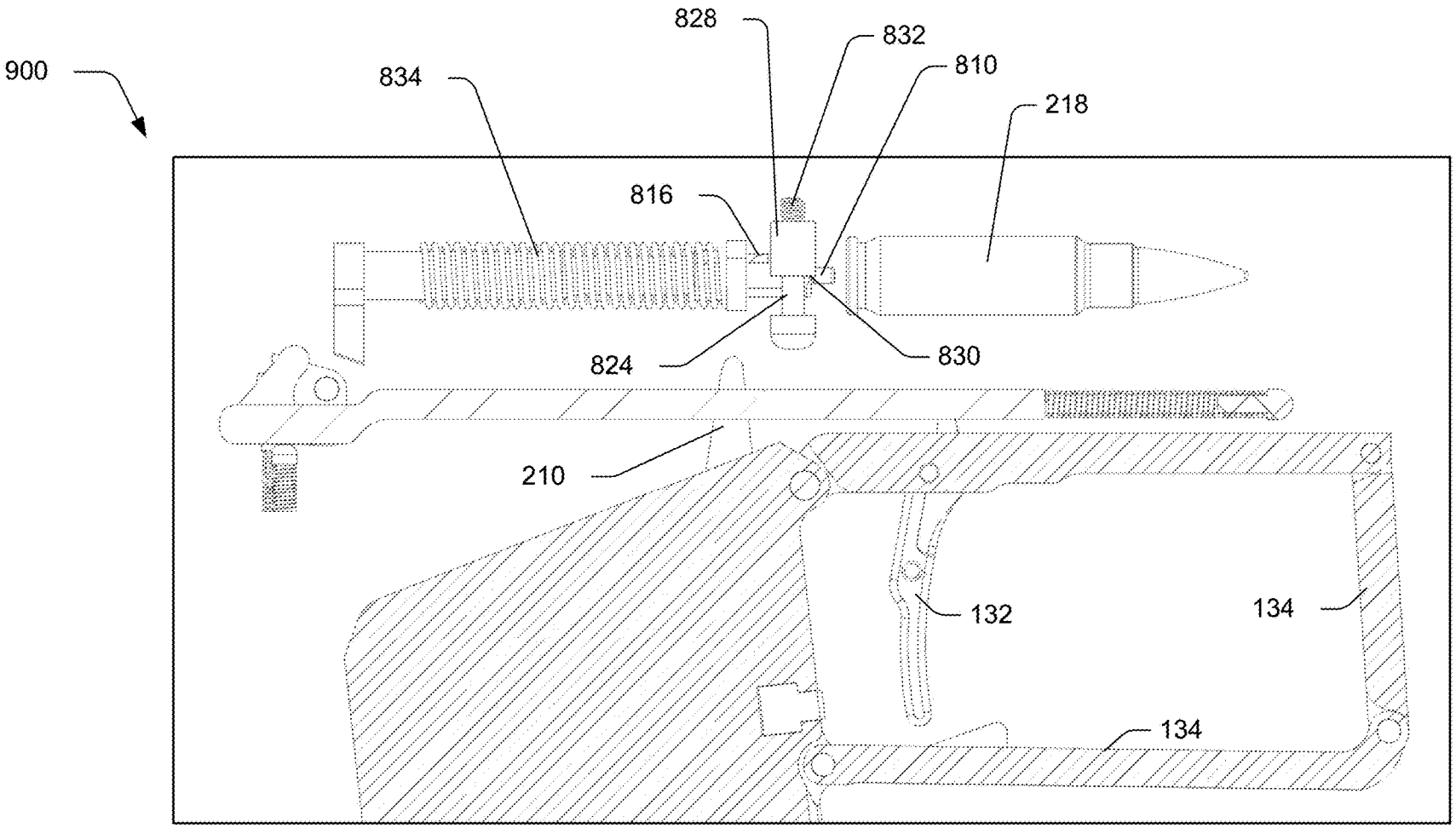

FIGS. 8A-8C are illustrations depicting representations of a firing pin and a firing pin safety. FIG. 8A illustrates a representation of an example firing pin 800. FIG. 8B illustrates a representation of an engaged firing pin safety 802. FIG. 8C illustrates a representation of a disengaged firing pin safety 804. As shown in FIG. 8A, the firing pin 800 includes a firing pin first end 806 and a firing pin second end 808. As illustrated, the firing pin 800 also includes a striker 810 and a block 812. The striker 810 is configured to striker a primer of a round such as chambered round 218 in this example. The block 812 is illustrated to include a stop geometry 814 and a strike geometry 816. In some examples, the firing pin 800 may also include a flange 818, a base 820, and a sear interface 822.

As shown in FIG. 8B, a firing pin safety 824 is disposed between the striker 810 and the chambered round 218. As illustrated, the firing pin safety 824 may include a magazine safety interface 826, a spring cup 828, a block geometry interface 830, and a firing pin safety spring 832. In one example, a firing pin spring 834 may be configured to actuate the striker 210 towards a primer of the chambered round 218, e.g., to discharge the chambered round 218. In this example, the firing pin safety 824 may prevent the striker 810 from contacting the primer of the chambered round 218. Consider an example in which the firing pin safety spring 832 applies a force to the spring cup 828 which actuates the firing pin safety 824 to a position in which the firing pin safety 824 is an engaged firing pin safety 802. In this example, the block geometry interface 830 of the firing pin safety 824 is aligned with the stop geometry 814 of the block 812 of the firing pin 800. As the striker 810 of the firing pin 800 advances towards the chambered round 218, an interface between the block geometry interface 830 and the stop geometry 814 prevents the striker 810 from advancing further towards the chambered round 218.

As shown in FIG. 8C, the magazine safety 210 applies a force to the magazine safety interface 826 of the firing pin safety 824 which has a greater magnitude than a magnitude of the force applied to the spring cup 828 by the firing pin safety spring 832. In this manner, the magazine safety 210 actuates the firing pin safety 824 to a position in which the firing pin safety 824 is a disengaged firing pin safety 804. Consider another example in which the block geometry interface 830 of the firing pin safety 824 is aligned with the strike geometry 816 of the block 812 of the firing pin 800. As the striker 810 of the firing pin 800 advances towards the chambered round 218, an interface between the block geometry interface 830 and the strike geometry 816 allows the striker 810 to contact the primer of the chambered round 218.

Figure 9B:
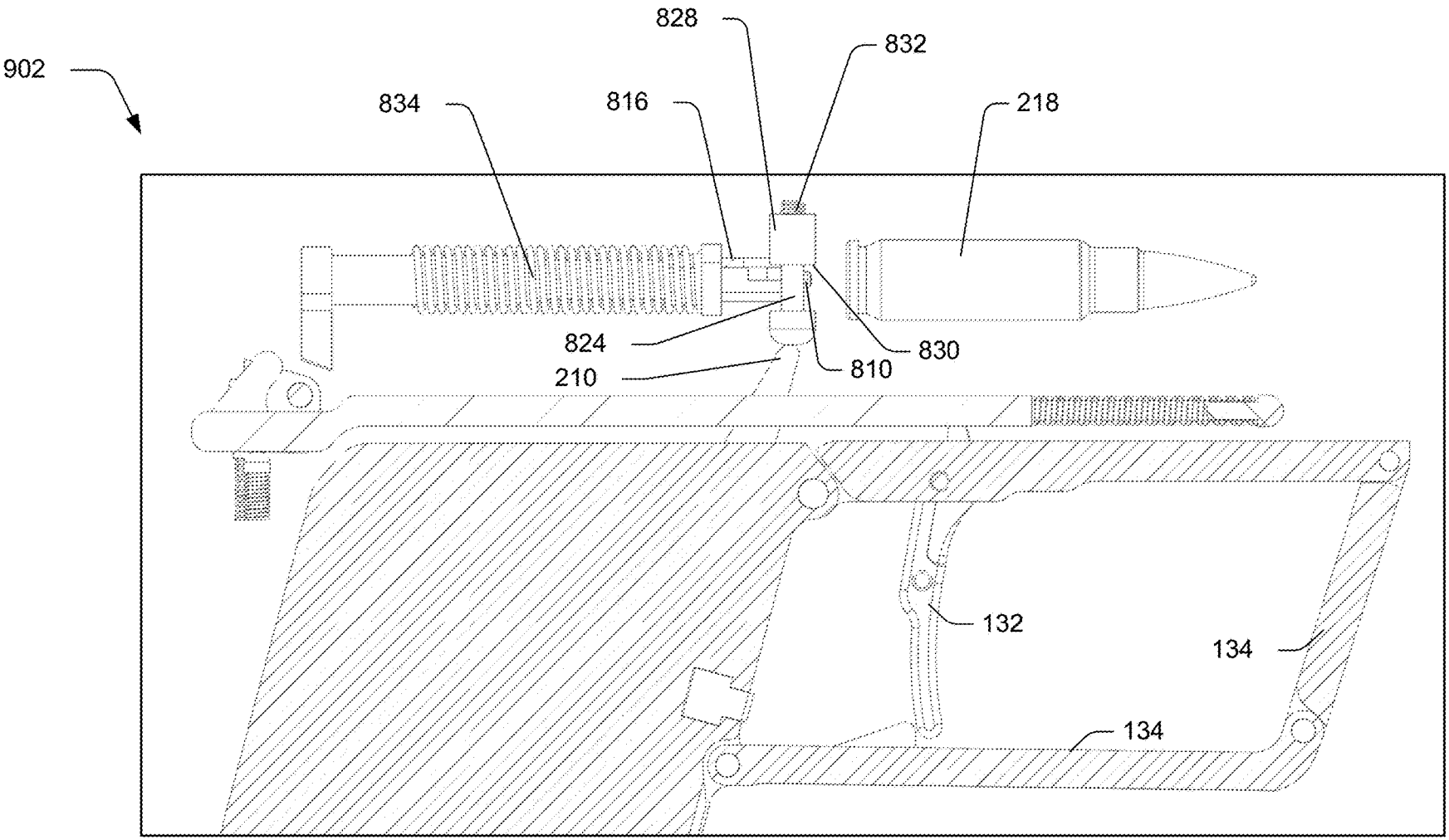
Figure 9C:
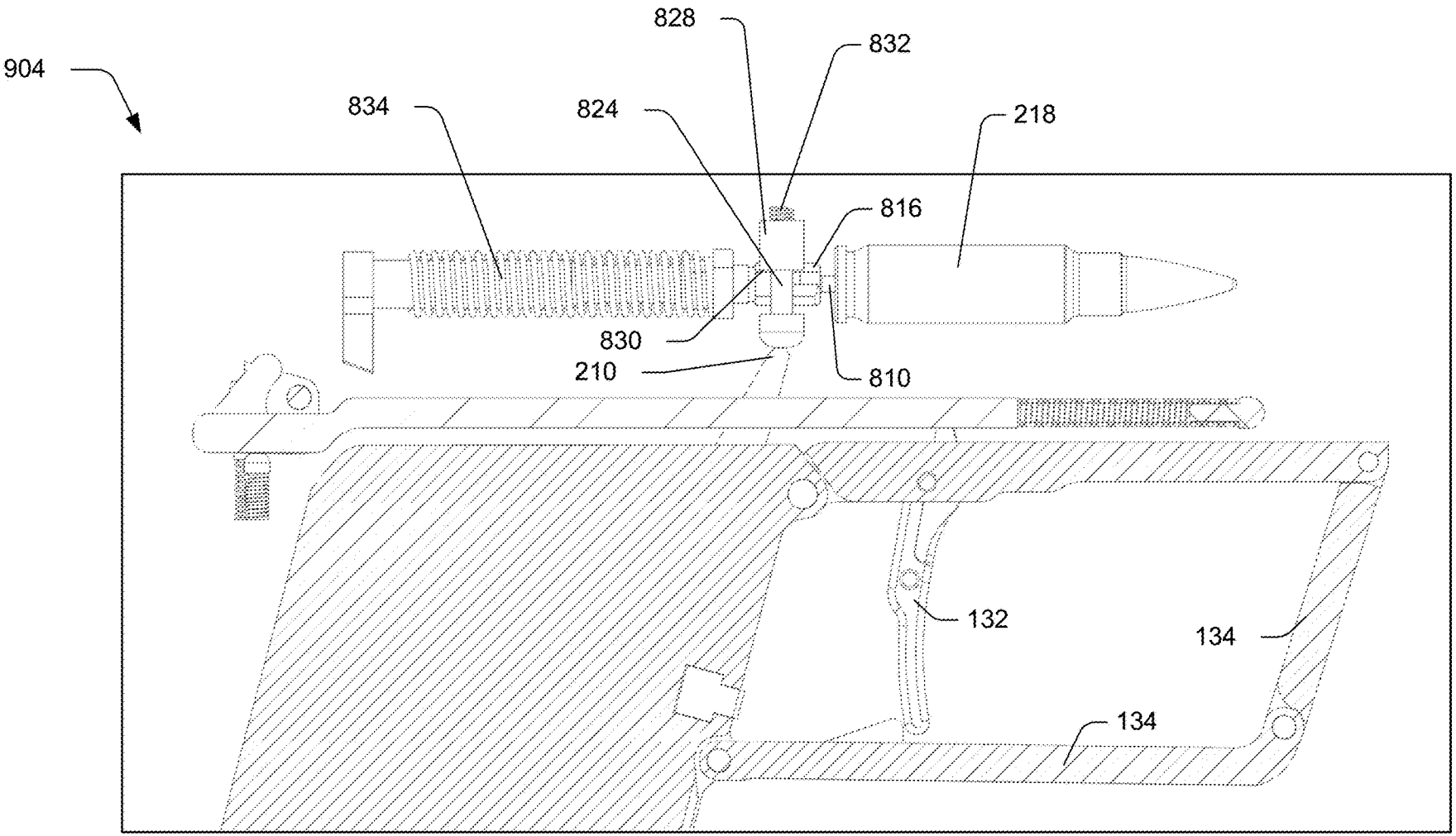

FIGS. 9A-9C are illustrations depicting operation of a magazine safety. FIG. 9A illustrates a representation of an unsupported firing pin safety 900. FIG. 9B illustrates a representation of the magazine safety 210 disengaging the firing pin safety 902. FIG. 9C illustrates a representation of example functionality in response to a disengaged firing pin safety 904. As shown in FIG. 9A, the magazine safety 210 is a distance away from the firing pin safety 824. As illustrated, the firing pin safety 824 prevents the striker 810 from contacting the chambered round 218. As shown in FIG. 9B, the magazine safety 210 actuates the firing pin safety 824 to align the block geometry interface 830 of the firing pin safety 824 with the strike geometry 816 of the firing pin 800. As shown in FIG. 9C, the disengaged firing pin safety 824 allows the striker 810 to contact a primer of the chambered round 218 in this example.

Additional safety features associated with a trigger safety are also described in reference to FIGS. 12A-12F. Briefly, the trigger safety may be configured to prevent an actuation of the trigger 132 as the firearm is converted from the stowed orientation 100 to the deployed orientation 102. For example, the trigger safety may be configured to prevent an actuation of the trigger 132 in the event of the firearm being dropped while in the deployed orientation 102. In one or more embodiments, the trigger safety can also be configured to prevent a non-deliberate finger press from actuating the trigger 132.

Example Latch Features

Figure 10A:
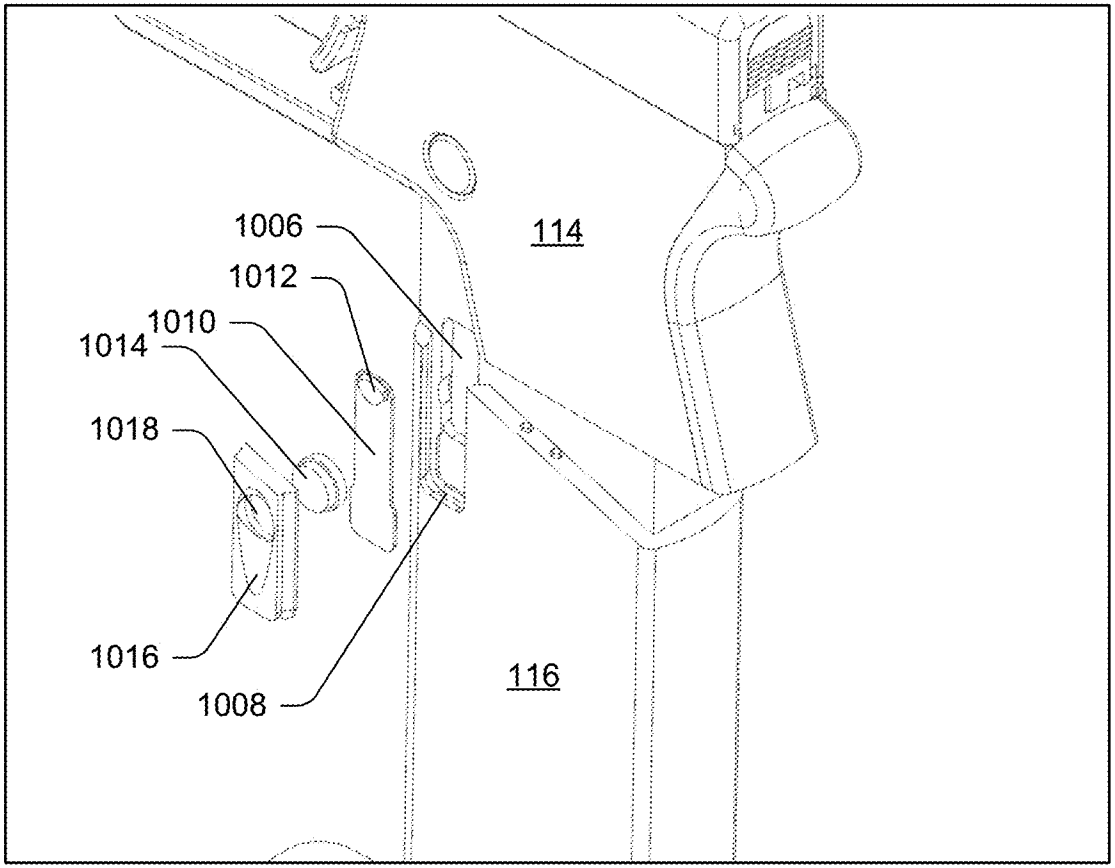
FIGS. 10A-10C are illustrations depicting operation of a latch.
Figure 10B:
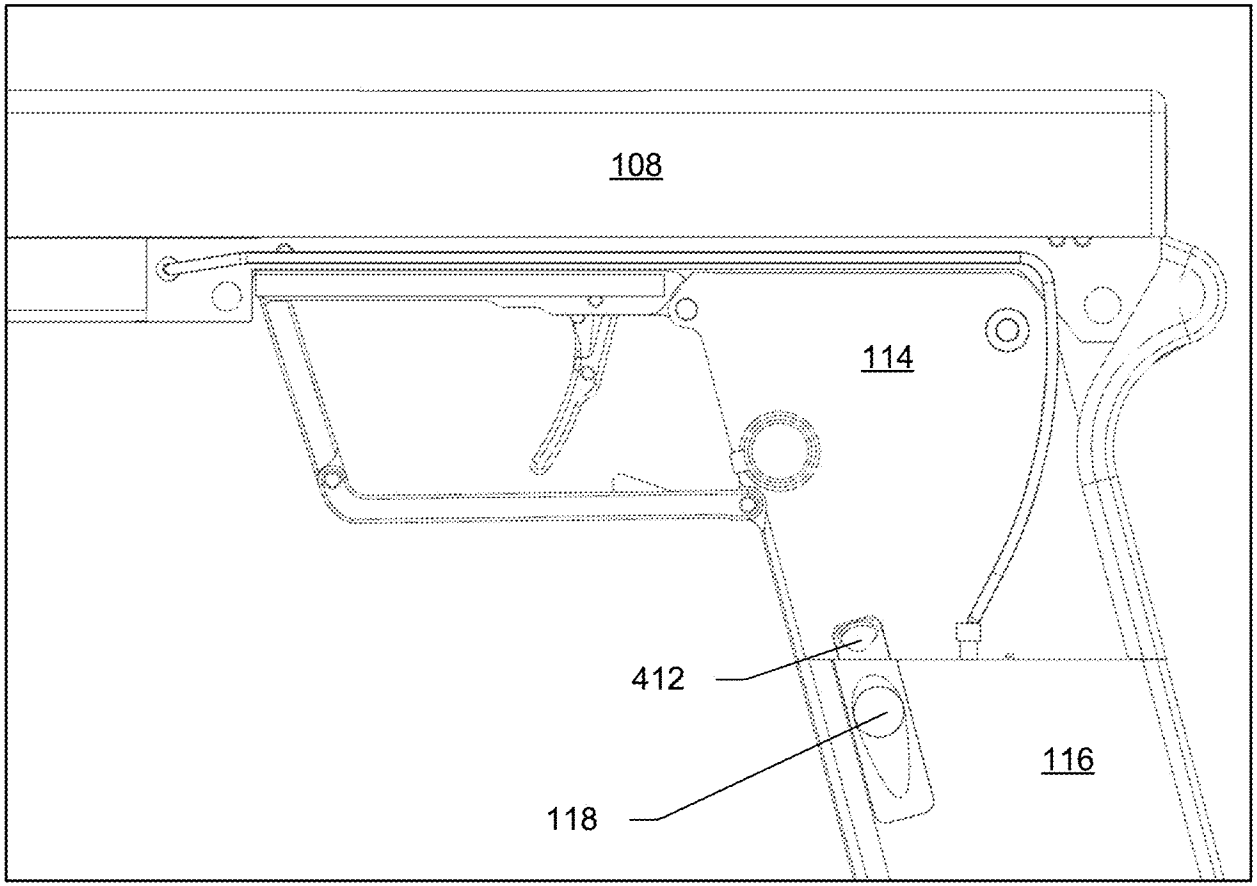
Figure 10C:
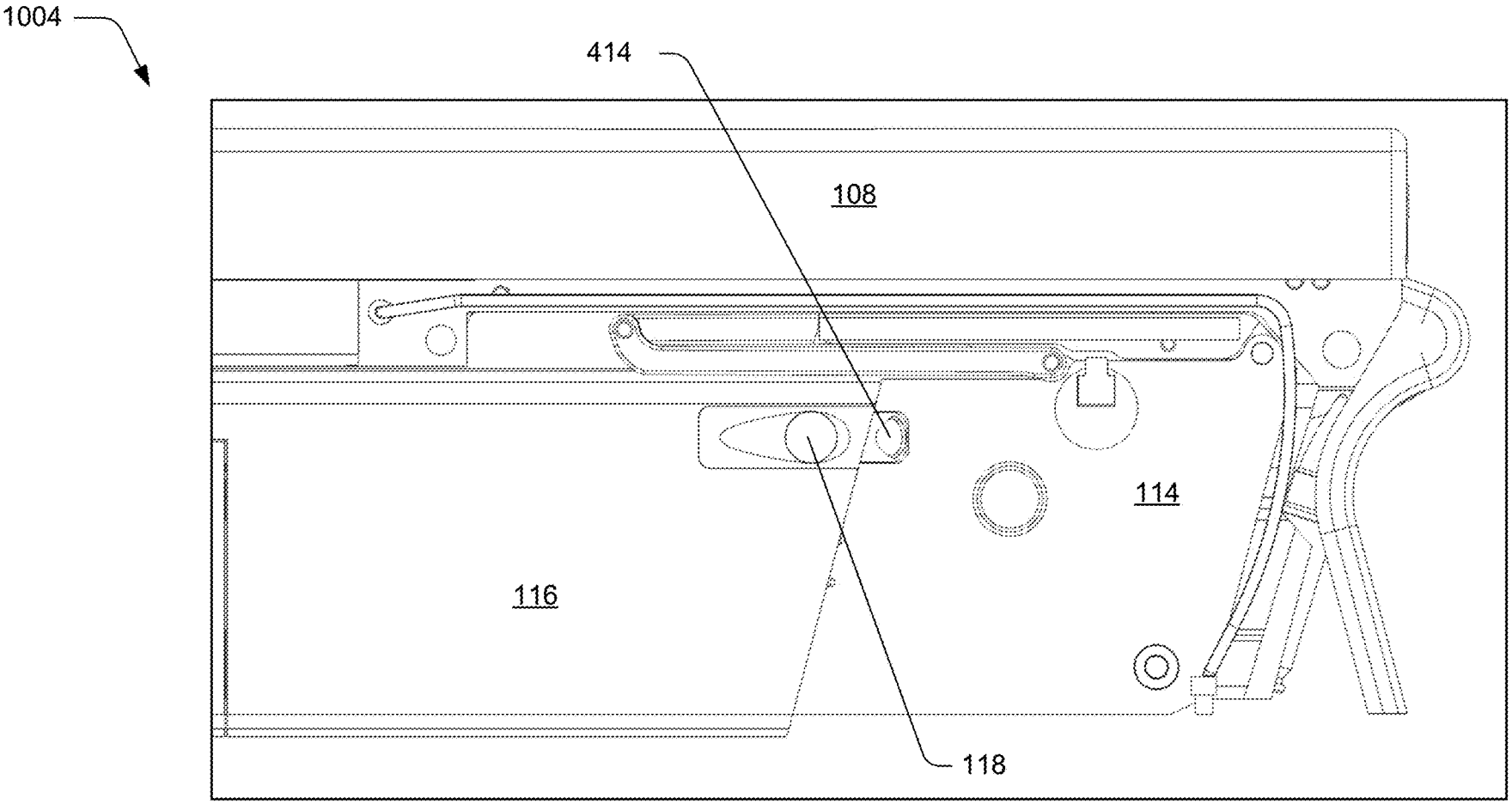
Figure 114:
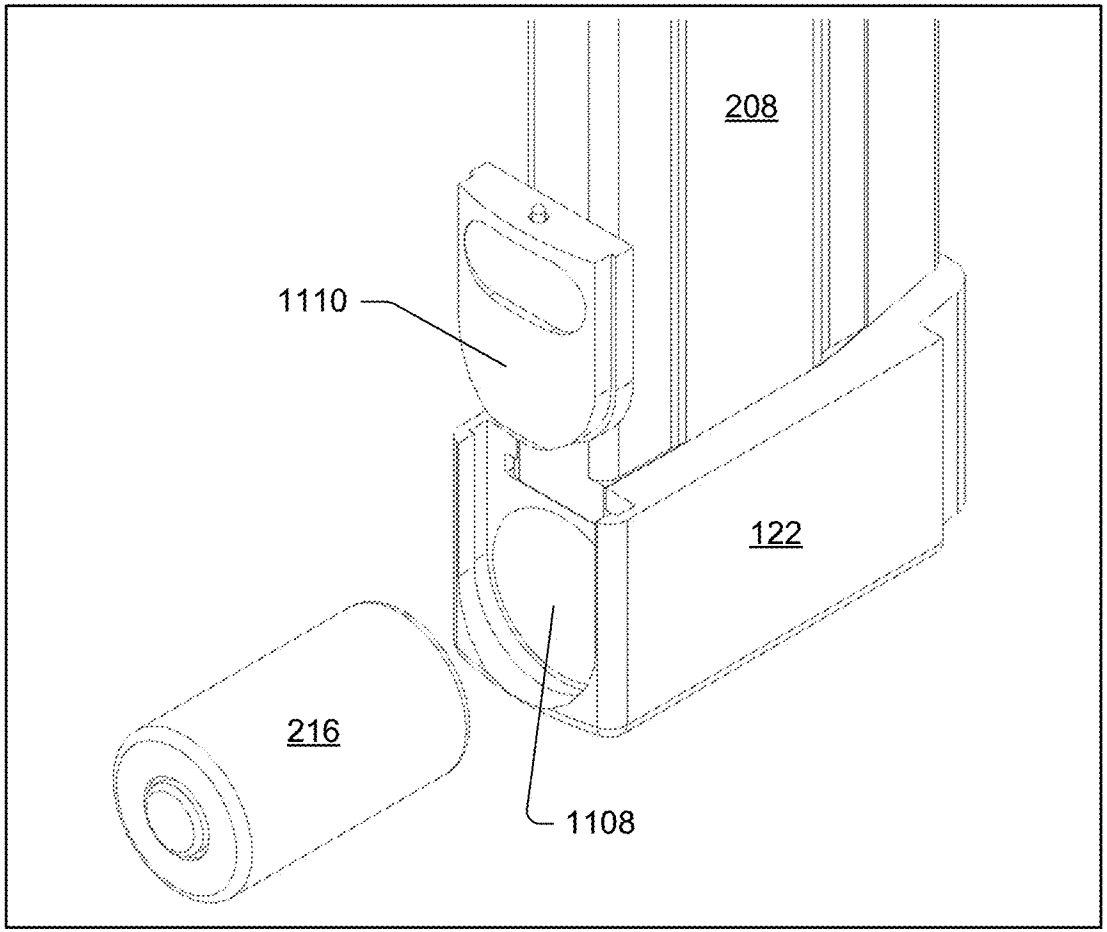

FIGS. 10A-10C are illustrations depicting operation of a latch. FIG. 10A illustrates a partially exploded view of a latch assembly 1000. FIG. 10B illustrates a representation of the latch in the deployed orientation 1002. FIG. 10C illustrates a representation of the latch in the stowed orientation 1004. As shown in FIG. 10A, a portion of the handle 116 can include a recessed portion 1006 and an actuator housing 1008. In some examples, the latch 118 can include an actuator 1010 having a detent catch 1012. The latch 118 can also include a user interface 1014, a user interface base 1016, and a user interface housing 1018. For example, the actuator 1010 may be disposed in the actuator housing 1008 such that a force applied to the actuator 1010 may deflect the actuator into the recessed portion 1006. In some examples, the user interface 1014 can be disposed between the actuator 1010 and the user interface base 1016 For example, a portion of the user interface 1014 may be disposed in the user interface housing 1018. In this manner, a user may apply a force to the user interface 1014 which is transferred to the actuator 1010 to actuate the detent catch 1012 into the recessed portion 1006. Thus, an actuation of the detent catch 1012 into the recessed portion 1006 may be configured to release the latch 118.

As shown in FIG. 10B, the latch 118 is disposed in the deployed detent 412. For example, the detent catch 1012 may be disposed in the deployed detent 412. In some examples, a user can apply a force to the latch 118 by applying the force to the user interface 1014. In these examples, applying the force to the user interface 1014 actuates the detent catch 1012 into the recessed portion 1006 and releases the latch 118 from the deployed detent 412. For example, latch 118 can include a tapered portion which facilitates automatic engagement of the latch 118 once having been released.

As shown in FIG. 10C, the latch 118 is disposed in the stowed detent 414. For example, the detent catch 1012 may be disposed in the stowed detent 414. In some examples, a user can apply a force to the latch 118 by applying the force to the user interface 1014. In these examples, applying the force to the user interface 1014 actuates the detent catch 1012 into the recessed portion 1006 and releases the latch 118 from the stowed detent 414.

Example Circuits

Figure 11B:
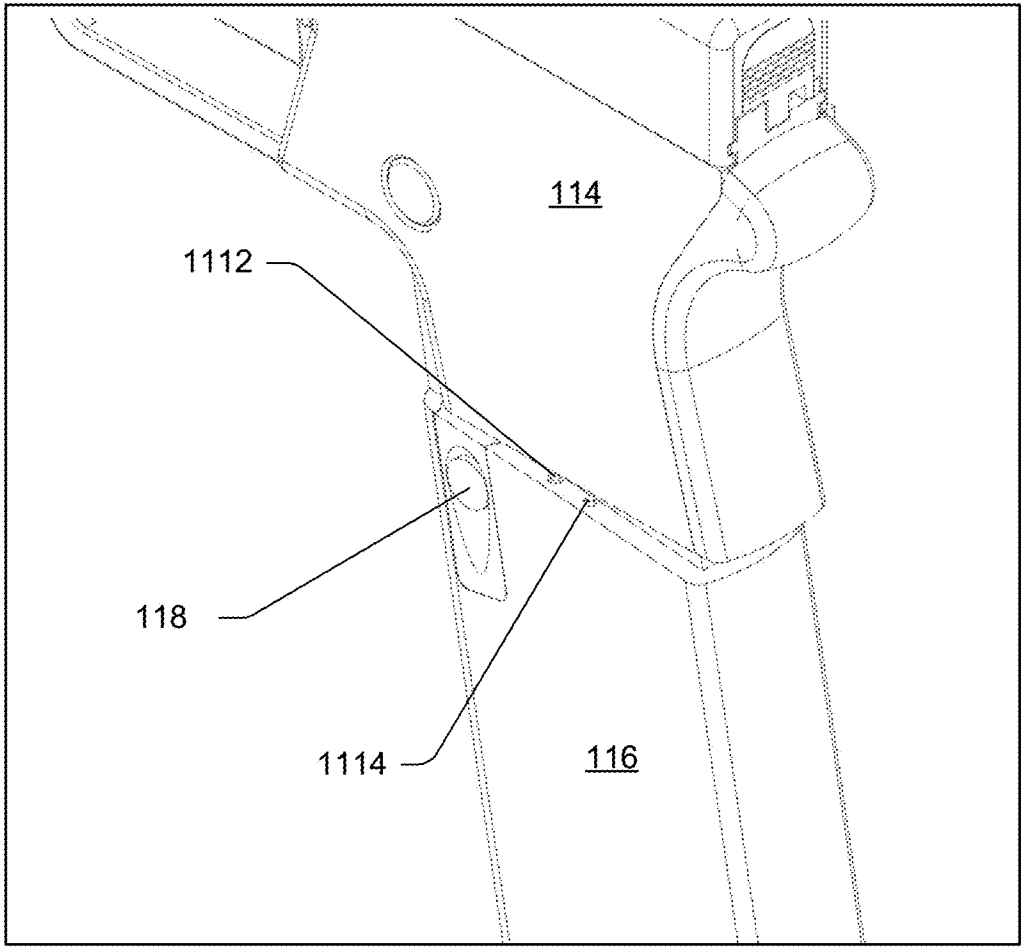
Figure 11C:
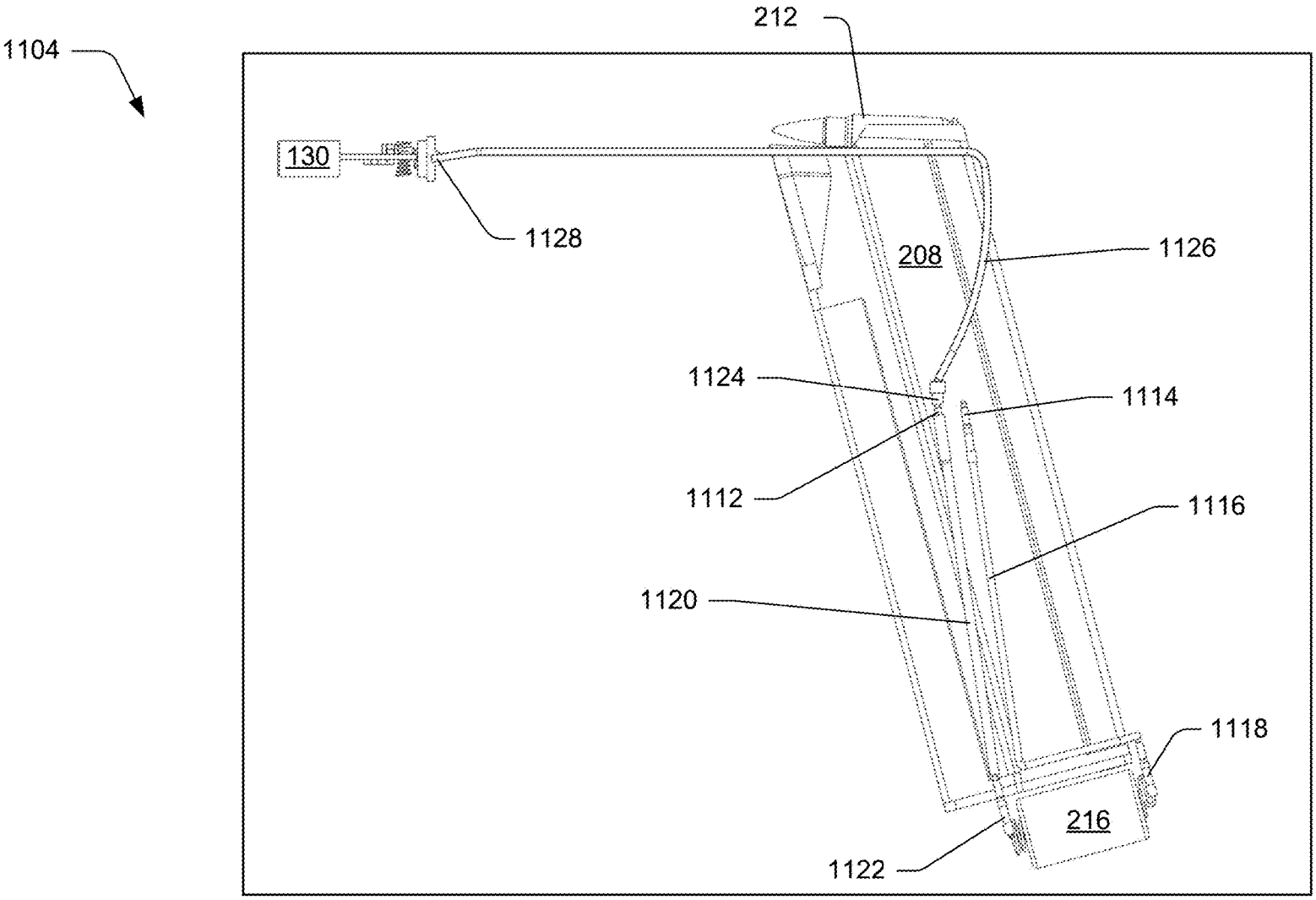
Figure 11D:
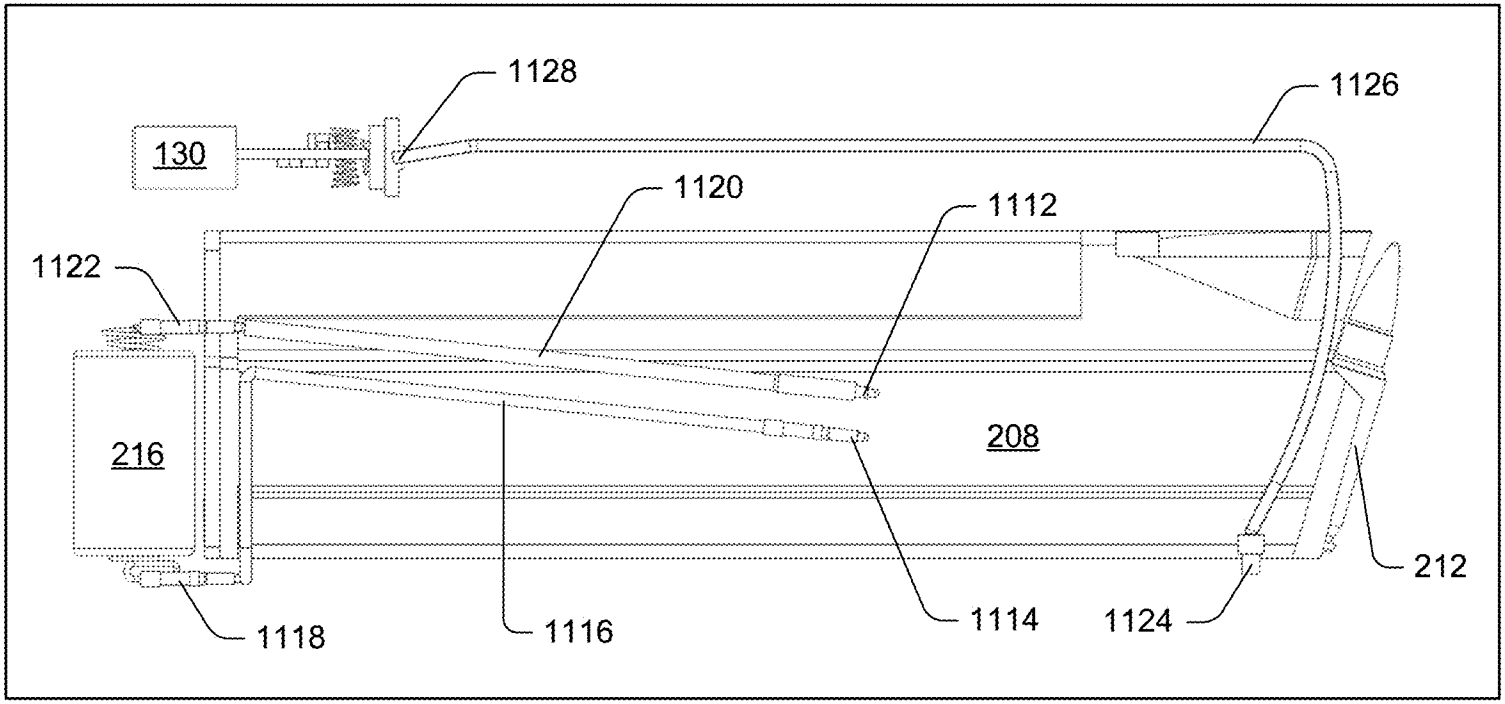

FIGS. 11A-11D are illustrations depicting example representations of a laser sight circuit. FIG. 11A illustrates functionality of the power supply housing 1100. FIG. 11B illustrates a representation of electrical conductors 1102. FIG. 11C illustrates a representation of a closed laser sight circuit 1104. FIG. 11D illustrates a representation of an open laser sight circuit 1106. As shown in FIG. 11A, the power supply housing 122 includes an inner portion 1108 for housing the power supply 216. As illustrated, the power supply housing 122 also includes door 1110 which is illustrated as functional to temporarily fix the power supply 216 in the inner portion 1108 and to release the power supply 216 from the inner portion 1108 of the power supply housing 122.

As shown in FIG. 11B, the handle 116 may include a first conductor 1112 and a second conductor 1114. In one example, the first conductor 1112 and the second conductor 1114 may be configured to conduct electrical current as electrical conductors. FIG. 11C illustrates an example configuration of the laser sight circuit when the firearm is in the deployed orientation 102. As shown in FIG. 11C, the second electrical conductor 1114 includes an extension 1116 which electrically connects the second electrical conductor 1114 to a ground terminal 1118 of the power supply 216. As illustrated, the first electrical conductor 1112 includes an extension 1120 which electrically connects the first electrical conductor 1112 to an active or hot terminal 1122 of the power supply 216. In one example, the first electrical conductor 1112 may be electrically connected to a laser sight electrical conductor 1124 which includes an extension 1126 that electrically connects the laser sight electrical conductor 1124 to a laser sight terminal 1128. In this example, the laser sight terminal 1128 is electrically connected to the active terminal 1122 of the power supply 216. In this manner, the power supply 216 provides electrical current to the laser sight terminal 1128 which energizes the laser sight 130 when the intrinsically safe firearm is in the deployed orientation 102.

FIG. 11D illustrates an example configuration of the laser sight circuit when the firearm is in the stowed orientation 100. As shown in FIG. 11D, the laser sight conductor 1124 is electrically disconnected from the first electrical conductor 1112 which opens the electrical connection between the laser sight terminal 1128 and the active terminal 1122 of the power supply 216. In this manner, the laser sight 130 is not energized when the intrinsically safe firearm is in the stowed orientation 100.

Example Operations

Figure 12A:
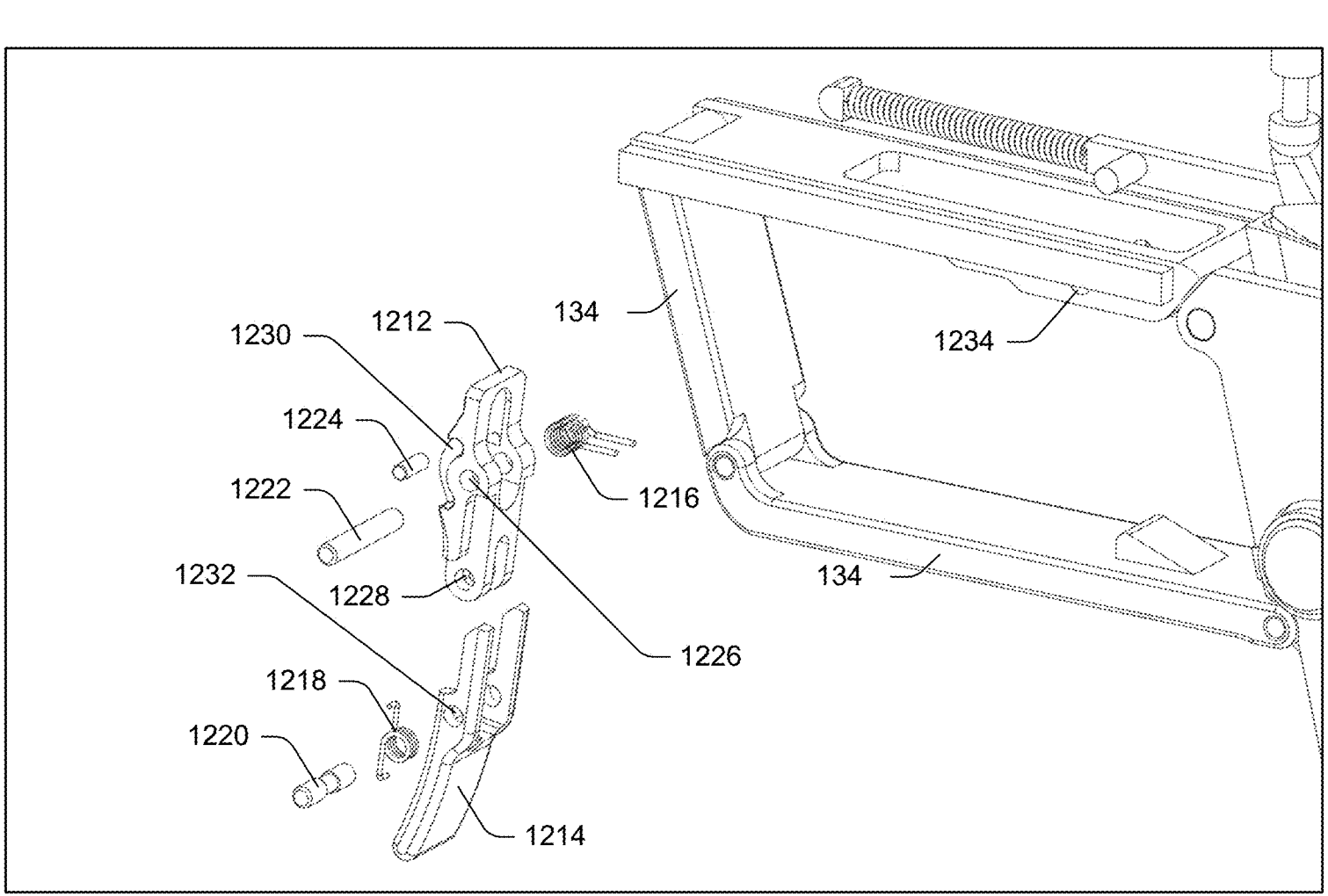
Figure 12B:
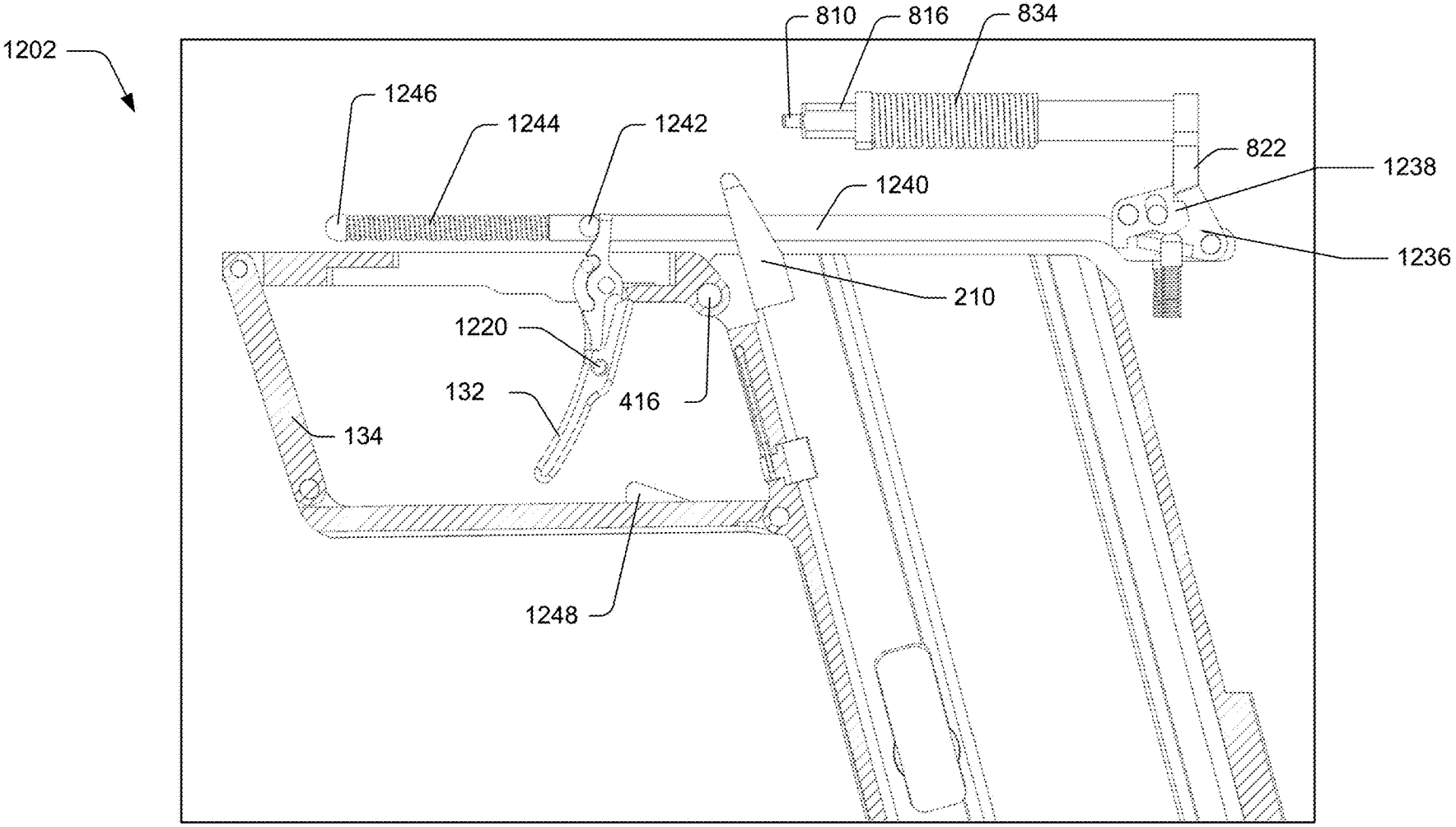
Figure 12C:
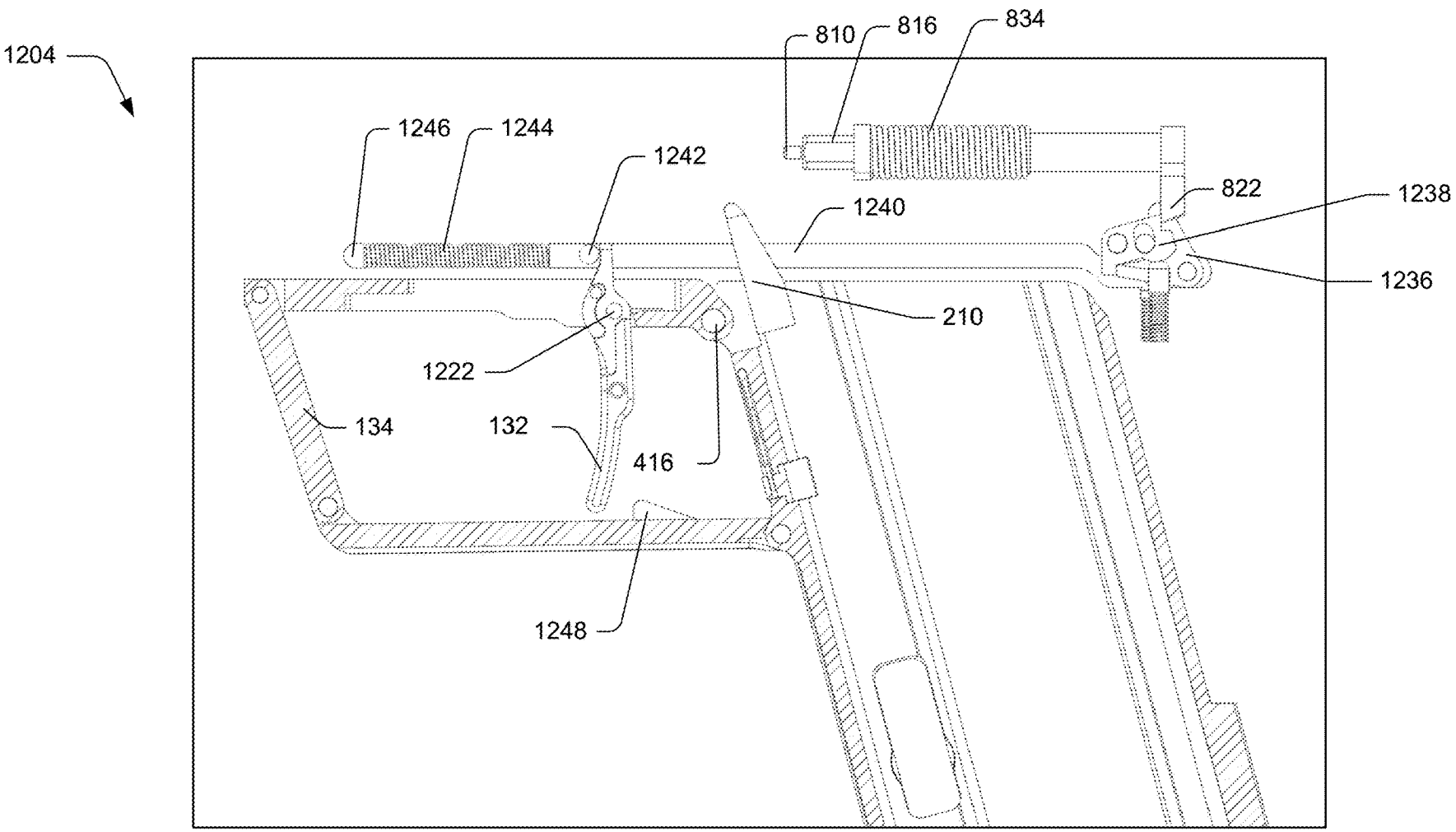
Figure 12D:
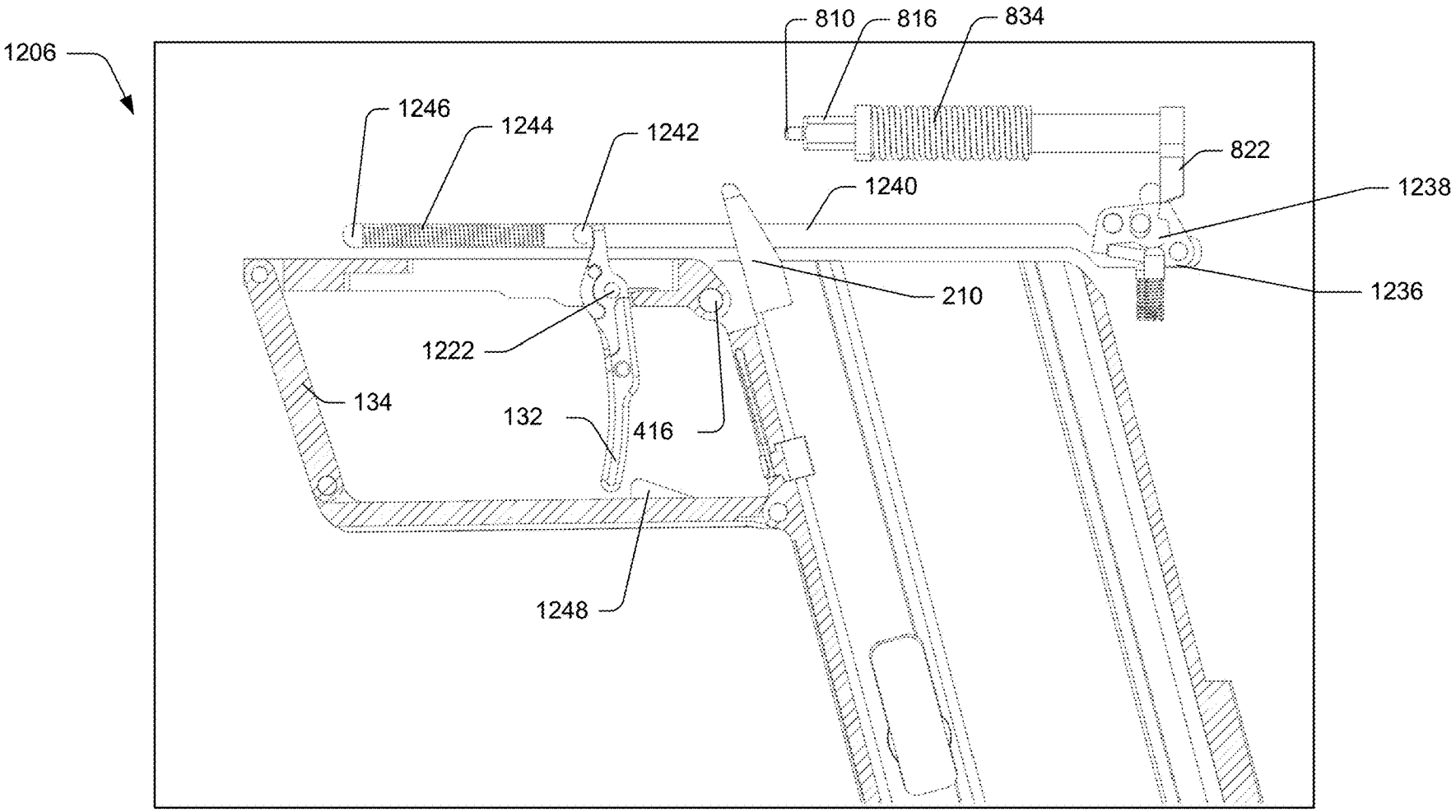
Figure 12B:
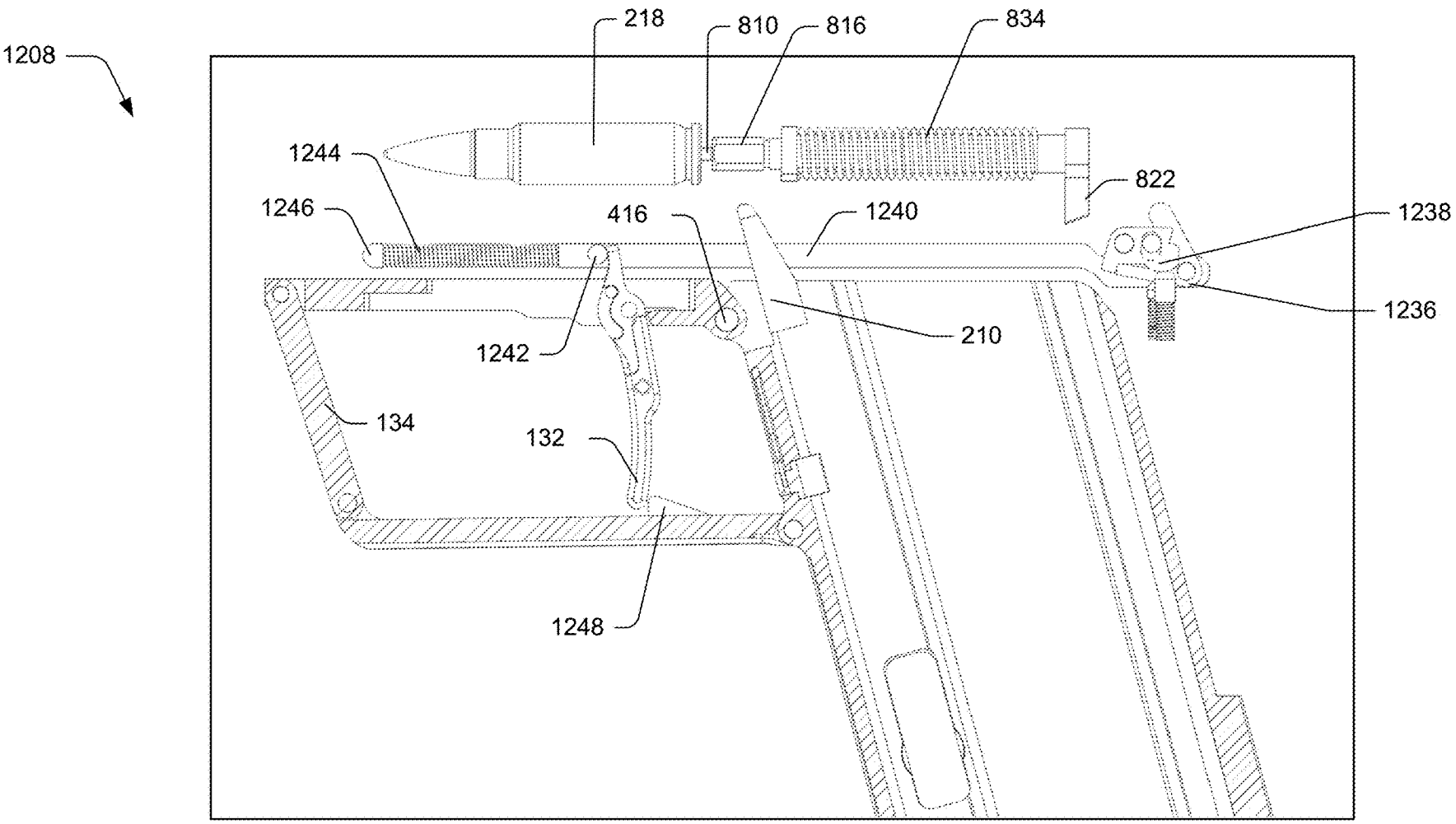
Figure 127:
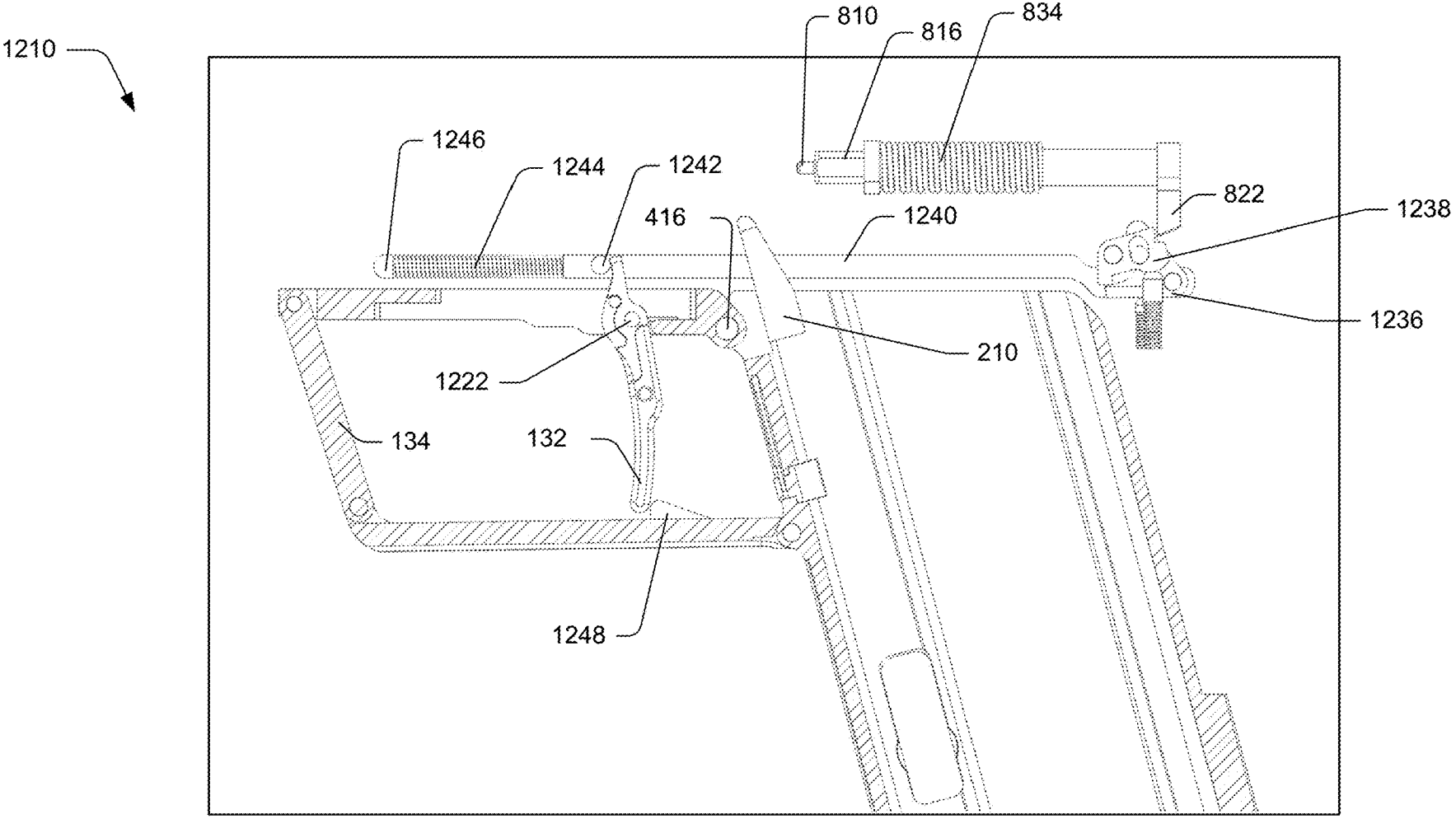
Figure 134:
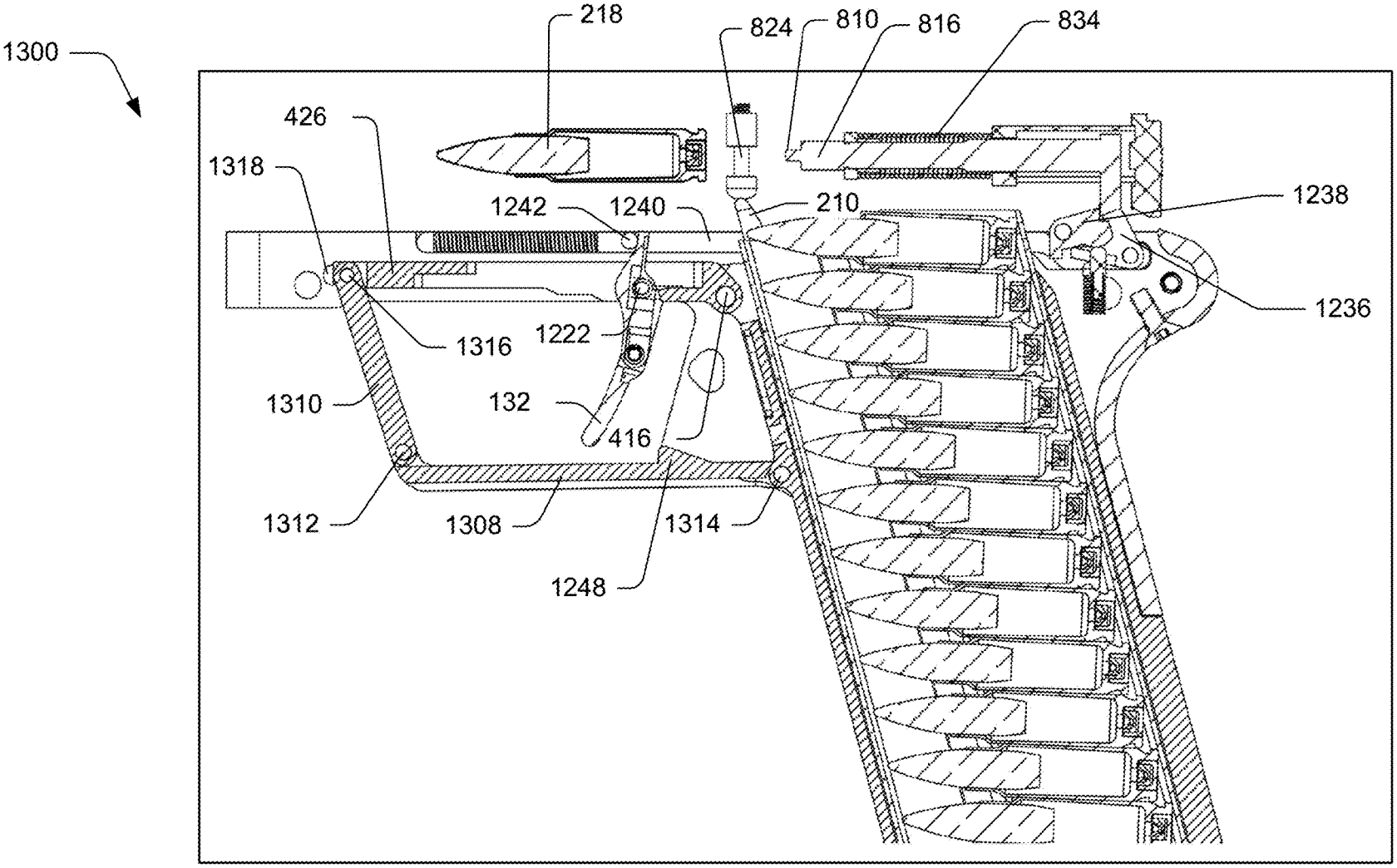

FIGS. 12A-12F are illustrations depicting example representations of operations of components of an intrinsically safe firearm. FIG. 12A illustrates a trigger assembly 1200. FIG. 12B illustrates a representation of components of the firearm in a cocked configuration 1202. FIG. 12C illustrates a representation of components of the firearm in a configuration in which a trigger safety has been disengaged 1204. FIG. 12D illustrates a representation of components of the firearm before the firing pin is released 1206. FIG. 12E illustrates a representation of components of the firearm as the chambered round is discharged 1208. FIG. 12F illustrates a representation of components of the firearm as the slide cycles after discharge 1210.

As shown in FIG. 12A, trigger 132 can include an upper trigger 1212, a lower trigger 1214, an upper trigger spring 1216, a lower trigger spring 1218, a trigger safety pivot 1220, a trigger pivot 1222, and an upper trigger pin 1224. In some examples, the upper trigger 1212 may include a trigger pivot housing 1226, a trigger safety pivot inner housing 1228, and an upper trigger channel 1230. For example, the lower trigger 1214 may include a trigger safety pivot outer housing 1232. In one or more embodiments, the trigger safety pivot 1220 may be disposed in the trigger safety pivot out housing 1232, the lower trigger spring 1218 and the trigger safety pivot inner housing 1228. In this manner, the trigger safety pivot 1220 can connect the upper trigger 1212 and the lower trigger 1214. In some examples, the trigger pivot 1222 may be disposed in the trigger pivot housing 1226, the upper trigger spring 1216, and a portion 1234 of the trigger guard 134. In this way, the trigger pivot 122 can connect the upper trigger 1212 to the trigger guard 134. In some examples, the upper trigger pin 1224 may be disposed in the upper trigger channel 1230.

As illustrated in FIG. 12B, the firearm may include a paw 1236, a sear 1238, and a trigger bar 1240. In some examples, the trigger bar 1240 can include a trigger bar pin 1242, a trigger bar spring 1244, and a trigger bar end 1246. The firearm is also illustrated to include an integral stop 1248 as part of the trigger guard 134 in one example. In the cocked configuration 1202 illustrated, the lower trigger spring 1218 applies a force which rotates the lower trigger 1214 relative to the upper trigger 1212 and engages a trigger safety as the upper portion of the lower trigger 1214 abuts a portion of the trigger guard 134 disposed between the pivot pin 416 and the trigger pivot 1222. For example, this trigger safety can be disengaged by applying a force vector having a direction towards the integral trigger stop 1248 to the lower trigger 1214. While the trigger safety is engaged, the upper trigger 1212 as adjacent to and abuts the trigger bar pin 1242. In some examples, an application of a force to a portion of the upper trigger 1212 may not disengage the trigger safety and thus not discharge a round. In one example, this feature may prevent the trigger 132 from actuating in the event that the firearm is dropped while in the deployed orientation 102.

In some examples, the trigger safety can have additional functionality such as to prevent discharge of the intrinsically safe firearm in the event that the firearm is "snapped" into the deployed orientation 102. As described herein, the trigger 132 is rotated approximately 90 degrees when the firearm is in the stowed orientation 100. As the firearm is converted from the stowed orientation 100 to the deployed orientation 102, the trigger 132 rotates back the approximately 90 degrees. If this back rotation of the trigger 132 happened quickly enough, the inertia of the trigger 132 could deflect the trigger bar 1240 and cause the firearm to discharge. However, the trigger safety prevents the trigger 132 from deflecting the trigger bar 1240 in this scenario by stopping the trigger's rotation as illustrated in FIG. 12B.

As shown in FIG. 12C, the trigger safety has been disengaged and the trigger 132 has rotated about the trigger pivot 1222 and a portion of the upper trigger 1212 contacting the trigger bar pin 1242 has actuated the trigger bar pin 1242 towards the trigger bar end 1246 which has advanced the trigger bar 1240. As illustrated, advancing the trigger bar 1240 pulls the paw 1236 forward until the paw 1236 engages the sear 1238 which begins to release the firing pin 800 by releasing the sear interface 822.

As shown in FIG. 12D, continued rotation of the trigger 132 about the trigger pivot 1222 causes the lower trigger 1214 to actuate towards the integral stop 1248 and causes the upper trigger 1212 to continue to actuate the trigger bar pin 1242 towards the trigger bar end 1246. As illustrated, actuating the trigger bar pin 1242 towards the trigger bar end 1246 advances the trigger bar 1240 which pulls the paw 1236 forward and further engages the sear 1238. As shown, the sear 1238 is about to release the firing pin 800 which will discharge the firearm as shown in FIG. 12E.

As illustrated in FIG. 12E, the firing pin 800 has been released and the striker 810 is actuated into a primer of the chambered round 218. In some examples, the integral stop 1248 prevents any further rotation of the trigger 132 and discharging the chambered round 218 actuates the slide 108 in a direction opposite of the direction of the discharged round. In an example, the slide 108 includes a linear cam mechanism (not shown) which rotates the paw 1236 causing the paw 1236 to release the sear 1238.

As illustrated in FIG. 12F, when the paw 1236 releases the sear 1238, the released sear 1238 catches the firing pin 800 as the slide 108 cycles. As shown in FIG. 12F, the trigger 132 is still pulled and additional rotation of the trigger 132 is prevented by the integrated stop 1248. For example, releasing the trigger 132 allows the trigger bar 1240 and paw 1236 to retract and once the paw 1236 is clear of the sear 1238, the paw 1236 can rotate forward to engage the sear 1238 again and the system is reset and ready to discharge a round 212.

Figure 13B:
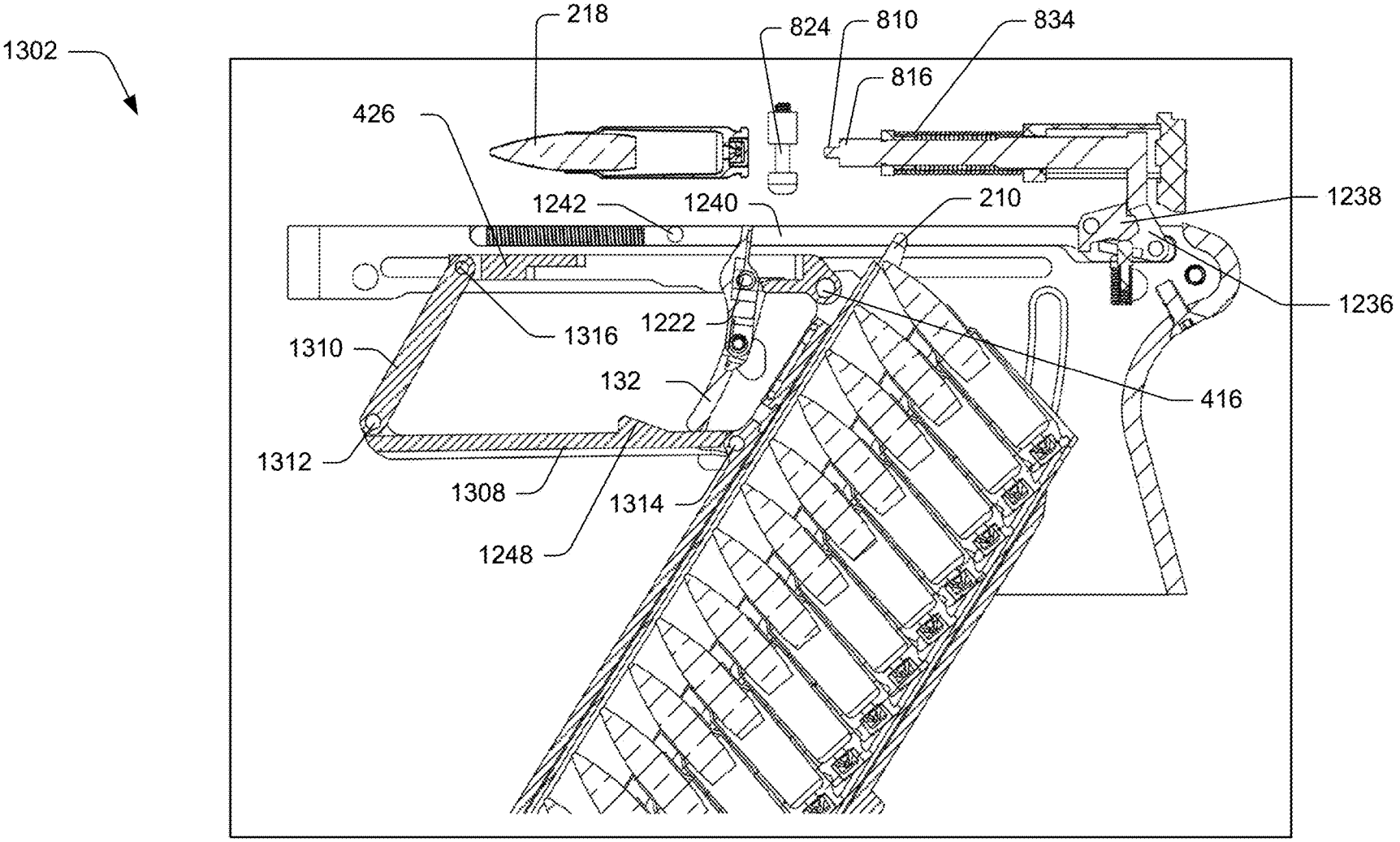
Figure 13C:
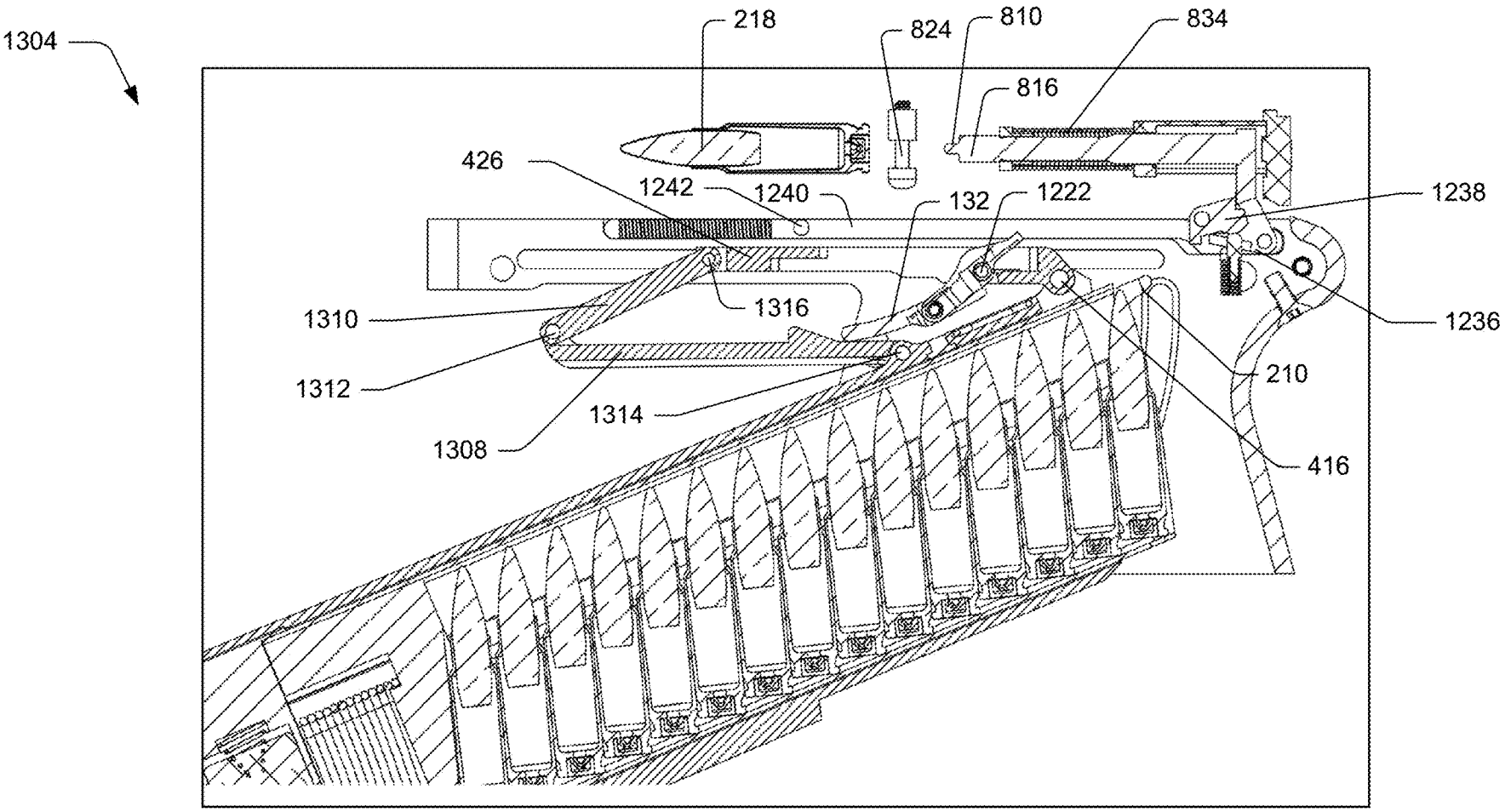
Figure 13D:
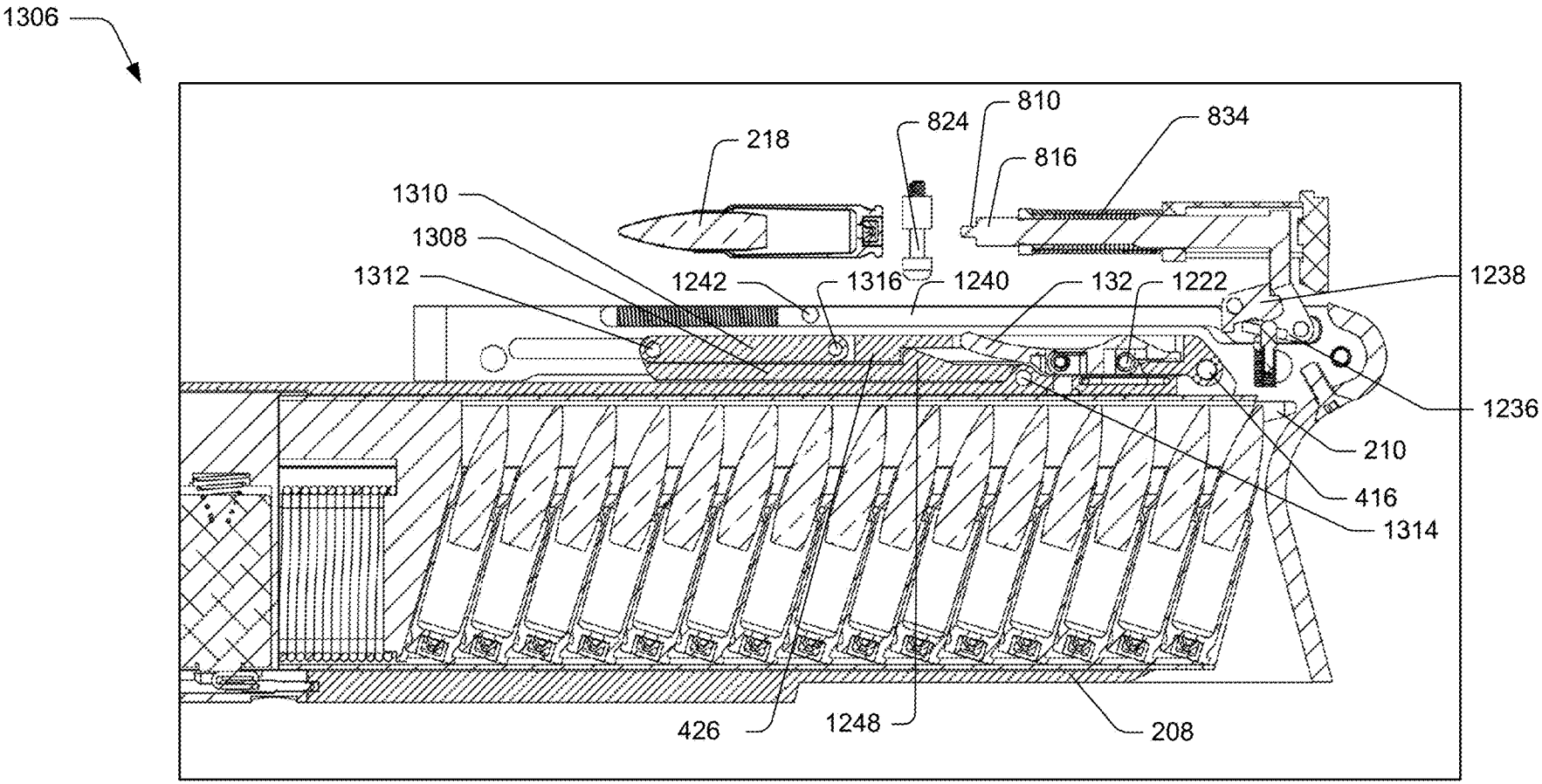

FIGS. 13A-13D are illustrations depicting component kinematics as an intrinsically safe firearm is converted from a deployed orientation to a stowed orientation. FIG. 13A illustrates a cross-section of components of the firearm in the deployed orientation 1300. FIG. 13B illustrates a cross-section of components of the firearm actuating out of the deployed orientation 1302. FIG. 13C illustrates a cross-section of components of the firearm actuating into a stowed orientation 1304. FIG. 13D illustrates a cross-section of components of the firearm in the stowed orientation 1306.

As shown in FIG. 13A, the trigger guard 134 includes a first arm 1308 and a second arm 1310 connected by a first guard pivot 1312. In an example, the first arm 1308 may also be connected to a portion of the firearm by a second guard pivot 1314. In another example, the second arm 1310 may also be connected to a portion of the firearm by a third guard pivot 1316. For example, the third guard pivot 1316 may be disposed in a frame channel 1318 of the frame 114 such that the third guard pivot 1316 may actuate within the frame channel 1318. As shown, the integrated stop 1248 is disposed between the trigger 132 and the second guard pivot 1314. In some examples, FIG. 13A presents the firearm in the in the cocked configuration shown in FIG. 12B. As illustrated, the carriage 426 may be partially disposed in the frame channel 1318 and the carriage 426 may be configured to actuate within the frame channel 1318. For example, a portion of the carriage 426 may be connected to the second arm 1310 by the third guard pivot 1316 such that an actuation of the carriage 426 may be configured to actuate the second arm 1310.

As shown in FIG. 13B, the handle 116 has rotated relative to the pivot pin 416 and the second guard pivot 1314. As further shown, the second arm 1310 has rotated about the first guard pivot 1312 and the third guard pivot 1316 has actuated in the frame channel 1318. In some examples, an actuation of the carriage 426 in the frame channel 1318 can actuate the third guard pivot 1316 in the frame channel 1318. As illustrated in this example, the third guard pivot 1316 has actuated towards the trigger 132 within the frame channel 1318. In an example, the first arm 1308 contacts the trigger 132 and the trigger 132 has actuated away from the trigger bar pin 1242. In this example, no portion of the trigger 132 contacts the trigger bar pin 1242. As also illustrated, the trigger 132 has begun to rotate about the trigger pivot 1222 in a direction opposite of the direction the trigger 132 rotates about the trigger pivot 1222 when a user pulls the trigger 132 to discharge a round when the firearm is in the deployed orientation 102. Additionally, the integrated stop 1248 is now shown disposed between the trigger 132 and the first guard pivot 1312.

As shown in FIG. 13C, the handle 116 has rotated further relative to the pivot pin 416 and the second guard pivot 1314. As illustrated, the second arm 1310 has rotated further about the first guard pivot 1312 and the third guard pivot 1316 has actuated further in the frame channel 1318 towards the trigger bar pin 1242. The carriage 426 is shown as having further actuated in the frame channel 1318 and in some examples the actuation of the carriage 426 may be configured to actuate the third guard pivot 1316. For example, an amount of the first arm 1308 in contact with the trigger 132 has increased and the trigger 132 has actuated further away from the trigger bar pin 1242. In this example, no portion of the trigger 132 contacts the trigger bar pin 1242. As shown, the trigger 132 has continued to rotate about the trigger pivot 1222 in the direction opposite of the direction the trigger 132 rotates when a user pulls the trigger 132 to discharge a round when the firearm is in the deployed orientation 102. As further shown, the trigger 132 is disposed between the integrated stop 1248 and the second guard pivot 1314. In an example, the carriage 426 may be connected to the pivot pin 416 and an actuation of the carriage 426 may be configured to actuate a portion of the trigger 132. For example, the carriage 426 and a portion of the trigger 132 may be connected by the pivot pin 416 such that an actuation of pivot pin 416 actuates the trigger 132.

As shown in FIG. 13D, the handle 116 has fully rotated relative to the pivot pin 416 and the latch 118 (not shown) temporarily fixes the firearm in the stowed orientation 100. As illustrated, the second arm 1310 has fully rotated about the first guard pivot 1312 and the second aim 1310 has folded onto the first arm 1308. The carriage 426 is shown fully actuated relative to the frame 114 and a portion of the carriage 426 may be adjacent to the integral stop 1248 in some examples.

For example, the third guard pivot 1316 is shown fully actuated within the frame channel 1318 such that the third guard pivot 1316 is disposed below the trigger bar 1240 and above the first arm 1308. In another example, the third guard pivot 1316 is shown disposed between the first guard pivot 1312 and the second guard pivot 1314. As further illustrated, the trigger bar pin 1242 is disposed between the first guard pivot 1312 and the third guard pivot 1316, e.g., the trigger bar pin 1242 is disposed nearer to the third guard pivot 1316 than the first guard pivot 1312. For example, the trigger 132 may be disposed between the integral stop 1248 and the pivot pin 416 and the integral stop 1248 is shown disposed between the trigger 132 and the third guard pivot 1316.

As illustrated in FIG. 13D, the first arm 1308 is disposed below the second arm 1310 and the trigger 132 and above the magazine 208. For example, the pivot pin 416 may be disposed below the trigger bar 1240 and above the magazine 208. In some examples, the first arm 1308, the second arm 1310, and the trigger 132 may be disposed below the trigger bar 1240 and above the magazine 208. As further shown, the trigger 132 is fully disconnected from the trigger bar 1240 and the trigger bar pin 1242 such that no portion of the trigger 132 contacts the trigger bar 1240, the paw 1236, or the sear 1238. Additionally, in this example, magazine safety 210 is fully disconnected from the firing pin safety 824 and the magazine safety 210 is illustrated to be disposed below the paw 1236 and the sear 1238. In some examples, the trigger guard 134 is continuous and does not include slots or gaps to interface with the trigger 132 and/or other elements of the trigger guard 134.

In some embodiments, the intrinsically safe firearm may include an additional feature or features to add additional functionality and/or to augment functionality described herein. For example, the firearm may include one or more sensors to decrease a risk that the firearm will be used by an unauthorized user. In one example, the intrinsically safe firearm may include a scanner such as a fingerprint or a thumbprint scanner to confirm a user as an authorized user before releasing the latch 118 to convert the firearm from the stowed orientation 100 to the deployed orientation 102. In this example, the scanner may be powered by the power supply 216.

In another example, the intrinsically safe firearm may be configured as a single-use firearm. Consider an example in which the intrinsically safe firearm is configured as a single-use firearm. In this example, the firearm may not include a removable magazine and may be provided initially in a stowed orientation 100. Continuing this example, a user may only be able to convert the firearm from the stowed orientation 100 to the deployed orientation 102 one time and after a single use, the firearm may no longer be operational. Other embodiments are also contemplated.

In some embodiments, the laser sight 130 may be pre-aligned such that it is usable as an accurate indicator of a path of a discharged round without adjusting parameters of the laser sight based on observed paths of discharged rounds. In other words, in some examples, the laser sight 130 can be useable without sighting-in the laser sight 130. In other embodiments, the laser sight 130 may be augmented or replaced by an illumination light such as a light emitting diode or a light emitting diode array. In these embodiments, the illumination light may provide dual functionality of illuminating an area in front of or around a user and may also temporarily blind or impair vision of a threat. In this manner, the illumination light can provide an additional safety feature which allows the user to identify a target as well as to identify potential non-targets in close proximity to the target. In these embodiments, the illumination light may be powered by the power supply 216.

In one or more embodiments, the intrinsically safe nature of the firearm in the stowed orientation 100 may be leveraged to provide augmented or additional functionality. For example, the firearm may combine aspects of lethal or less than lethal defenses with aspects of lethal defenses. In a particular example, some or all of the rounds 212 and/or the chambered round 218 may be non-lethal or less than lethal rounds. Non-lethal or less than lethal rounds may include rubber bullets, flash bang rounds, salt and/or pepper rounds, etc. Consider an example in which the chambered round 218 may be a non-lethal or less than lethal round. In this example, the user can discharge the chambered round 218 in a non-lethal attempt to dispatch the threat. Continuing this example, the remaining rounds 212 may be lethal rounds in such scenarios where the non-lethal attempt to dispatch the threat was unsuccessful. In a similar example, the chambered round 218 and one or more rounds 212 disposed a distance from the feed spring 214 may be non-lethal or less than lethal rounds. In this similar example, the user may discharge several non-lethal rounds in an attempt to dispatch the threat before discharging lethal rounds in the scenario in which the non-lethal attempts to dispatch the threat are not successful.

In another example, the chambered round 218 may be a lethal round, some of the rounds 212 disposed the distance from the feed spring 214 may be non-lethal or less than lethal rounds, and the remaining rounds 212 can be lethal rounds. Consider an example in which the chambered round 218 is a lethal round so that a lethal defense is available immediately after converting the firearm from the stowed orientation 100 to the deployed orientation 102. This gives the user an opportunity to assess the threat level and discharge the chambered round 218 to dispatch the threat or in a manner that warns the threat that the user has lethal defensive capabilities. Continuing this example, the user may then discharge one or more non-lethal rounds 212 in an attempt to dispatch the threat which can either augment the lethal force applied to the threat by the chambered round 218 or to replace the lethal force of the chambered round 218. As in the other examples, the additional lethal rounds 212 can be available and discharged if the user's previous attempts to dispatch the threat were unsuccessful.

Conclusion

Although the implementations of an intrinsically safe firearm have been described in language specific to structural features and/or methods, it is to be understood that the appended claims are not necessarily limited to the specific features or methods described. Rather, the specific features and methods are disclosed as example implementations of the intrinsically safe firearm, and other equivalent features and methods are intended to be within the scope of the appended claims. Further, various different examples are described and it is to be appreciated that each described example can be implemented independently or in connection with one or more other described examples.

What is claimed is:

1. A firearm comprising:

a frame;

a handle configured to actuate in a first direction relative to the frame and in an opposite second direction relative to the frame to render the firearm in a deployed state or a stowed state; and a firing pin, the firing pin configured to contact a primer of a round chambered in the firearm by disengaging a firing pin safety using a magazine safety of a magazine in the deployed state, and the firing pin mechanically prevented from contacting the primer of the round by disposing the firing pin safety between the firing pin and the primer in the stowed state.

2. The firearm as described in claim 1, wherein the firing pin is additionally mechanically prevented from contacting the primer by disconnecting a trigger from a trigger bar of the firearm.

3. The firearm as described in claim 1, wherein a channel of the firearm guides an actuation of the handle relative to the frame.

4. The firearm as described in claim 3, wherein the channel is curved.

5. The firearm as described in claim 1, wherein a slide of the firearm is not removable from the frame in the stowed state.

6. The firearm as described in claim 1, wherein a lateral projection of the handle covers a barrel of the firearm in the stowed state.

7. The firearm as described in claim 6, wherein the lateral projection is configured to absorb an impact of the round.

8. The firearm as described in claim 1, wherein the magazine is removable from the handle in the deployed state and the magazine is not removable from the handle in the stowed state.

9. A method for converting a firearm from a deployed state to a stowed state, a magazine safety disengages a firing pin safety of the firearm in the deployed state, the method comprising:

actuating a handle of the firearm relative to a frame of the firearm from the deployed state to the stowed state; and preventing a firing pin from contacting a round in a chamber of the firearm by disposing the firing pin safety between the firing pin and the round in the stowed state.

10. The method as described in claim 9, further comprising disconnecting a trigger from a trigger bar in the stowed state.

11. The method as described in claim 9, further comprising releasing at least one latch of the firearm.

12. The method as described in claim 9, further comprising actuating a portion of the handle through a channel of the frame.

13. The method as described in claim 12, wherein the channel is curved.

14. The method as described in claim 9, further comprising covering a barrel of the firearm with a lateral projection of the handle in the stowed state.

15. A firearm comprising:

a frame;

a handle configured to actuate in first and second directions relative to the frame to render the firearm in a first state or a second state; and a firing pin, the firing pin configured to contact a round disposed in the firearm by disengaging a firing pin safety using a magazine safety in the first state, and the firing pin prevented from contacting the round by disposing the firing pin safety between the round and the firing pin in the second state.

16. The firearm as described in claim 15, wherein a trigger is disconnected from a trigger bar of the firearm in second state.

17. The firearm as described in claim 15, wherein a channel of the firearm guides an actuation of the handle relative to the frame.

18. The firearm as described in claim 17, wherein the channel is curved.

19. The firearm as described in claim 15, wherein the handle is configured to actuate in the first and second directions relative to the frame without axial movement of the handle relative to the frame.

20. The firearm as described in claim 15, further comprising a power supply and a laser sight, the laser sight is electrically connected to the power supply in the first state and the laser sight is not electrically connected to the power supply in the second state.

* * * * *